United States Patent [19]

Aoki

[11] Patent Number: 4,470,332

[45] Date of Patent: Sep. 11, 1984

[54] ELECTRONIC MUSICAL INSTRUMENT WITH COUNTER MELODY FUNCTION

[75] Inventor: Eiichiro Aoki, Hamamatsu, Japan

[73] Assignee: Nippon Gakki Seizo Kabushiki Kaisha, Hamamatsu, Japan

[21] Appl. No.: 472,914

[22] Filed: Mar. 14, 1983

Related U.S. Application Data

[63] Continuation of Ser. No. 250,089, Apr. 1, 1981, abandoned.

[30] Foreign Application Priority Data

Apr. 12, 1980 [JP] Japan ..... 55-48537

[51] Int. Cl.[3] ..... G10F 1/00

[52] U.S. Cl. ..... 84/1.03; 84/1.24; 84/DIG. 22

[58] Field of Search ..... 84/1.03, 1.24, DIG. 22, 84/1.01

[56] References Cited

U.S. PATENT DOCUMENTS

| | | | |
|---|---|---|---|
| 4,120,225 | 10/1978 | Dietrich et al. | 84/1.03 |
| 4,191,081 | 3/1980 | Devtsch et al. | 84/1.24 |
| 4,220,068 | 9/1980 | Howell et al. | 84/1.03 |
| 4,274,321 | 6/1981 | Swartz | 84/1.03 |
| 4,295,402 | 10/1981 | Devtsch et al. | 84/1.03 |
| 4,311,076 | 1/1982 | Rucitenwald et al. | 84/1.03 |
| 4,311,077 | 1/1982 | Hall | 84/1.03 |
| 4,331,057 | 5/1982 | Wheelwright et al. | 84/DIG. 22 |
| 4,379,422 | 4/1983 | Munch et al. | 84/1.19 |

*Primary Examiner*—Forester W. Isen

*Attorney, Agent, or Firm*—Spensley Horn Jubas & Lubitz

[57] ABSTRACT

The electronic musical instrument is provided, in addition to usual tone producing circuitries associated with playing keys, with a chord designating circuit designating, according to key depression, a plurality of notes of that constitute a chord, a change detecting circuit for detecting a change in designated chord, a note selection circuit for selecting a note from among the designated notes according to a predetermined condition related to the preceeding selected note when the chord change is detected, and a musical tone forming circuit for forming musical tones of the selected notes. Succession of the selected notes constitute a counter line melody automatically established to meet the music being played on the instrument.

34 Claims, 25 Drawing Figures

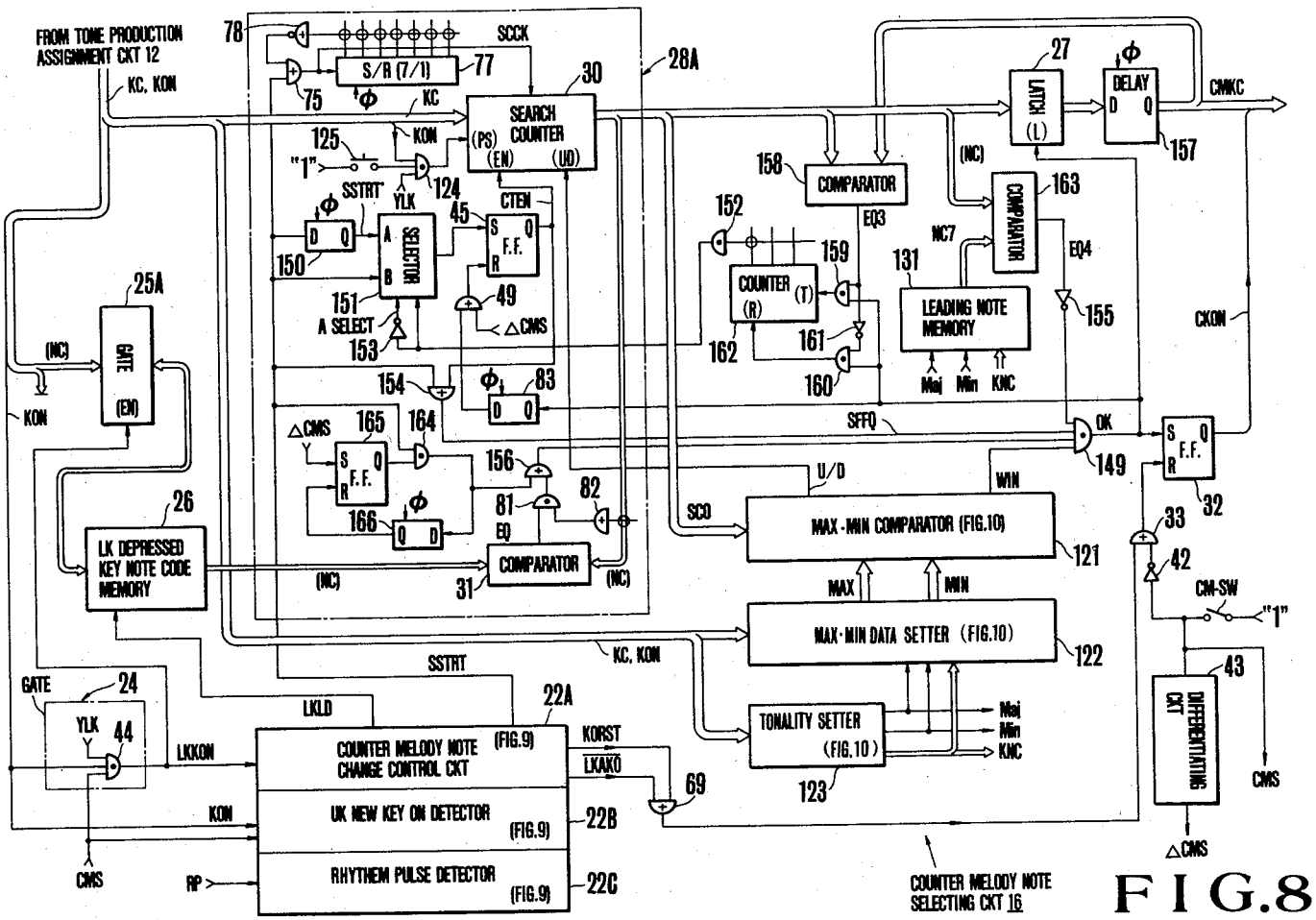
FIG.8
FROM TONE PRODUCTION ASSIGNMENT CKT 12
KC, KON
SCCK
S/R (7/1)
SEARCH COUNTER
(PS)
(EN)
(UD)
SELECTOR
A SELECT
CTEN
F.F.
COMPARATOR
COUNTER
(T)
(R)
LATCH
(L)
DELAY
LEADING NOTE MEMORY
MAX-MIN COMPARATOR (FIG.10)
MAX-MIN DATA SETTER (FIG.10)
TONALITY SETTER (FIG.10)
COUNTER MELODY NOTE SELECTING CKT 16
DIFFERENTIATING CKT
GATE
LK DEPRESSED KEY NOTE CODE MEMORY
COUNTER MELODY NOTE CHANGE CONTROL CKT
LK NEW KEY ON DETECTOR
RHYTHEM PULSE DETECTOR
YLK
KORST
LKAKO
LKLD
LKKON
SSTRT
CMS
△CMS
CKON
CMWC
CK-SW
KON
(INC)

STEP 206 SHOWN IN FIG.15

ELECTRONIC MUSICAL INSTRUMENT WITH COUNTER MELODY FUNCTION

This application is a continuation of Ser. No. 250,089, filed Apr. 1, 1981, now abandoned.

BACKGROUND OF THE INVENTION

This invention relates to an electronic musical instrument, more particularly an electronic musical instrument which automatically performs a counter line melody in the music being played.

A prior art electronic musical instrument which automatically performs a counter melody together with an accompaniment chord is disclosed, for example, in Japanese Preliminary Publication of Pat. No. 72213 of 1977. In the prior art automatic counter melody performing device disclosed therein a specific note among accompaniment chord constituting tones is used as the counter melody note so that the produced counter line melody lacks variety. For example, the specific note may be the root note of a chord, and where the root note is predetermined to be a counter melody note, only the root notes of the chords are used as the counter melody notes. Where either the 3rd degree note, 5th degree note, or the highest note played in the lower keyboard (a chord performance keyboard) is predetermined as the specific note, the counter melody notes are always fixed to such determined notes, only a monotonous counter line melody is produced, thus failing to realize an interesting musical performance. For instance, where the root notes are used as the counter melody notes, when the accompaniment chord changes from C major chord to A minor chord and then to C major chord, the counter melody note changes from the C note to the A note but it then returns again to the C note. Generally, the number of kinds of the chords utilized in one music is limited by the performance tonality of the music and so that in most cases a limited number of chords are repeatedly used. Consequently, in an actual music performance, the same note might be used repeatedly very often, if the same chord is repeatedly used.

SUMMARY OF THE INVENTION

Accordingly, it is an object of this invention to provide an electronic musical instrument that can automatically perform a counter melody rich in variety and realize comfortable musical performance.

Another object of this invention is to provide an electronic musical instrument capable of changing a note in response to not only changes in accompaniment chords (that is changes in the depressed key states or an accompaniment keyboard) but also changes in melody notes (that is the depressed key state changes or a melody performance keyboard) or changes in rhythm pulses, in other words capable of rendering an element other than the accompaniment chord to cause the counter melody notes change.

Still another object of this invention is to provide an electronic musical instrument capable of controlling a search of counter melody notes by considering musical theory.

According to this invention these and further objects can be accomplished by providing an electronic musical instrument comprising a keyboard including a plurality of keys, a circuit for producing a note designating signal that simultaneously designates a plurality of notes of one set corresponding to the depressed keys, a detection circuit for detecting a variation in a depressed key state, a selection circuit responsive to an output of the detection circuit for selecting a signal corresponding to a note among the designated notes according to a condition related to a note selected immediately before, and a musical tone signal forming circuit for forming a musical tone signal in accordance with an output of the selection circuit.

According to a preferred embodiment of this invention, instead of fixing a specific note as the counter melody note relating to the accompaniment notes, each time the accompaniment chord is changed, the note used as the counter melody note is changed with a predetermined motion pattern. More particularly, the electronic musical instrument of this invention is characterized in that it comprises a counter melody note change control means which detects the chord change and controls the counter melody note to change, search means which searches among notes including the same notes as the chord constituting tones or tones having an octave relation with respect to the chord constituting notes and selects particular notes to be used for the counter melody according to a predetermined counter melody motion pattern each time the change of the chords is detected by the counter melody note change control means, and a counter melody musical tone signal forming means which forms musical tone signals corresponding to the notes selected by the search means, that is the counter line melody notes. The counter melody motion pattern gives to the counter melody performance an outline or tendency of the counter melody motion. According to the prior art system, since only specific notes in the accompaniment notes are used as the counter melody notes, the motion of the counter melody depends only upon the changes of the accompaniment notes, the counter melody performance itself did not make a positive melody performance. In contrast according to this invention, the counter melody note not only depends on the accompaniment chord but also can perform a counter melody performance having a unique melody motion according to a predetermined progression pattern.

According to one example of the counter melody progression pattern the tone pitch of the counter melody note is sequentially raised or lowered each time the chord varies. More particularly, in the following description, a progression pattern is illustrated in which sequential up-going and sequential down-going movement of the counter melody notes are alternately repeated. There are two methods of controlling the switching between up and down (up-going movement and down-going movement in short) of the counter melody progression. According to one method an upper limit note and a lower limit note are set and the up and down of the counter melody note is repeated between these limits. According to the other method up and down are switched each time a predetermined number of counter melody notes have been produced. With any method it is possible to select whether the counter melody performance is started with an up mode or a down mode.

The search means includes a counter melody note search means which scans towards high tone side or low tone side depending upon whether the present counter melody progression is in the up mode or the down mode. The counter melody note search means starts the scanning when the accompaniment chord has varied, and stops the scanning when a note which is the same as a chord constituting note is detected during the scanning, thus selecting the note to be the counter melody note for that instance. Accordingly, each time the accompaniment chord varies start and stop of the scanning are repeated for selecting a counter melody note at each repetition whereby the melody progression of the counter melody note sequentially rises (toward the high note side) or lowers (toward the low note side).

Changing of the counter melody note can be accomplished by causing the search means to respond not only to the variation in the depressed key state of the accompaniment keyboard but also to a change in the depressed key state of the melody performance keyboard or to a rhythm pulse change.

When a progression pattern is selected in which sequential up and down of the counter melody notes are repeated between the upper and lower limit notes, the once set upper or lower limit note can be corrected to other note, if there is a fear that the once set upper or lower limit note can be a note contradicting the end theory of music. A predetermined counter melody note for end can be selectively produced independently of the progression pattern, when a music end is judged from the progression of the accompaniment notes and the progression of the counter melody notes.

The term "chord" is not limited to a consonant but may, for example, be notes of a plurality of keys concurrently depressed on the accompaniment keyboard or a plurality of notes concurrently produced based on the key depression in the keyboard. As a consequence the term "chord constituting notes" means not only notes normally constituting a chord but also respective notes simultaneously produced according to a designation made by a chord designation means in the accompaniment keyboard. Further, the "chord designation means" is not limited to the accompaniment keyboard including normal playing keys but may be chord selection buttons, for example. The term "accompaniment keyboard" may not be a key board of exclusive use for performing an accompaniment. Further, the "accompaniment keyboard" is not required to be a whole keyboard but may be a fractional part of a keyboard.

The term "cadence theory" or "end feeling" in the following description does not means perfect end of a music but also means an imperfect end (or half-way stop) at an intermediate point of a music (so-called resolution). Accordingly, terms "end note", "end chord" and "counter melody note for end" do not means a note (chord) at which the music perfectly ends, but means half-way stop of the music or a note (chord) that gives a feeling of such an end wherein the music is continued thereafter.

BRIEF DESCRIPTION OF THE DRAWINGS

In the accompanying drawings:

FIG. 8 is a block diagram showing still another embodiment of the counter melody note selection circuit shown in FIG. 1;

DESCRIPTION OF THE PREFERRED EMBODIMENT

Figure 1:
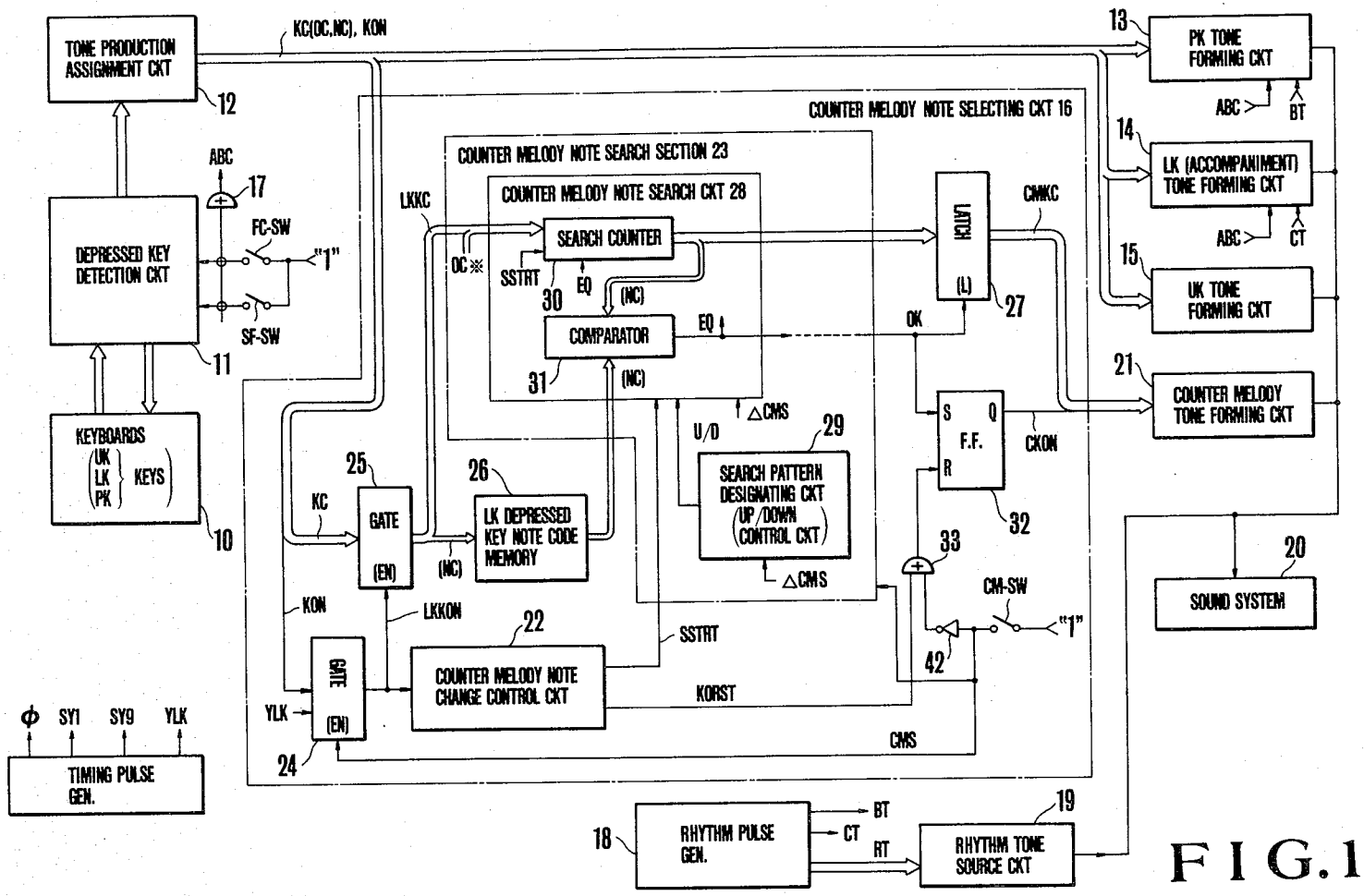
FIG. 1 is a block diagram showing one embodiment of an electronic musical instrument according to this invention.

In a preferred embodiment of this invention shown in FIG. 1, a keyboard unit 10 comprises an upper keyboard, a lower keyboard and a pedal keyboard. Usually, the upper keyboard is used for a melody performance, and the lower keyboard is used for an accompaniment (chord) performance. A depressed key detection circuit 11 is provided to detect depression and release of a key for supplying an information showing a depressed key to a tone production assignment circuit 12 which assigns tone production to either one of a plurality of musical tone production channels and produces a key code KC and a key-on signal KON that specify the depressed key in accordance with the assignment. The depressed key detection circuit 11 includes a circuit that conducts an automatic bass chord performance. In connection with the depressed key detection circuit 11 are provided a fingered chord mode selection switch FC-SW and a single finger mode selection switch SF-SW which respectively select a fingered chord mode operation and a single finger mode operation for performing the automatic bass chord performance. In the fingered chord mode, notes of the depressed keys in the accompaniment keyboard, i.e., the lower keyboard are all produced as the accompaniment chord, whereas in the single fingered mode, the note of the single depressed key in the lower or accompaniment keyboard is used as the root note of the chord to be produced and the remaining chord constituting notes (subordinate notes) are produced automatically to conduct a chord performance.

For example, the musical tone production channel comprises a total of 15 channels, 7 thereof being the upper keyboard channels, 7 being the lower keyboard channels, and one being the pedal keyboard channel. The tone production assignment circuit 12 assigns the tone production of a depressed key in the upper keyboard to either one of the upper keyboard channels, assigns the tone production of a depressed key in the lower keyboard (at the time of the automatic bass chord performance, respective chord constituting notes of the accompaniment chord in the fingered chord mode, or respective constituting notes of an automatically produced accompaniment chord in the single finger mode) to either one of the lower keyboard channels, and assigns the tone production of a depressed key in the pedal keyboard (or the automatic bass tone) to the pedal keyboard channel. The tone production assignment circuit 12 produces, on the time division basis, a key code KC and a key-on signal KON of a key (note) assigned to each channel. The key code KC is constituted by a four bit note code NC and a three bit octave code OC. One example of the relationship between the value of the note code NC and the note name is shown in the following table I, while one example of the relationship between the value of the octave code OC and a tone range is shown in the following Table II.

TABLE I

| note name | NC (binary representation) MSB | | | LSR | decimal representation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1 | 1 | 15 |

TABLE II

| note range | OC (binary representation) MSB | | LSB |
|---|---|---|---|
| C2 | 0 | 0 | 0 |
| C#2 to C3 | 0 | 0 | 1 |
| C#3 to C4 | 0 | 1 | 0 |
| C#4 to C5 | 0 | 1 | 1 |
| C#5 to C6 | 1 | 0 | 0 |
| C#6 to C7 | 1 | 0 | 1 |

The key-on signal comprises one bit data which is "1" when a key is depressed and "0" when the key is released.

The key code KC and the key-on signal KON for each channel and outputted from the tone production assignment circuit 12 are supplied to a pedal keyboard musical tone (PK tone) signal forming circuit 13, to a lower keyboard musical tone (LK tone) signal forming circuit 14, to an upper keyboard musical tone (UK tone) signal forming circuit 15, and to a counter melody tone forming circuit 16. The PK tone signal forming circuit 13 forms a musical tone signal of a pedal keyboard depressed key (or the automatic bass tone) according to the key code KC and the key-on signal KON which are assigned to the pedal keyboard channel. The LK (accompaniment) tone signal forming circuit 14 form a musical tone signal of a lower keyboard depressed key (or an accompaniment chord of the automatic bass chord performance) according to a key code KC and a key-on signal which are assigned to the lower keyboard channel. The UK tone signal forming circuit 15 forms a musical tone signal of an upper keyboard depressed key (melody tone) according to a key code KC and a key-on signal KON which are assigned to the upper keyboard channel. Respective tone signal forming circuits 13, 14 and 15 are constructed to select any desired tone color for each keyboard which is suitable for a bass tone, an accompaniment tone, and a melody tone for example.

At the time of the automatic bass chord performance, generation of a musical tone signal formed by the PK tone signal forming circuit 13 or the LK tone signal forming circuit 14 is controlled by a bass tone production timing pattern pulse BT or a chord production timing pattern pulse CT. Where the fingered chord switch FC-SW for selecting the automatic bass chord performance or a single finger chord switch SF-SW is closed an automatic bass/chord mode signal ABC outputted from an OR gate circuit 7 becomes "1" and applied to the PK tone signal forming circuit 13 and to the LK tone signal forming circuit 14. When this output signal ABC is "1", the timing of generation of the bass tone musical tone signal or the accompaniment chord musical tone signal is controlled by a pattern pulse BT or CT supplied from a rhythm pulse generator 18 to be described later. However when the signal ABC is "0" generation of the bass tone (a pedal keyboard depressed key tone) musical tone signal or the accompaniment (lower keyboard depressed key tone) is inhibited by the pattern pulse BT or CT. The rhythm pulse generator 18 also produces a rhythm pattern pulse RT in addition to the tone production timing pattern pulses BT and CT regarding the bass tone and the chord, and in response to the rhythm pattern pulse RT, a rhythm tone source circuit 19 produces a rhythm tone signal. Of course, the rhythm pattern pulse generator 18 is constructed to be able to select any desired rhythm and pattern. The musical tone signals generated by respective musical tone forming circuits 13 through 15 and the rhythm tone source circuit 19 are applied to the sound system and produced as a musical tone.

Whenever the key depression state of the accompaniment keyboard changes, a counter melody tone selection circuit 16 selects a suitable note among the constituting notes (including those in an octave relation) of an accompaniment chord produced by a depressed key of the accompaniment (lower) keyboard (or an accompaniment chord automatically produced by a lower keyboard depressed key at the time of the single finger mode) according to a predetermined counter melody progression pattern and outputs the data of the selected note as the data representing a counter melody note. A counter melody note signal forming circuit 21 forms a musical tone signal of the counter melody note based on the tone data selected by the counter melody tone selection circuit 16 and supplies the musical tone signal thus formed to the sound system 20. The tone color of the counter melody tone formed by the counter melody tone signal forming circuit 21 may be made to be the same as that of the upper keyboard (melody tone) by interlocking the forming circuits 15 and 21 or may be different.

The counter melody note selection circuit 16 comprises a counter melody note change control circuit 22 and a counter melody note search section 23 as its principal elements. The counter melody note change control circuit 22 detects a change of the depressed key state on the accompaniment keyboard (lower keyboard), that is the fact that a key is newly depressed or released for producing signals (a search start signal SSTRT and a key-on reset signal KONRST) that control the change of the counter melody note according to such detection. Of the key code KC and the key-on signal KON supplied from the tone production assignment circuit 12, the key-on signal KON is applied to a lower keyboard key-on signal gate circuit 24 to select a key-on signal LKKON regarding the lower keyboard channel. The counter melody note change control circuit 22 detects whether the key depression state of the accompaniment keyboard (lower keyboard) has been changed or not based on the lower keyboard key-on signal LKKON selected by the gate circuit 24. The enabling input EN of the lower keyboard key-on signal gate circuit 24 is supplied with a counter melody selection signal CMS from a counter melody switch CM-SW so that the gate 24 is enabled only when the counter melody is selected, that is when the signal CMS becomes "1" as a result of closure of the counter melody switch CM-SW.

The key code KC supplied to the counter melody note selection circuit 16 from the tone production assignment circuit 12 is applied to a lower keyboard (LK) key code gate circuit 25. The enabling input EN thereof is supplied with the lower keyboard key-on signal LKK from the lower keyboard (LK) key-on gate circuit 24 so as to select a key code of a depressed key among key codes KC assigned to the lower keyboard channel (that is a key code KC given when signal LKKON is "1"). The note code NC among the key codes KC of the lower keyboard (LK) depressed key selected by the gate circuit 25 is stored in a lower keyboard depressed key note code memory device 26.

The search section 23 of the melody note selection circuit 16 searches or selects a counter melody note from the same tones, or notes having an octave relation thereto, as the chord constituting notes (the note codes NC representing the tone names of the chord constituting notes are stored in the LK depressed key note code memory device 26) according to the melody progression pattern. Such search effected by the search section is done when a search start signal SSTRT is given from the counter melody note change control circuit 22, that is when the lower keyboard depressed key state changes. A key code KC representing a tone (counter melody tone) searched by the search section 23 is latched by a counter melody key code latch circuit 27 and then supplied to the counter melody note musical signal forming circuit 21.

The search section 23 comprises a counter melody note search circuit 28 and a search pattern designation circuit 29. When supplied with the search start signal SSTRT from the counter melody note change control circuit 22, the counter melody note search circuit 28 searches a counter melody note according to a counter melody progression pattern designated by the search pattern designation circuit 29 which designates a search pattern for obtaining a desired progression pattern and constituted by, for example, a up/down control circuit which designates a counter melody progression pattern which repeatedly counts down as the tone pitch of the counter melody note increases. However, it should be understood that the counter melody progression pattern, that is the search pattern of the counter melody note is not limited to a pattern in which count up or count down is repeated, and that any pattern may be used. In the following description, it is assumed that the counter melody progression pattern, that is the search pattern repeatedly counts up and counts down.

The counter melody note search circuit 28 comprises a search counter 30, which may be a up/down counter, for example, and a comparator 31. The search counter 30 is constituted by a 7 bit binary counter and its content corresponds to the key code KC. When supplied with the search start signal SSTRT, the search counter 30 starts its counting operation. More paticularly by sequentially producing key codes KC corresponding to respective keys, a scanning is made toward the high tone side or low tone side. Whether the counter is operated in a up count mode (scanning toward the high tone side) or in a down count mode (scanning toward low tone side) is determined by a up/down control signal U/D given by the search pattern designation circuit 29 (i.e., the up/down control circuit). The comparator 31 compares a note code NC stored in the LK depressed key note code memory device 26, and a portion (the count of the lower order 4 bits) corresponding to the note code NC of the count of the search counter 30 for producing a coincidence signal EQ when a coincidence is obtained, and based on the coincidence signal EQ a search completion signal OK is outputted from the search section 23. The search completion signal OK is applied to the load control input L of the counter melody key code latch circuit 27 for storing therein the count of the search counter 30 when the signal OK is produced, and the count latched by the latch circuit 27 is supplied to the counter melody musical tone signal forming circuit 21 as a key code CMKC of the counter melody note. Further, the search completion signal OK is applied to the set terminal S of a flip-flop circuit 32 which is preset before the operation of the search section 23 by a signal formed by inverting the output of the counter melody switch CM-SW, or an output "1" of an OR gate circuit 33 based on the key-on set signal KORST. Consequently, as the flip-flop circuit 32 is set by the search completion signal, the output Q of the flip-flop circuit 32 becomes "1" and this output Q is supplied to the counter melody musical tone signal forming circuit 21 as a key-on signal CKON of the counter melody note. Whereby the counter melody musical tone signal forming circuit 21 continuously produces a musical tone signal having a tone pitch corresponding to the content of the counter melody key code CMKC is accordance with the key-on signal. More particularly, once set the flip-flop circuit 32 would not be reset until a next key-on reset signal KORST is produced by the counter melody note control circuit 22, that is until the state of the lower keyboard depressed key changes. During this interval the key-on signal CKON is continuously maintained at "1" so that the counter melody note would be produced continuously based on the key-on signal CKON. The rhythm pulse generator 18 generates a tone production timing pattern pulse for the counter melody note (it is desirable that this timing pattern pulse has a pattern different from the bass tone production timing pattern pulse BT or the chord tone production timing pattern pulse CT) and can control the tone production timing of a counter melody note formed by the counter melody musical tone signal forming circuit 21 with this pattern pulse.

The counter melody note search circuit 28 is constructed to stop the counting operation of the search counter 30 when the search completion signal OK is produced, and when the next search start signal SSTRT is generated the counting operation of the search counter 30 is started again from a count at which the previous counting operation has stopped. When the search counter 30 operates in the up count mode, the count increases from the previous count (the key code of the counter melody note previously selected) so that a note on the higher tone side than the previously produced counter melody note is selected as a next counter melody note. Consequently, when the search counter 30 operates in the up count mode, each time the state of the lower keyboard depression changes (that is, whenever the accompaniment chord changes, the tone pitch of the counter melody note increases). Conversely, when the search counter 30 operates in the down count mode, each time the lower keyboard depression state changes the pitch of the counter melody note decreases.

Figure 2:
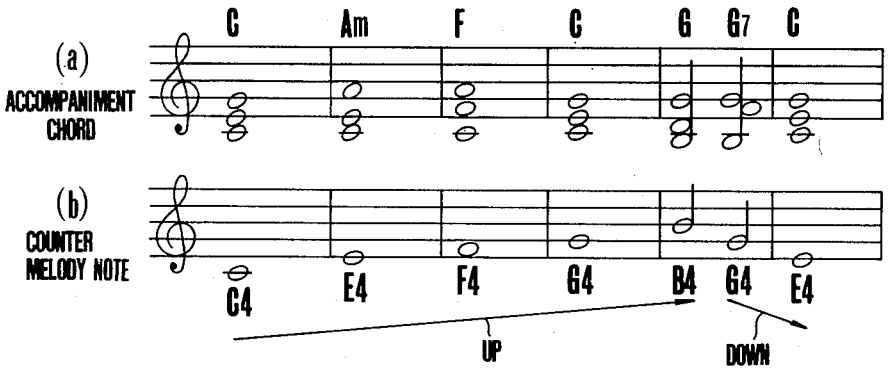
FIG. 2 shows musical notes showing accompaniment chords and counter melody notes corresponding thereto and performed automatically, these musical notes showing one example of a chord progression.

FIG. 2 shows one example of an up or down counter melody performance in which FIG. 2*a* shows one example of accompaniment chords played by depressing keys of the lower keyboard, while FIG. 2*b* one example of the counter melody notes automatically performed corresponding to the accompaniment chords described above. At first, a note C4 which is one of the C major chord constituting notes is produced as the counter melody note, and when it is now supposed that the mode is in the up mode (i.e., the search counter 30 operates in the up count mode), as the accompaniment chord is changed to A minor chord, a note E4 higher than the note C4 but is an A minor chord constituting note closest to the note C4 would be selected as the counter melody note. Thereafter, when the accompaniment chord is changed to F major chord, a note F4, one of the F major chord constituting notes and higher than the note E4 would be selected as the counter melody note. Then, when the accompaniment chord is changed to C major chord, a note G4, one of the C major chord constituting notes and higher than the note G4 would be selected as the counter melody note. Then, when the accompaniment chord is changed to G major chord, a note B4, one of the G major chord constituting notes and higher than the note G4 would be selected as the counter melody note. In the example shown in FIG. 2*b*, the up mode is terminated at the B4 note, and the mode is changed to the down mode. Accordingly, when the accompaniment chord is thereafter changed to G seventh chord, the note G4, one of the G seventh chord constituting notes and lower than the note B4 would be selected as the counter melody note. Upon change to C major chord, a C major chord constituting note E4 lower than the note G4 would be selected as the counter melody note. The length of the note of the accompaniment chord shown in FIG. 2*a* shows the length of the time of key depression of the lower keyboard but not always shows the length and timing of the accompaniment chord actually produced. As above described, at the time of the automatic bass chord performance chord, the tone producing timing of the accompaniment chord is controlled according to the chord production timing pattern pulse CT.

The control of switching the progression of the counter melody from up to down or vice versa is effected by the search pattern designation circuit 29 (up/-down control circuit). There are the following two methods of controlling up/down switching effected by the search pattern designation circuit 29. According to one method, the upper limit value (the highest tone of the counter melody note) and lower limit value (the lower most tone of the counter melody note) are preset, and when the upper limit value is reached during the up mode, the mode is switched to the down mode, and when the lower value is reached during the down mode, the mode is switched to the up mode. According to the other method the number of the counter melody notes to be produced in the up and down modes are preset and when a predetermined number of the counter melody notes are produced the mode is changed from up mode to down mode or vice versa. The detail of counter melody note selection circuit 16 for controlling the up/down switching effected by the search pattern designation circuit 29 is shown in FIG. 3.

Figure 3:
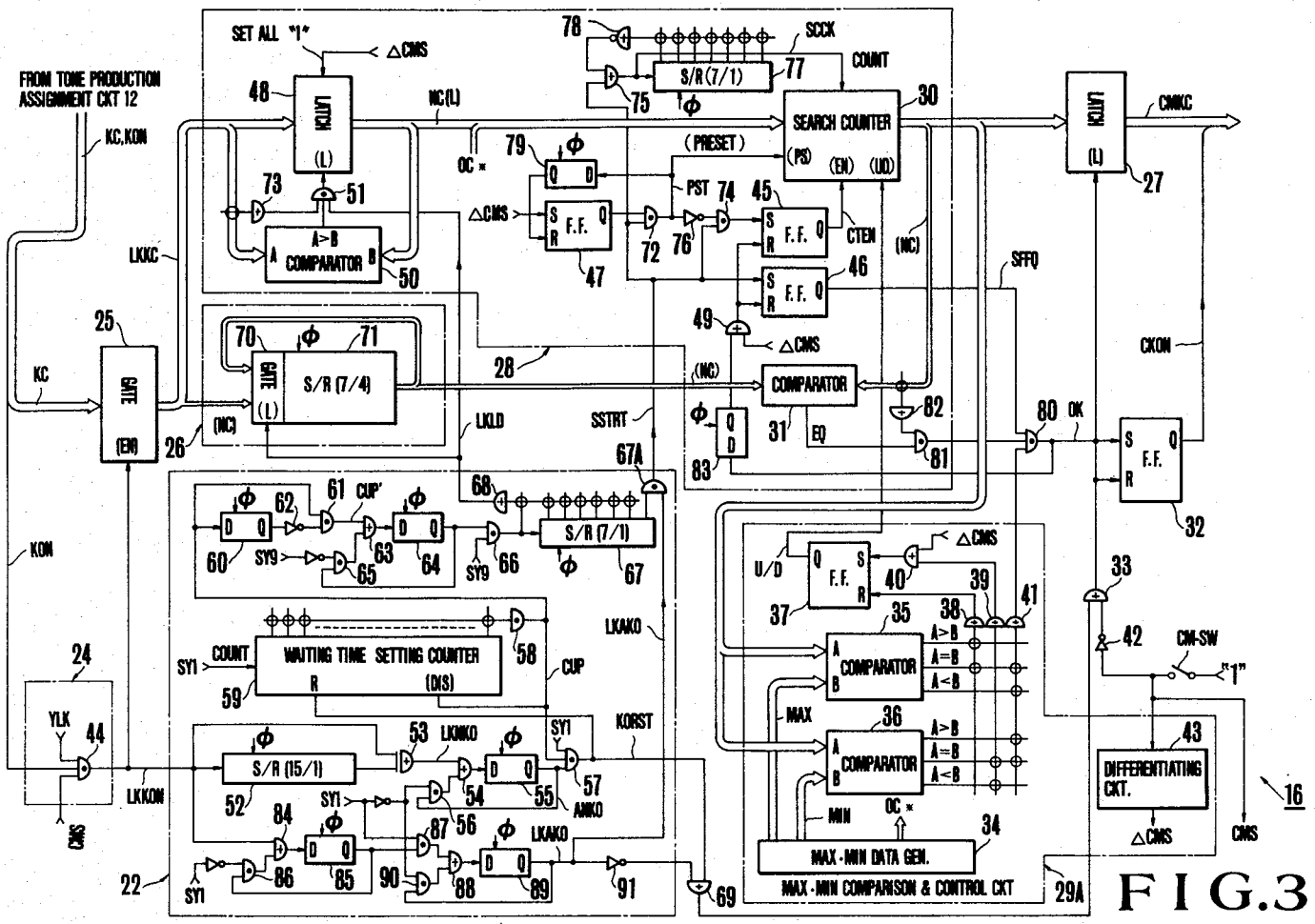
FIG. 3 is a connection diagram showing the detail of the counter melody note selection circuit shown in FIG. 1.

In FIG. 3, a circuit corresponding to the search pattern designation circuit 29 (up/down control circuit) is a max/min comparison and control circuit 29A including a max/min data generator 34 which generates a upper limit key code MAX representing the upper limit note of the counter melody performance and a lowe limit key code MIN representing the lower limit note, as well as an initial octave code OC* representing the octave range of the first note of the counter melody performance. These codes MAX, MIN and OC* may have fixed values or may be set to any values. It is to be noted, however, that the upper limit key code MAX and the lower limit key code MIN should be different by more than one octave. The upper limit key code MAX is applied to the B input of a comparator 35 for upper limit comparison, while the lower limit key code MIN is applied to the B input of a comparator 36 for lower limit comparison. The A inputs of the comparators 35 and 36 are supplied with the count output of the search counter 30.

The max/min comparison and control circuit 29A contains a flip-flop circuit 37 whose states are set by the outputs of the comparators 35 and 36 and the output Q of this flip-flop circuit is applied to the up/down control input UD of a search counter 30 to act as an up/down control signal U/D. When the result of comparison of the upper limit comparator 35 is A=B or A>B, that is when the count A of the search counter 30 is larger than the upper limit key code MAX (B), the output "1" of the comparator 35 corresponding to A=B or A>B is applied to the reset input R of the flip-flop circuit 37 via an OR gate circuit 38 to reset the flip-flop circuit. Accordingly, the output Q, or the up/down control signal U/D of the flip-flop circuit 37 becomes "0" to switch the search counter 30 to the down count mode. On the other hand when the result of comparison of the lower limit comparator 36 is A=B or A<B, that is when the count A of the search counter 30 becomes less than the lower key code MIN (B), the output "1" of the comparator 36 corresponding to A=B or A<B is applied to the set terminal of the flip-flop circuit 37 via OR gate circuits 39 and 40 to set the flip-flop circuit 37 with the result that the output Q or the up/down control signal of the flip-flop circuit 37 becomes "1" thus switching the search counter 30 to the up count mode. When the count A of the search counter 30 is within a range between the lower limit key code MIN and the upper limit key code MAX, the output A=B or A<B of the comparator 35 which compares the upper limit 5 becomes "1", and the output A=B or A<B of the comparator 36 becomes "1". These outputs "1" are applied to the inputs of an OR gate circuit 41.

In FIG. 3 when the counter melody switch CM-SW is open, the output "1" of an inverter 42 which inverts the output "0" of ths switch CM-SW is applied to the reset input R of a key-on signal forming flip-flop circuit 32 to maintain the same at the reset state. Upon closure of the switch CM-SW, the output of the inverter 42 becomes "0" thus setting the flip-flop circuit 32 by the search completion signal. At the same time, the counter melody selection signal CMS changes to "1" so that the counter melody note selection circuit 16 can select a counter melody note. Thus, the counter melody selection signal CMS is applied to an AND gate circuit 44 constituting the lower keyboard key-on signal gate circuit 24, thus enabling the AND gate circuit 44 to select the lower keyboard key-on signal LKKON among the key-on signals KON supplied from the tone production assignment circuit 12 shown in FIG. 1. As the counter melody selection signal CMS builds up to "1" a build-up differentiating circuit 43 operates to generate a single counter melody start pulse ΔCMS of a short width. This start pulse ΔCMS is applied to the set input S of a flip-flop circuit 37 via an OR gate circuit 40 in the max/min comparison and control circuit 29A. In the case of the example shown in FIG. 3, at the time of beginning the counter melody performance, the flip-flop circuit 37 is set and its output Q, i.e., the up/down control signal U/D is set to "1" thus starting the progression of the counter melody from the up mode. The count melody start pulse ΔCMS is also applied to the counter melody note search circuit 28 to set the same to the initial state.

In addition to the search counter 30 and the comparator 31, the counter melody note search circuit 28 shown in FIG. 3 comprises a flip-flop circuit 45 for controlling the operation of the counter, a flip-flop circuit 46 for storing the search state, a flip-flop circuit 47 for presetting the initial value of the counter, and a latch circuit 48 for detecting the lower most note. The counter melody start pulse CMS is applied to the reset inputs R of the flip-flop circuits 45 and 46 via an OR gate circuit 49 and to the set input S of the flip-flop circuit 47. This pulse ΔCMS also sets the content of the lower most tone detection latch circuit 48 to all "1" (the maximum value).

In the example shown in FIG. 3, the note name of the first note of the counter melody is to be made the note name of the lower most note among the constituting notes at the acompainment chord produced by the firstly depressed key and the octave range of the first note is imparted by the initial octave code OC* produced by the max/min data generator 34. Thus, by the combination of the latch circuit 48, comparator 50 and the AND gate circuit 51 of the counter melody note search circuit 28, the lower most note of the lower keyboard depressed key (chord constituting tone) is detected. A 7 bit key code constituted by the note code NC (L) latched by the latch circuit 48 and the initial octave code OC* is applied to the preset data input of the search counter 30 as the key code of the initial counter melody note. Thus, the search counter 30 starts counting starting from the preset initial key code.

Figure 4:
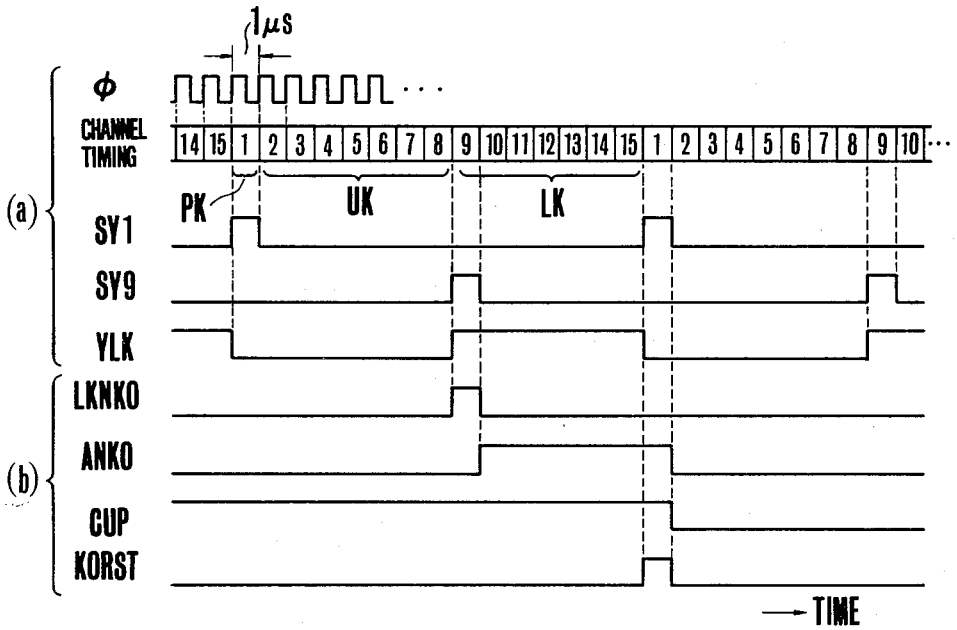
FIG. 4*a* is a time chart showing the time relation of the timing signals utilized in the circuit shown in FIG. 3.
FIG. 4*b* is a time chart showing one example of the operation of the counter melody note change control circuit shown in FIG. 3.

The counter melody note selection circuit 16 shown in FIG. 3 utilizes timing signals SY1, SY9 and YLK which are synchronous with the channel timings of the key code KC and the key-on signal KON outputted from the tone production assignment circuit 12 (FIG. 1) on the time division basis. One example of the relationship between the time divisioned channel timing of the key code KC and the key-on signal KON and respective timing signals SY1, SY9 and YLK is shown in FIG. 4*a*. In FIG. 4*a* channel timing 1 corresponds to the pedal keyboard channel PK, channel timings 2 through 8 to seven upper keyboard channels UK respectively, and channel timings 9 through 15 to seven lower keyboard channels LK respectively. The width of each channel timing corresponds to one period (for example one microsecond) of the clock pulse $\phi$. The tone production assignment circuit 12 (FIG. 1) repeatedly produces key code KC and key-on signal KON assigned to respective channels PK, UK and LK at channel timings 1 through 15 respectively. The timing signal SY1 is generated corresponding to the channel timing 1 while the timing signal SY9 is generated corresponding to the channel timing 9. The lower keyboard channel timing signals YLK are generated corresponding to channel timings 9 through 15 which are supplied with key codes KC and key-on signals KON which are assigned to the lower keyboard channels.

The key-on signal KON supplied to the counter melody note selection circuit 16 (FIG. 3) from the tone production assignment circuit 12 is applied to one input of an AND gate circuit 44 of the lower keyboard key-on signal gate circuit 24, while the other input of this AND gate circuit is supplied with the lower keyboard channel timing signal YLK and the counter melody selection signal CMS. Consequently, at the time of selecting the counter melody (when CMS is "1") only the key-on signal KON, that is the key-on signal of the lower keyboard depressed key (accompaniment chord constituting note) supplied at the lower keyboard channel timing (when YLK is "1") is selected by the AND gate circuit 44 to be outputted as the lower keyboard key-on signal LKKON.

This lower keyboard key-on signal LKKON is supplied to a shift register 52 and one input of an exclusive-OR gate circuit 53 in the counter melody note change control circuit 22. This shift register is of the 15-stage/1-bit type and shift controlled by the clock pulse $\phi$. Consequently, the lower keyboard key-on signal LKKON is delayed by 15 periods of the clock pulse $\phi$, i.e., 15 microseconds by the shift register 52 and then outputted from the 15th stage thereof.

The output from the 15th stage of the shift register 52, is applied to the other input of the exclusive-OR gate circuit 53. As a consequence, when the key-on signal LKKON of any one of the lower keyboard channels is applied to one input of the OR gate circuit 53, the state of a preceding key-on signal LKKON regarding the same channel is outputted from the shift register 52 and applied to the other input of the exclusive OR gate circuit 53. When a new key of the lower keyboard (accompaniment keyboard) is depressed, and when a key-on signal LKKON outputted from the AND gate circuit 44 at a lower keyboard channel timing to which the note of the newly depressed key is assigned firstly changes to "1", a signal representing the state of a key-on signal (LKKON) concurrently outputted from the shift register 52 15 microseconds before at the same channel timing is "0", and the output of the exclusive-OR gate circuit 53 becomes "1". Thereafter, as long as the key is maintained at the depressed state, the key-on signal of "1" is repeatedly produced at the same channel timing, so that the output of the exclusive-OR gate circuit 53 is "0". When a key of the lower keyboard is newly released, the key-on signal LKKON of the channel to which the note of the released key has been assigned will change to "0" from "1". Consequently, as the signal changes from "1" to "0", the output of the exclusive-OR gate circuit 53 becomes "1" only once. Thereafter, so long as a new depressed key assignment is not made for that channel, the key-on signal LKKON remains at "0", so that the output of the exclusive OR gate circuit 53 is "0". Accordingly, when a new key of the lower keyboard is depressed or a key is released, the output of the exclusive OR gate circuit 53 becomes "1" only once at the channel timing to which the key is assigned.

The output "1" of the exclusive-OR gate circuit 53 is applied to a delay flip-flop circuit 55 via an OR gate circut 54 to act as a lower keyboard new key-off signal LKNKO showing that the depressed key state of the lower keyboard has changed, i.e., the accompaniment chord has changed. The delay flip-flop circuit 55 is controlled by the clock pulse $\phi$ so as to delay inputted signal LKNKO of "1" by one microsecond and then output the delayed signal. The output of the delay flip-flop circuit 55 is self-held through one inputs of self-holding AND gate circuit 56 and OR gate circuit 54. The other input of the AND gate circuit 54. The other input of the AND gate circuit 56 is supplied with an inverted signal of the timing signal SY1 so that when the signal SY1 becomes L at the channel timing 1, the self-holding action of the flip-flop circuit 55 is released. Consequently, a lower keyboard new key on/off signal LKNKO generated at either one of the lower keyboard channel timing 9 through 15 (see FIG. 4*a*) would be stored in the delay flip-flop circuit 55 until the next channel timing 1 is reached. The output of the delay flip-flop circuit 55 storing the lower keyboard new key on/off signal LKNKO is termed herein as a lower keyboard any new key on/off signal ANKO. For example, as shown in FIG. 4*b*, when the lower keyboard new key on/off signal LKNKO becomes "1" at the first channel timing of the lower keyboard, the lower keyboard any new key on/off signal ANKO outputted from the delay flip-flop circuit 55 is maintained at "1" between the next channel timing 10 and the channel timing 1 of the next cycle.

The lower keyboard any new key on/off signal ANKO is applied to one input of an AND gate circuit 57 with its other input connected to receive the timing signal SY1 and the output signal CUB of an AND gate circuit 58 which is supplied with the ouputs of all stages of a waiting time setting counter 59, which takes the form of a 10 stage binary counter (counter of modulo $2^{10}$) that repeatedly counts the number of timing signals SY1. The waiting time is provided for waiting completion of the key operation necessary for chord change by taking into consideration the variation in the time of depression or release of the keys corresponding to the chord constituting tones at the time of changing the state of the lower keyboard depressed key (that is chord change). As the count of the counter 59 reaches a maximum value or when the outputs of all stages become "1", the AND gate circuit 58 is enabled and its output (count completion signal CUP) becomes "1". The count completion signal CUP is applied to the disabling input DIS of the counter 59 and when this signal is "1", the operation of the counter 59 is inhibited. Accordingly, the count of the counter 59 is fixed to the maximum value (all "1") so that the output of the AND gate circuit 58, that is the signal CUP is normally "1".

When the lower keyboard any new key on/off signal ANKO becomes "1" which the count completion signal CUP is "1" (see FIG. 4*B*), the signal SY1 would become "1" at the channel timing 1 immediately prior to an instant at which the signal ANKO becomes "0", thus enabling the AND gate circuit 57. The output "1" of the AND gate circuit 57 is outputted from the counter melody note change control circuit 22 as a key-on reset signal KORST and applied to the reset input R of the waiting time setting counter 59, whereby the same is once reset to make "0" the signal CUP thus setting the counter at an operable state. As shown in FIG. 4*b*, the key-on reset signal KORST is generated at the channel timing 1 of a cycle next to the cycle in which the lower keyboard new key on/off signal LKNKO has generated. However, when the key-on reset signal KORST has generated to bring the counter 59 to an operable state (i.e., the waiting time counting state), the signal CUP becomes "0" and the AND gate circuit 57 is disabled. Accordingly, even when a lower keyboard new key on/off signal LKNKO is produced, the key-on reset signal KORST would not be produced.

Where the counter 59 is constituted by 10 stage binary counter, when 1023 ($2^{10}-1$) of the timing signals SY1 are generated after counter 59 has been reset by the key-on reset signal KORST, all outputs of the counter 59 becomes "1", whereby the AND gate circuit 58 is enabled to make "1" the count completion signal CPU. Since the recurrence frequency of the timing signal SY1 is 15 microseconds, the interval in which the signal CUP is "0" that is the waiting time set by the counter 59 is about 15 ms (15 microseconds $\times$ 1023) in this example.

The count completion signal CUP is applied to a delay flip-flop circuit 60 and one input of an AND gate circuit 61. The output of the delay flip-flop circuit 60 driven by the clock pulse $\phi$ is inverted by an inverter 62 and then applied to the other input of the AND gate circuit 61. These circuits 60, 61 and 62 constitute a build up differentiating circuit. More particularly when the signal CUP changes to "1" from "0" as a result of the expiration of the waiting time, a signal "1" formed by inverting a signal CUP of "0" one microsecond before is applied to the AND gate circuit 61 from the inverter 62, so that this AND gate circuit 61 is enabled for one microsecond to produce a single pulse CUP' in synchronism with the channel timing 1 at which signal CUP becomes "1". This waiting time completion pulse CUP' is applied to a delay flip-flop circuit 64 via an OR gate circuit 63 and self-held in the flip-flop circuit 64 via one input of an AND gate circuit 65. To the other input of the AND gate circuit 65 is applied a signal formed by inverting a timing signal SY9 corresponding to the channel timing 9, so that the memory in the delay flip-flop circuit 64 would be cleared at the channel timing 9 in a cycle same as that in which the pulse CUP' has been produced. More particularly, the output of the delay flip-flop circuit 64 is "1" for an interval of 8 microseconds between channel timing 2 immediately following the generation of the pulse CUP' and the channel timing 9. This output of the delay flip-flop circuit 64 is applied to one input of an AND gate circuit 66 with its other input connected to receive the timing signal SY9, so that the AND gate circuit 66 produces an output "1" at the channel timing 9 immediately before the output of the delay flip-flop circuit 64 changes to "0" from "1". In other words, the output of the AND gate circuit 66 becomes "1" only at the first channel timing 9 starting from a channel timing at which the waiting time set by the counter 95 completes (CUP changes to "1").

The output "1" of the AND gate circuit 66 is sequentially delayed by a 7-stage/1-bit shift register 67 according to the clock pulse $\phi$. The output of the AND gate circuit 66 and the outputs of the first to sixth stages of the shift register 67 are applied to an OR gate circuit 68. Since the output of the AND gate circuit 66 becomes "1" at the channel timing 9 the outputs of the first to sixth stages of the shift register 67 sequentially becomes "1" at the channel timings of 10 through 15. As a consequence, the lower keyboard key code load signal LKLD produced by the OR gate circuit 68 becomes "1" only at the lower keyboard channel timings 9 through 15 (see FIG. 4*a*) immediately following the waiting time completion. The output of the 7th stage of the shift register 67 is applied to the counter melody note search circuit 28 via an AND gate circuit 67A to act as a search start signal SSTRT which becomes "1" only once at the channel timing 1 immediately after the lower keyboard key code load signal LKLD. The other input of the AND gate circuit 67A is supplied with a lower keyboard any key-on signal LKAKO in a manner as will be described later, so that the search start signal SSTRT can be produced only when either one of the keys of the lower keyboard is depressed (that is when signal LKAKO is "1"), and the search start signal SSTRT can not be produced when no key of the lower keyboard is depressed.

As above described each one of the key-on reset signal KORST produced by the counter melody note change control circuit 22, the lower keyboard key code load signal LKLD and the search start signal SSTRT is generated when the state of the depressed key of the lower keyboard is changed, but signals LKLD and SSTRT are generated a predetermined waiting time later than the signal KORST. The key-on reset signal KORST is applied to the reset input R of the flip-flop circuit 32 adapted to from the counter melody key-on signal via OR gate circuits 69 and 33. Since the counter melody note search circuit 28 begins to search only when the search start signal SSTRT is applied thereto, the flip-flop circuit 32 is reset before starting the search.

The lower keyboard key code load signal LKLD is applied to the lower most note detecting AND gate circuit 51 and to the load control input L of a gate circuit 70 of the lower keyboard depressed key note code memory device 26. When the load signal LKLD applied to the load control input L is "1", the gate circuit 70 applies to a shift register 71 a 4 bit note code NC among the lower keyboard key codes outputted from the lower keyboard key code gate circuit 25, whereas when the load signal LKLD is "0", the gate circuit 70 returns the output of the shift register to its input side for storing and holding the lower keyboard depressed key note code applied to the shift register 71 which is in the form of a 7-stage/4-bit type and shift controlled by the clock pulse $\phi$.

Key codes KC produced by the tone production assignment circuit 12, on the time division basis, and assigned to respective channels are applied to the lower keyboard key code gate circuit 25, and the lower keyboard key-on signal LKKON is applied to the enabling input EN of the gate circuit 25. Consequently, the gate circuit 25 selects only a depressed key code (LKKON is "1") among key codes outputted from the tone production assignment circuit 12 at the lower keyboard channel timings 9 through 15. The key code LKKC of the lower keyboard depressed key (a chord constituting tone of a depressed key) selected by the gate circuit 25 is applied to the latch circuit 48 for detecting the lower most note and to the comparator 50, while its note code portion NC is applied to the gate circuit 70.

When the lower keyboard key code load signal LKLD becomes "1" during 7 microseconds between the lower keyboard channel timings 9 and 19 immediately following the completion of the waiting time, all note codes, of the lower keyboard depressed keys (chord constituting notes of the depressed keys) selected by the gate circuit 25 between the channel timings 9 and 15 are applied to respective stages of the shift register 71 via the gate circuit 70. The seven stages of the shift register 71 correspond to seven lower keyboard channels, thereby enabling to store note codes regarding all (7) lower keyboard channels (of course there may be a channel in which no assigned note code presents). Since the load signal LKLD is generated immediately after completion of a predetermined waiting time, it does not respond to the difference in the key depression or key release operation at the time of changing the lower keyboard depressed key state, so that the lower keyboard depressed key notes at the stable depressed key state following the variation are stored in the shift register 71.

Let us now describe the operation of the circuit shown in FIG. 3, especially of the counter melody note search circuit 28. At first, production of the first counter melody note will be described with reference to the connection diagram shown in FIG. 3 and the timing chart shown in FIG. 5. After closing a source switch and the generation of the clock pulse $\phi$ produced by the timing pulse generator becomes stable, timing signals SY1, SY9 and YLK sent by the timing pulse generator are also produced stably. Actually signals other than these signals are also produced, but they are omitted for the purpose of simplifying the description, so that the number of the timing signals SY1 are counted by the counter 59 adapted to set the waiting time. Consequently, after elapse of about 15 milliseconds after the closure of the source switch all outputs of the counter 59 become "1" and signal CUP also becomes "1". Under these states the counter 59 stops to count and the signal CUP is continuously maintained at "1". Upon closure of the counter melody switch CM-SW, concurrently with the generation of a single counter melody start pulse ΔCMS, the counter melody selection signal CMS is continuously maintained at "1". The pulse ΔCMS sets the flip-flop circuit 37, and the search counter 30 would firstly be set to the up count mode (signal U/D becomes "1"). Furthermore, as the pulse ΔCMS sets the flip-flop circuit 45, that is the counter enabling signal CTEN, and the output Q of the flip-flop circuit 46, that is the search state memory signal SFFQ are initially set to "0". The flip-flop circuit 47 adapted to preset the initial value of the counter is set by the pulse ΔCMS and the AND gate circuit 72 supplied with the output Q of "1" from the flip-flop circuit 47 is enabled. The content of the latch circuit 48 for detecting the lower most note is set to the maximum value (all "1") by the pulse CMS. The AND gate circuit 44 of the lower keyboard key-on signal gate circuit 24 is enabled by the counter melody selection signal CMS to produce a lower keyboard key-on signal LKKON corresponding to a channel to which a lower keyboard depressed key has been assigned.

Figure 5:
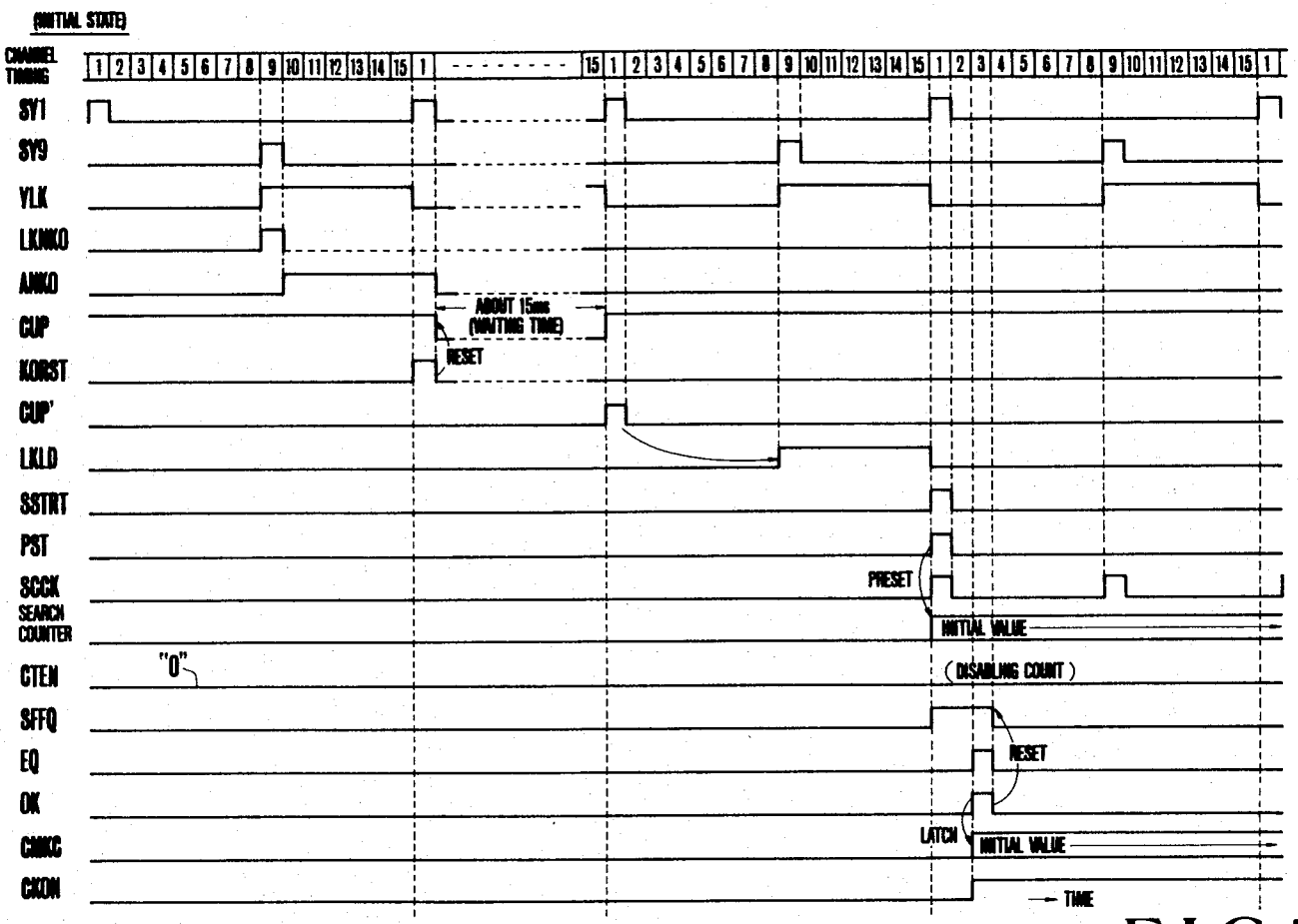
FIG. 5 is a time chart showing the timings of generation of various signals and useful to explain the operation of selecting and generating a key code of the first counter melody note by the circuit shown in FIG. 3.

At the time of starting the counter melody performance, the exclusive-OR gate circuit 53 produces a lower keyboard new key on/off signal LKNKO corresponding to a channel timing to which a newly depressed key of the lower keyboard has been assigned. FIG. 5 shows one example of producing the signal LKNKO corresponding to the channel timing 9. In this case, as shown in FIG. 5, the lower keyboard any new key on/off signal outputted from the delay flip-flop circuit 55 is produced during an interval between the channel timing 10 immediately following the generation of the signal LKNKO and the channel timing 1 of the next cycle. The lower keyboard new key on/off signal LKNKO is generated by either one of the two following method in the initial state.

One corresponds to a case wherein the first accompaniment chord is produced by depressing keys of the lower keyboard after closing the counter melody switch CM-SW. In this case, in one assignment processing cycle of the tone production assignment circuit 12 (FIG. 1) the signal LKNKO is produced at only one lower keyboard channel timing. Thus, during a plurality of assignment processing cycles, signals LKNKO are produced corresponding to different lower keyboard channel timings. Because, the tone production assignment circuit 12 processes the tone production assignment of only one tone (one key) in one assignment processing cycle, and because respective accompaniment constituting tones are newly assigned to different lower keyboard channels in different assignment processing cycles. Thus, the lower keyboard new key on/-off signals LKNKO are produced corresponding to respective chord constituting notes (lower keyboard depressed keys) newly assigned to be produced. As a consequence, although not shown in FIG. 5, the signals LKNKO of the number equal to that of the chord constituting notes, are generated so that the signals ANKO are also generated by corresponding numbers. However the key-on reset signal KORST is generated only once corresponding to the first signal LKNKO (that is ANKO). Because when key-on reset signal KOKST is produced corresponding to the first lower keyboard new key on/off signal LKNKO, the counter 59 would be reset by the signal KORST so that the count completion signal CN changes to "0" as shown in FIG. 5 to disenable the AND gate circuit 57. More particularly, since one assignment processing cycle is much shorter than the waiting time (15 milliseconds), even when signals LKNKO corresponding to respective chord constituting notes are sequentially generated at each assignment processing cycle, they would be produced in a waiting time of 15 milliseconds calculated by the counter 59. Thus, the second and the following signals LKNKO are blocked by the AND gate circuit 57.

The other method corresponds to a case wherein the counter melody switch CM-SW is closed while an accompaniment chord is produced by the lower keyboard. In this case, the assignment processing of respective chord constituting notes of the tone production assignment circuit 12 (FIG. 1) has already been completed, and the key-on signals KON are repeatedly produced corresponding to channel timings exclusively used by the lower keyboard to which respective chord constituting notes have been assigned.

However, when the counter melody switch CM-SW is open, since signal CMS is "0", the gate circuit 24 blocks the key-on signal KON so that the contents of all stages of the shift register 52 are always "0". Upon closure of the counter melody switch CM-SW, the signal CMS becomes "1" and the lower keyboard key-on signals LKKON regarding all chord constituting notes would be outputted from the gate circuit 24 at the lower keyboard channel timings. Since the outputs of the shift register 52 showing the immediately prior state of the key-on signal LKKON are all "0", the lower keyboard new key on/off signals LKNKO corresponding to all chord constituting notes are produced in one time divisioned cycle at respective lower keyboard channel timings. In this case, as the signal ANKO becomes "1" in accordance with a firstly produced signal LKNKO, this signal ANKO is stored until the channel timing of the next cycle, so that the second and the succeeding signals LKNKO do not contribute to the generation of the signal ANKO. For this reason, the key-on reset signal KORST is produced only once.

When a predetermined waiting time of about 15 milliseconds elapses after resetting the counter 59 with the key-on reset signal KORST, the count completion signal CUP outputted from the AND gate circuit 58 becomes "1" (see CUP in FIG. 5) whereby the AND gate circuit 61 produces a waiting time completion pulse CUP' (see CUP' in FIG. 5) corresponding to this change of the count completion signal. The output of the AND gate circuit 16 becomes "1" in the channel timing 9 of the same cycle as that in which the pulse CUP' has produced, and the output (the lower keyboard key code load signal LKLD) of the OR gate circuit 68 becomes "1" during an interval of from the channel timing 9 to the channel timing 15, 6 microseconds later. (See LKLD shown in FIG. 5). During an interval between channel timings 9 and 15 in which the lower keyboard key code load signal LKLD is "1", all note code portions NC of the key codes KC assigned to the lower keyboard channel given by the gate circuit 25 are received in the shift register 71 via the gate circuit 70. Further, the AND gate circuit 51 for detecting the lower most note is enabled during an interval between the lower keyboard channel timings 9 and 15.

To the A input of the comparator 50 for detecting the lower most note is applied the key code LKKC assigned to the lower keyboard channel selected by the lower keyboard key code gate circuit 25, while the 3 input is supplied with the output of the latch circuit 48. Where the A input is smaller than the B input, the output A<B of the comparator 50 becomes "1" and applied to one input of the AND gate circuit 51, the other input thereof being applied with the output of the OR gate circuit 73. This OR gate circuit is supplied with the all bits of the lower keyboard depressed key code LKKC applied to the A input of the comparator 50. The output of the AND gate circuit 51 is applied to the load control input 1 of the latch circuit 48. Consequently, during an interval between the lower channel timings 9 and 15 immediately following the completion of the waiting time produced by the lower keyboard load signal LKLD of "1", and when the value of the key code LKKC of the depressed key (the chord constituting note) is smaller than that stored in the latch circuit 48 at a channel timing (output of the OR gate circuit 73 is "1") to which either one of the lower keyboard depressed keys (chord constituting notes) is assigned, that is when a lower note key code LKKC is given (A<B, the AND gate circuit 51 applies a loading instruction to the latch circuit 45 so as to latch a key code of the lower note.

At first since the maximum value is latched by the latch circuit 48 by the counter melody starting pulse ΔCMS, the AND gate circuit 51 is always enabled at the first channel timing among the lower keyboard channel timings 9 through 15 generated by the signal LKLD, the first channel being assigned with a depressed key, whereby the key code LKKC given by the gate circuit 25 at that channel timing would be latched by the latch circuit 48. Thereafter, the key codes LKKC given by the gate circuit 25 at the subsequent channel timings are sequentially compared with the key codes latched by the latch circuit 48 and the key code LKKC having a smaller value, or on the lower tone side is latched by the latch circuit 48. As above described, when the last lower keyboard channel timing 15 is over, the key code of the lower most note of the lower keyboard depressed keys (chord constituting tones) would be latched by the latch circuit 48. Thereafter, since the lower keyboard key code load signal LKLD becomes "0" AND gate circuit 51 is disenabled so that the key code of the lower most note latched by the latch circuit 48 does not vary.

When the lower keyboard key code load signal LKLD changes to "0", the 7th stage of the shift register 67 produces a search start signal SSTRT as shown in FIG. 5. This search start signal SSTRT is applied to one inputs of the AND gate circuits 72 and 74, OR gate circuit 75 and to the set input S of the flip-flop circuit 46 in the counter melody note search circuit 28. The other input of the AND gate circuit 72 is supplied with the output of the flip-flop circuit 47 adapted to preset the initial value of the counter. Since the flip-flop circuit 47 is preset by the counter melody start pulse ΔCMS, at the same time when the search start signal SSTRT becomes "1", the output of the AND gate circuit 72 also becomes "1" (See PST shown in FIG. 5). This output "1" of the AND gate circuit 72 is applied to the preset control input PS of the search counter 30 as a preset instruction signal PST. Accordingly, a combination of the note code portion NC (L) of the lower most note key code of the lower keyboard depressed key (chord constituting note) latched by the latch circuit 48 and the initial octave code OC* is preset in the search counter 30 as the key code of the initial counter melody note.

The output PST of the AND gate circuit 72 is inverted by inverter 76 and then applied to one input of AND gate circuit 74 and the output thereof is applied to the set input S of the flip-flop circuit 45 for controlling the counting operation. When a search start signal SSTRT is applied to one input of the AND gate circuit 74 in the initial state a signal "0" obtained by inverting the output (preset instruction signal PST) of the AND gate circuit 72 is applied to the other input of the AND gate circuit 72 so that the AND gate circuit 74 is not enabled with the result that the flip-flop circuit 45 is not set. Consequently, the output of the flip-flop circuit 45, that is the count enabling signal CTEN is still maintained at "0" (see CTEN shown in FIG. 5).

The search start signal SSTRT is applied to the count input of the search counter 30 as a count clock pulse SCCK via OR gate circuit 75 (see SCCK shown in FIG. 5). However, as above described, since the counter enabling signal applied to the enabling input EN of the search counter 30 is still "0", the counter 30 can not count so that its count does not vary from the preset value. The search start signal SSTRT is also applied to the shift register 77 OR gate circuit 75. The shift register 77 is of the 7-stage/1-bit type and shift controlled by the clock pulse $\phi$. The outputs of all stages of the shift register 77 are applied to the NOR gate circuit 78 and become "0" at each 8 microseconds after a time at which signal "1" is applied to the shift register 77 from the OR gate circuit 75 so that the output of the NOR gate circuit 78 becomes "1". The output "1" of the NOR gate circuit 78 is returned to the shift register 77 via OR gate circuit 75. Consequently, the OR gate circuit 75 repeatedly produces an output "1" at each 8 microseconds after generation of the search start signal SSTRT. The count clock pulse SCC applied to the search counter 30 from the NOR gate circuit 75 is a clock pulse having a period of 8 microseconds (see SCCK shown in FIG. 5). Even when the count clock pulse SCCK is repeatedly applied to the search counter 30, since the count enabling signal CTEN is still maintained at "0" as above described, the count of the search counter 30 does not depart from the set value (see the search counter 30 shown in FIG. 5).

On the other hand, the preset instruction signal PST outputted from the AND gate circuit 72 is delayed one microsecond by the delay flip-flop circuit 79 and then applied to the reset input R of the flip-flop circuit 47. Consequently, the flip-flop circuit 47 for presetting the counter initial value would be reset immediately after the presetting of the search counter 30, and thereafter maintains this reset state.

The flip-flop circuit 46 adapted to store the search state is set when a search start signal STRT is produced, and its output, i.e., a search state memory signal SFFQ becomes "1" when the search start signal SSTRT is produced as shown in FIG. 5 and this search state memory signal SFFQ is applied to one input of AND gate circuit 80.

The key code (the output of the counter 30) of the initial counter melody note preset in the search counter 30 is applied to the data input of the latch circuit 27 and its note code portion NC is applied to one input of the comparator 31, the other input thereof being supplied, on the time division basis, with the note code of the lower keyboard depressed key (chord constituting notes) from the shift register 71 of the lower keyboard depressed key note code memory device 26. When the values of the note codes applied to both inputs of the comparator 31 coincide with each other, a coincidence signal EQ of "1" is produced. For example where a note code NC same as the note code portion NC of the key code preset in the search counter 30 is assigned to a channel corresponding to the lower keyboard channel timing 11, the coincidence signal EQ becomes "1" as shown in FIG. 5. Although the timing at which the coincidence signal EQ becomes "1" is the channel timing 3 when one considers the entire system, it will be clear that it is caused by the fact that the shift register 71 storing the lower keyboard depressed key note codes is not synchronous with the channel timings 1 through 15 of the entire system. Because, the note codes NC stored in the shift register 71 via the gate circuit 70 at the channel timing 11 are outputted from the shift register at an interval of 7 microseconds (channel timings 3, 10, 2 . . . ).

The coincidence signal EQ outputted from the comparator 31 is applied to one input of an AND gate circuit 81, the other input thereof being supplied with the output of an OR gate circuit 82 which is supplied with the counter output of the note code portion NC inputted to the comparator 31 from the search counter 30. When the counter output of the note code portion NC is "0000", the output of the OR gate circuit 82 is "0", but "1" in other cases. Where a coincidence signal EC is produced corresponding to a value "0000" (see Table I) not present in the actual note code NC, the OR gate circuit 82 is provided for the purpose of blocking the same with the AND gate circuit 81. At a channel timing not assigned with a depressed key, the value of the note code NC outputted from the shift register 71 would become "0000" so that a coincidence signal EQ corresponding to actually existing value "0000" of the note code NC might be produced.

The coincidence signal EQ passing through the AND gate circuit 81 is applied to one input of an AND gate circuit 80 which produces an output "1" when a signal "1" based on the coincidence signal EQ is applied from AND gate circuit 81 under a search state (signal SFFQ is "1"). The output of the OR gate circuit 41 applied to the other input of AND gate circuit 80 is normally "1". The output "1" of the AND gate circuit 80 is applied to the load control input L of the latch circuit 27 and to the set input S of the flip-flop circuit 32 as a search completion signal OK and returned to the counter melody note search circuit 28 to be delayed by one microsecond by a delay flip-flop circuit 83 and then applied to the reset inputs R of the flip-flop circuits 45 and 46 via OR gate circuit 49.

Generation of the coincidence signal EQ and the search completion signal OK based thereon means that the same note name as the initial counter melody note key code stored in the search counter 30 exists in the lower keyboard depressed key note (chord constituting note), in other words a note of the same note name as the initial counter melody note has been searched out from the chord constituting notes. The search completion signal OK causes the latch circuit 27 to latch the key code of the initial counter melody note outputted from the search counter 30. At the same time the key code sets the flip-flop circuit 32, whereby the counter melody key code CMKC outputted from the latch circuit 27 has a value representing the initial counter melody tone as shown in FIG. 5 as the counter melody key-on signal CKON outputted from the flip-flop circuit 32 becomes "1". Based on these counter melody key code CMC and key-on signal CKON, the counter melody musical tone signal forming circuit 21 (FIG. 1) produces an initial counter melody note musical tone signal. The note name of such initial counter melody note corresponds to the note name of the lower most note of the lower keyboard depressed key note (chord constituting note) and lies in a note range represented by the initial octave code OC*.

Suppose now that, as shown in FIG. 2*a*, the first accompaniment chord comprises C major chord consisting of the notes C4, E4 and G4, and that the value of the initial octave code OC* is "010" representing the note range of C#3 through C4 (see Table II). Then, the key code of the lower most note C4 would be latched by the latch circuit 48. By combining the note code NC(L) representing the note name C among the key codes of C4 latched by the latch circuit 48 with the initial octave codes OC*, the key code of the note C4 would be preset in the search counter 30 and the key code of note C4 outputted from the search counter 30 is latched by the latch circuit 27 to produce a note C4 as the first counter melody note as shown in FIG. 2*b*.

Section of the second and succeeding counter melody notes will now be described with reference to FIGS. 3 and 6.

At first, a state before commencement of the search for a counter melody note will be described. The circuit 27 is now latching the key code CMKC (it is assumed now that this value is KC′ as shown in FIG. 6) of a counter melody note previously selected (now being produced as a musical tone), and the search counter 30 is also holding the same value KC′. The flip-flop circuit 32 is in its set state and the counter melody key-on signal CKON is "1" (see CKON shown in FIG. 6). The count clock pulse SCCK is repeatedly produced at any time and at a period of 8 microseconds. (See SCCK shown in FIG. 6). Since the recurrent period of 8 microseconds of this count clock pulse SLLK is not the same as the recurrent period of the channel timing it is difficult to specify a particular channel timing that produces the count clock pulse. Although FIG. 6 shows that the count clock pulse SCCK is generated at the channel timings 3 and 11, it should be noted that this is only one example. Although the count clock pulse SCCK is being produced, the search counter 30 stops its counting operation, so that the count KC′ of the counter does not vary. Because, the flip-flop circuit 45 has been reset in response to the previously produced search completion signal OK (CTEN is "0").

When the lower keyboard key depression state varies, the exclusive OR gate circuit 53 produces a lower keyboard new key on/off signal LKNKO corresponding to either one of the lower keyboard channel timings. In FIG. 6, it is assumed that the signal LKNKO is generated at the channel timing 12, for example. Based on this signal LKNKO, a key-on reset signal KORST is produced in the same manner as above described and the counter 59 commences to measure the waiting time. Upon generation of the key-on reset signal KORCT, the flip-flop circuit 32 is reset by this signal through OR gate circuits 69 and 33 whereby the counter melody key-on signal CKON changes to "0" from "1" (see CKON shown in FIG. 6). Consequently, the counter melody note that has been produced as a musical tone would be stopped. The number of keys changed from depressed state to released state or vice versa at the time of changing the chord is not limited to one. Consequently, while the counter 59 is peforming its counting operation for the purpose of setting a waiting time, there is a probability of producing for certain times the lower keyboard new key on/off signal LKNKO at a channel timing different from that described above.

However, since the signal CUP is "0" during the counting operation, AND gate circuit 57 would not be enabled so that the key-on reset signal KORST would be produced only once.

Figure 6:
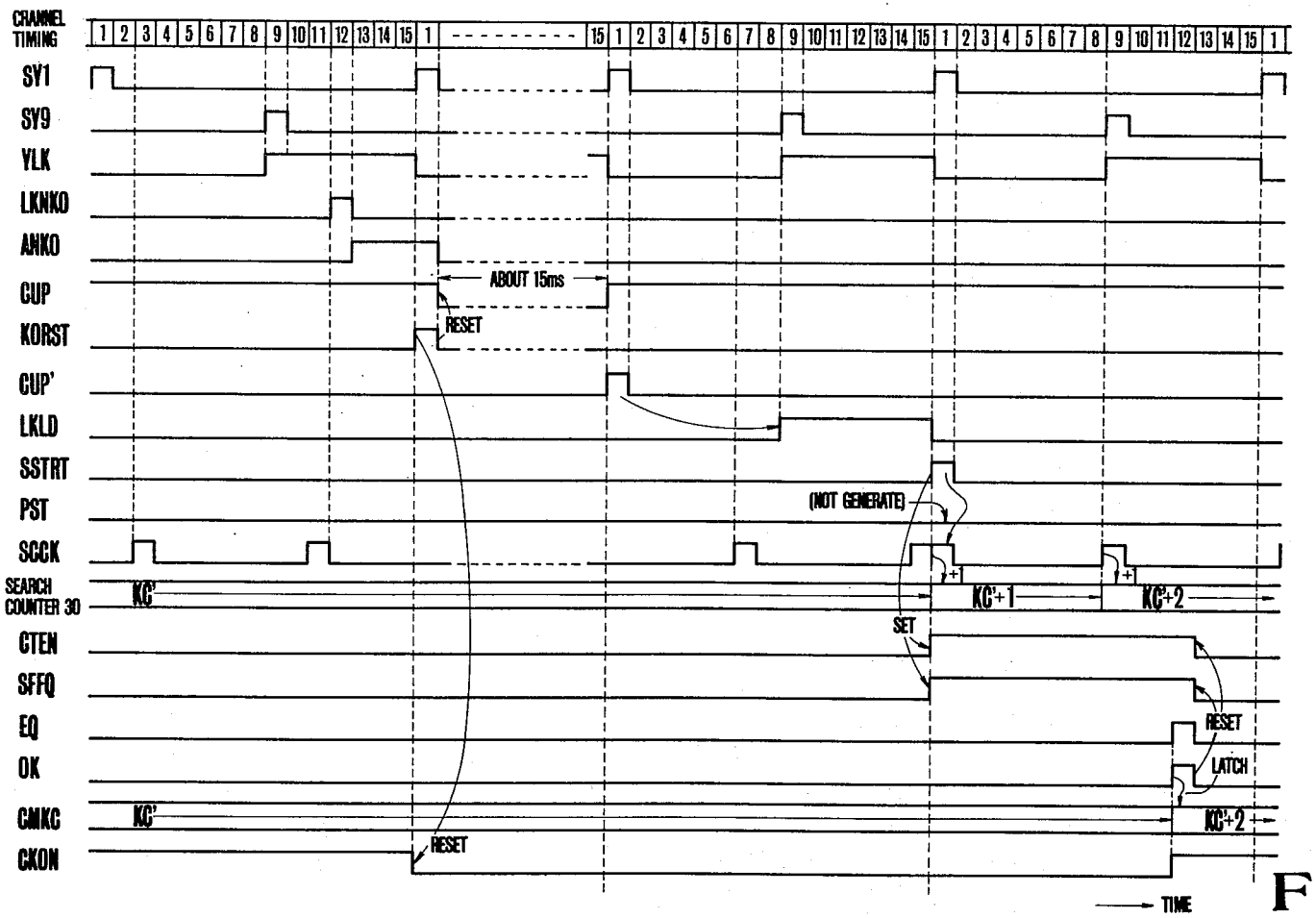
FIG. 6 is a time chart showing the timings of generation of various signals and useful to explain the operation of selecting and generating key codes of the second and the succeeding counter melody notes.

When the count completion signal CUP becomes "1" upon termination of the waiting time (see CUP shown in FIG. 6), the lower keyboard key code load signal LKLD is produced in the same manner as above described (see LKLD shown in FIG. 6). Based on this signal LKLD the note code of a new chord constituting note after change will be stored in the shift register 71. Although a new lower most note key code is latched by the latch circuit 48 in response to this signal LKLD this is a data not actually used for the second and succeeding counter melody notes selection processing.

As the lower key code load signal LKLD changes to "0", the shift register 67 produces a search start signal SSTRT (see SSTRT shown in FIG. 6). The flip-flop circuit 47 adapted to preset a counter initial value has already been preset when the initial value is preset, so that the AND gate circuit 72 is disabled. Accordingly, the preset instruction signal PST is not produced and the output of the inverter 76 is "1". For this reason, the AND gate circuit 74 is enabled when the search start signal SSRT is produced to set the flip-flop circuit 45 for controlling the counting operation. The flip-flop circuit 46 for storing the search state is also set by the search start signal SSTRT. The count enabling signal CTEN and the search state memory signal SFFQ respectively outputted from the flip-flop circuits 45 and 46 become "1" when the search start signal SSTRT is produced as shown in FIG. 6. The search start signal SSTRT is applied to the search counter 30 via OR gate circuit 75 as a count clock pulse SCCK.

The search counter 30 is brought to an operable state by the count enabling signal given from the flip-flop circuit 45 at the same time when the search start signal SSTRT is generated. Consequently, the number of the count clock pulses given from the OR gate circuit 75 based on the search start signal SSTRT is immediately counted by the search counter 30. Initially, as the flip-flop circuit 37 which produces an up/down control signal U/D is set by the counter melody starting pulse ΔCMS, the signal U/D firstly has a value "1" indicating the up count mode. In the up count mode, the count of the search couner 30 is incremented by one when the search start signal SSTRT is produced so that the count of the search counter 30 is changed to a value [KC'+1] equal to the value KC' of the previously selected counter melody key code plus one (see FIG. 6).

Irrespective of the production timing of the count clock pulse SCCK produced before the search start signal SSTRT, the count clock pulse SCCK is repeatedly produced subsequent to the generation of the search start signal SSTRT, at a period of 8 microseconds (see SCCK shown in FIG. 6). Because even after signal "1" which has been written into register 77 prior to the production of the search start signal SSTRT is shifted through and outputted from the last stage of the shift register 77, signal "1" is written therein by the search start signal SSTRT so that the output of the NOR gate circuit 75 would not become "1" and the output of the NOR gate circuit 78 becomes "1" only when the signal "1" written by the search start signal is outputted from the last stage. When the count clock pulse SCCK is generated 8 microseconds after the search start signal SSTRT, the count of the search counter 30 is further increased one so that its count becomes [KC'+2] as shown in FIG. 6.

Since the recurrent frequency of the count clock pulse SCCK is 8 microseconds, the count of the search counter 30 does not vary for at least 8 microseconds. The lower keyboard channel (7 channels) assignment note code NC outputted on the time division basis, from the shift register 71 of the lower keyboard depressed key note code memory device 26 completes one cycle in 7 microseconds. Accordingly, during 8 microseconds in which the count of the search counter 30 is maintained at the same value, the comparator 31 completes comparison of the value of the note code portion NC of the count with the value of the all lower keyboard channel assignment note codes NC outputted from the shift register 71. Where the value of the note code portion NC of the count of the search counter 30 does not coincide with any note code NC stored in the shift register 71, no coincidence signal EQ is produced during the 8 microseconds in which the count of the counter 30 is maintained at the same value. For example, when the count of the search counter 30 shown in FIG. 6 is [KC'+1], no coincidence signal is produced.

When the 8 microseconds elapses without producing any coincidence signal, the next count clock pulse SCCK is applied to the search counter 30 to increment its count by one (provided that signal U/D is "1"). In this manner, after varying (count up one) the count of the counter 30, the note code NC of each lower keyboard channel stored in the shift register 71 is again compared with the note code portion NC of the counter output. Thereafter, the content of the search counter 30 is incremented according to the count clock pulse SCCK with the next coincidence signal EQ is produced.

When the note code portion NC of the count of the counter 30 coincides with either one of the note codes NC stored in the shift register 71, the comparator 31 produces a coincidence signal EQ which produces a search completion signal OK via AND gate circuits 81 and 80. Signal "1" outputted from the delay flip-flop circuit 83 one microsecond later than the search completion signal OK resets the flip-flop circuits 45 and 46 via OR gate circuit 49. As a result of resetting of the flip-flop circuit 45, the counter enabling signal CTEN becomes "0", thus disabling the search counter 30. Consequently, thereafter the count of the counter 30 would not be changed even when the count clock pulse SCC is applied thereto.

FIG. 6 shows an example in which a coincidence signal EQ is produced when the count of the search counter 30 becomes [KC'+2], and the AND gate circuit 80 produces a search completion signal OK corresponding to the coincidence signal EQ, (see OK shown in FIG. 6). Based on the search completion signal OK, the count KC'+2 of the search counter 30 is latched by the latch circuit 27, while a counter melody key-on signal CKON is set in the flip-flop circuit 32 (see CMKC and KON shown in FIG. 6). Consequently, the counter melody musical tone signal forming circuit 21 (FIG. 1) produces a counter melody note corresponding to a counter melody key code CMKC having a value of [KC'+2] outputted from the latch circuit 27. One microsecond after the generation of the search completion signal OK, the flip-flop circuits 45 and 46 are reset so that one microsecond later than signal OK, the counter enabling signal CTEN and the search state memory signal SFFQ are both changed to "0", with the result that the search counter 30 stops to count, thus holding the same value [KC'+2] as that latched by the latch circuit 27.

As above described in the up mode, (i.e., up count mode), the count of the search counter 30 is sequentially incremented by one from the value KC' of the key code of the counter melody note previously generated (or selected) until the note code portion NC of the count of the search counter 30 comes to coincide with either one of the note codes NC of the chord constituting notes assigned to respective lower keyboard channels stored in the shift register 71. Consequently, a note having the same note name as that of either one of the present chord constituting notes and higher than previously produced counter melody note but closest to the previous note would be selected as the counter melody note to be presently produced. The octave tone range of the counter melody note is shown by the upper 3 bit count (a portion corresponding to the octave code) of the 7 bit search counter. Initially this portion is the initial octave code OC* but sequentially varies to a value representing an upper order octave tone range as the up counting operation proceeds (i.e., at each 16 counts).

The key-on reset signal KORST and the search start signal SSTRT are produced each time the lower keyboard depressed key state (accompaniment chord) changes, so as to resume the counting operation of the search counter 30 to search out the key code of the key code CMKC to be presently produced counter melody note in a manner described above. In the up count mode, as above described, the count of the search counter 30 increases stepwisely by repeating start and stop the counting operation. Finally, the count of the search counter 30 becomes equal to the upper limit key code MAX set by the max min data generator 34. Then the output A=B of the comparator 35 in the max/min comparison and control circuit 29A becomes "1" which is applied to the reset input R of the flip-flop circuit 37 via OR gate circuit 38 so that the up-down control signal U/D outputted from the flip-flop circuit 37 is converted to "D"; thus switching the search counter 30 to the down count mode.

When switched to the down count mode, the search counter 30 counts down by one each time a count clock pulse SCCK is given, provided that it is enabled by the counter enabling signal CTEN of "1". Thus, in the down count mode, a note lower than the previously produced (selected) counter melody note and having the same note name as that of either one of the present chord constituting notes, but closest to the previous note is selected as the counter melody note to be presently produced, contrary to the up count mode described above. Thus, each time the lower keyboard depressed state (accompaniment chord) varies, the counter melody note gradually changes towards the low tone side. Also the content of the search counter 30 decreases stepwisely by repeating start and stop of the counting operation. Finally, the count of the search counter 30 becomes equal to the lower limit key code MIN set by the max/min data generator 34. Then, the output A=B of the comparator 36 in the max/min comparison and control circuit 29A becomes "1" which is set in the flip-flop circuit 37 via OR gate circuits 39 and 40. Then, the up/down control signal changes to "1" from "0", thus switching the search counter 30 in the up count mode.

As above described, the search counter alternately repeats up and down count modes under the control of the max/min comparison and control circuit 29A. In response thereto, the progression of the counter melody repeats up mode and down mode between the highest one corresponding to the upper limit key code MAX and the lower most note corresponding to the lower limit key code.

When the output A=B of the comparator 35 which compares the count (A) of the search counter 30 and the upper limit keycode MAX (B) becomes "1", the counter is switched to the down count mode so that the output A>B of the comparator 35 would not become "1" in an ordinary case. In the same manner, the output A<B of the comparator would not become "1". In certain cases, however, the key code of the initial counter preset in the search counter 30 may be on the outside of a range of the upper limit key code MAX and the low limit key code MIN. In such a case, the output A>B of the comparator 35 or the output A<B of the comparator 36 becomes "1". In order to switch the count mode in such case, the output A>B of the comparator 35 or the output A<B of the comparator 36 is inputted to the OR gate circuit 38 or 39. Where the initial octave code OC* is on the outside of the range between the upper limit key code MAX and the lower limit key code MIN, the initial key code preset in the search counter may be on the outside of the range between the upper limit and the lower limit key codes. Such state may also occur depending upon the value of the note code NC (L) latched in the latch circuit 48 even when the initial octave code OC* is the same as the octave code of the key code MAX or MIN. For example, when the value of the upper limit key code MAX is equal to "0110101" representing the note E, a code "0111111" representing the note C5 will be set in the search counter 30 where the initial octave code OC* is "011" representing the octave of notes C#4 through C5 and where the note code NC (L) latched in the latch circuit 48 is "1111" showing the note name C (see Tables I and II). At this time, the output A>B of the comparator 35 becomes "1" which is applied to the reset input of the flip-flop circuit 37 via the OR gate circuit 38, thus immediately switching to the down count mode.

Taking the musical note shown in FIG. 2 as an example, let us explain generation (selection of the second and succeeding counter melody notes). As above described, a C4 note is firstly produced as the initial counter melody note corresponding to the first counter melody note. When the accompaniment chord changes to A minor chord (Am) to produce a search start signal SSTRT, the count of the search counter 30 immediately changes to "0110000" which is equal to the sum of one and a value "0101111" (see Tables I and II) corresponding to the previous note C4. Thereafter, each time a count clock pulse SCCK is given the count of the search counter sequentially counts up one as "0110001", "0110010" . . . . The comparator 34 compares the note codes "1111", "0101" and "1011" of the chord constituting notes (C, E and A) of the minor chord stored in the shift register 71 with the values of the lower 4 bits of the count of the search counter 30. When a sixth pulse SCC starting from the count clock pulse SCC based on the search start signal SSTRT is given to the search counter 30, its count becomes "0110101" showing the E4 note, thus producing a coincidence signal because this count corresponds to the note code "0101" of the note E stored in the shift register 71. Consequently, the key code of the note E is latched by the latch circuit 27 as a counter melody key code CMKC, thus producing an E4 note as the second counter melody note as shown in FIG. 2. The search counter 30 stops its counting operation and maintains its count at a value representing E4 note.

When the chord is changed to F major chord as shown in FIG. 2*a*, the search counter 30 starts its count up operation from a value "0110101" representing the preceeding note. In other words concurrently with the generation of the search start signal SSTRT, the count is incremented by one so that the value of the count becomes "0110110". Since the note code portion "0110" thereof coincides with the note code of the note F among F major chord constituting notes (F, A, C), a coincidence signal EQ is produced which is latched in the latch circuit 27. This is a key code representing an F4 note (see Tables I and II) so that an F4 note is produced as a counter melody note as shown in FIG. 2*b*.

When changed to C major chord, the search counter 30 resumes its up counting operation from a value "0110110" representing previous note F4, and when its count reaches "0111001" a coincidence signal EQ is produced corresponding to the note code "1001" of the note name G, one of the chord constituting notes. As a consequence, a G4 note is produced as a counter melody note based on the key code "0111001". Then, as the chord is changed to G major chord, a chord constituting tone B4 which is higher than the previous note G4 and closest to C4 note would be produced as a counter melody note. Where the value of the upper limit key code MAX is "0111110" representing B4 note, the output A=B of the comparator 35 becomes "1" when the count of the search counter 30 reaches a value representing an B4 note, thereby resetting the flip-flop circuit 37. Accordingly, the search counter 30 is switched to the down count mode, and thereafter when changed to a G seventh chord (G7), the counter 30 counts down from a value representing the former B4 note. More particularly, concurrently with the generation of the search start signal SSTRT the count decreases to "0111101". Thereafter, each time a count clock pulse SCCK is given, the count is counted down by one. When the count reaches "0111001", a coincidence signal EQ is produced corresponding to the note code "1001" of the note name G, one of the G seventh chord constituting notes, and a key code "0111001" representing the G4 note is latched by the latch circuit 27 as a counter key melody key code CMMK. As a consequence, a note G4 would be produced as the counter melody note as shown in FIG. 2*b* corresponding to the G seventh chord shown in FIG. 2*a*.

Upon changing to C major chord from G seventh chord G7, the count of the search counter 30 becomes "0111000" by subtracting one from a value representing the former G4 note. Thereafter, one is sequentially subtracted each time a pulse SCCK is given. When a value "0110101" representing an E4 note of the same note name as one of the chord constituting notes is reached, a coincidence signal EQ is produced and the key code of the E4 note is latched by the latch circuit 27 as the counter melody key code MKC.

In the example shown in FIG. 2*a*, where a value representing a D5 note is set as the upper limit key code MAX, in the counter melody search made at the time of changing to the G seventh chord G7, initially, the search counter 30 is in the up count mode so as to sequentially count up one from a value representing the former note B4, and the mode is changed to the down count mode when the count reaches a value representing a D5 note without generating any coincidence signal EQ. During the down counting operation, when the count reaches a value representing a B4 note, a coincidence signal EQ would be produced corresponding to a note name B, one of the G seventh chord constituting notes. Thus, since this case is different from that shown in FIG. 2*b*, a counter melody of a B4 note would be produced corresponding to G seventh chord G7. Also in this case, a counter melody note of the G4 note is produced corresponding to a succeeding C major chord.

The counter melody note change control circuit 22 shown in FIG. 3 includes a circuit (not shown) which detects the fact that all keys of the lower keyboard (accompaniment keyboard) are in the released state. A lower keyboard key-on signal LKKON outputted from the lower keyboard key-on signal gate circuit 24 is applied to the delay flip-flop circuit 85 via OR gate circuite 84 and self-held in the delay flip-flop circuit 85 via one input of AND gate circuit 86, the other input thereof being connected to receive a signal formed by inverting with an inverter a timing signal SY1 corresponding to the channel timing 1. When a certain key of the lower keyboard is depressed, the lower keyboard key-on signal LKKON becomes 1 at any one of the lower keyboard channel timings 9 through 15 and the signal "1" is held in the delay flip-flop circuit 85 until the channel timing 1 at which a signal SY1 is produced. The output of the delay flip-flop circuit 85 is applied to one input of AND gate circuit 87 and the timing signal SY1 is applied to the other input of the AND gate circuit 87. Accordingly, the output 1 which has been held until the channel timing 1 is reached is selected by the AND gate circuit 87 at that channel timing 1 (when signal SY1 becomes "1") and applied to the delay flip-flop circuit 87 via OR gate circuit 88. The output of the delay flip-flop circuit 89 is self-held through one input of AND gate circuit 90 with the other input connected to receive a signal obtained by inverting signal SY1, so that as the signal SY1 is produced, self-holding action of the delay flip-flop circuit 89 is released. However, when a signal SY1 is produced, a new daa is applied to the delay flip-flop circuit 89 via AND gate circuit 87.

When any key of the lower keyboard is being depressed, at the channel timing to which the depressed key has been assigned the lower keyboard key-on signal LKKON repeatedly becomes "1" so that the output of the delay flip-flop circuit 85 is always "1" at least at the channel timing in which signal SY1 is produced, and the output of the delay flip-flop circuit 89 which stores the output "1" until the generation of the next signal SY1 is always maintained at "1". Conversely, when no key of the lower keyboard is depressed, the output of the delay flip-flop circuit 89 is always "0" which is used as the lower keyboard new any key-on signal LKAKO. This signal LKAKO is inverted by inverter 91 and then applied to the reset input R of the flip-flop circuit 33 adapted to form a key-on signal via OR gate circuits 69 and 33. Consequently, when all keys of the lower keyboard are released, the output of the inverter 91 becomes "1" (LKAKO is "0"), thus always resetting the flip-flop circuit 32. The lower keyboard any key-on signal LKAKO is applied to one input of AND gate circuit 67A as above described.

Figure 7:
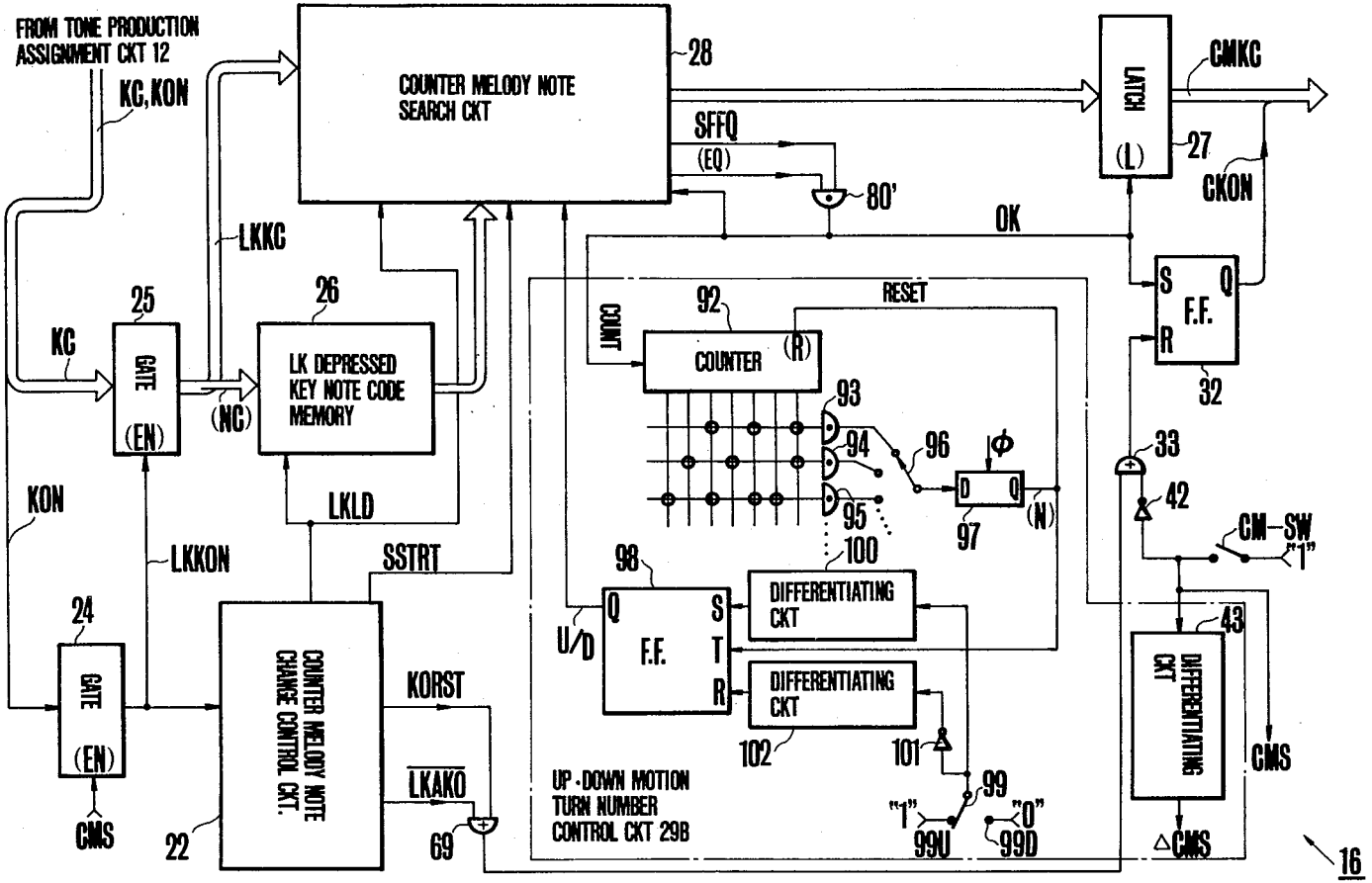
FIG. 7 is a block diagram showing another embodiment of the counter melody note selection circuit shown in FIG. 1.

FIG. 7 is a block diagram showing a modification of the counter melody note selection circuit 16 shown in FIG. 1, in which the up/down switching control of the search pattern designation circuit (up/down control circuit) is performed in accordance with the number of the counter melody notes generated.

In FIG. 7, the circuit corresponding to the search pattern designation circuit 29 shown in FIG. 1 is an up/down motion turn number control circuit 29B. Although in FIG. 7, the detail of only the circuit 29B is shown and the details of the counter melody note change control circuit 22, the lower keyboard depressed key note code memory device 26 and the counter melody note search section 28 are not shown because they are identical to those illustrated in FIG. 3. It should be understood that the LK key-on signal gate circuit 24, the LK key code gate circuit 25, the counter melody key code latch circuit 27, the flip-flop circuit 32 adapted to form the counter melody key-on signal, OR gate circuits 33 and 69, inverter 42 and the building up differentiating circuit 43 operate in the same manner as those identified by the same reference numerals shown in FIG. 3. Also an AND gate circuit 80′ produces a search completion signal OK based on a coincidence signal EQ produced by the comparator 31 (FIG. 3) in the same manner as the AND gate circuit 80 shown in FIG. 3. In FIG. 7, the AND gate circuit 80′ has two inputs, one supplied with the search state memory signal SFFQ outputted from the flip-flop circuit 46 (FIG. 3), and the other with the coincidence signal outputted from the comparator 31 and applied via AND gate circuit 81 (FIG. 3). A signal $\overline{\text{LKAKO}}$ applied to OR gate circuit 69 is a signal produced by the inverter 91 (FIG. 3) (i.e., a signal formed by inverting signal LKAKO).

In FIG. 7, the search completion signal OK outputted from the AND gate circuit 80′ is applied to latch circuit 27, flip-flop circuit 32, counter melody note search section 28 (delay flip-flop circuit 83 shown in FIG. 3) and to the count input of a counter 92 in the up/down motion turn number control circuit 29B. A counter 92 is provided for the purpose of counting the number of generations of the counter melody note at the time of up or down motion of the counter melody progression, thus counting up one each time a search completion signal OK is produced. When a counter melody note is newly selected at the time of changing the counter melody note, a search completion signal OK is produced so that counting the number of this signals OK, means counting of the number of generations of the counter melody notes. The outputs of respective stages of counter 92 are applied to AND gate circuits 93, 94, 95 . . . adapted to set the number of generations according to a predetermined combination of the output. The AND gate circuits 93, 94, 95 . . . correspond to different count values, and when the count of the counter 92 becomes to coincide with either one of the output of these AND gate circuits, that AND gate circuit produces on output of "1". A turn number selection switch 96 is provided for selecting the output of either one of the AND gate circuits 93, 94, 95 . . . .

When the performer throws the switch 96 to a position corresponding to a desired number of times N the output of either one of the AND gate circuits 93, 94, 95 ... corresponding to that number N is sent to the delay flip-flop circuit via the switch 96. In other words, when the count of the counter 92 becomes N, a signal "1" is applied to the delay flip-flop circuit 97 via the switch 96. An output "1" outputted from the delay flip-flop circuit 99 one microsecond later is applied to the reset input R of the counter 92 and to the T input of the T type flip-flop circuit 98 for controlling up and down countings. As a consequence, when the counter melody note is produced a desired N times (i.e., when the count of the counter 92 becomes N) the counter 92 is reset and the state of the T type flip-flop circuit 98 is reversed. The output Q of the T type flip-flop circuit 98 is applied to the counter melody tone search section 28 as the up/down control signal U/D (that is to the input of the search counter 30).

An initial motion direction setting switch 97 is provided in association with the T type flip-flop circuit. Although in the example shown in FIG. 3, the flip-flop circuit 37 is set by the counter melody start pulse ΔCMS and the direction of progression is set to the up mode, in the example shown in FIG. 7, the initial motion direction can be selected to any direction by the switch 99. When this switch 99 is transferred to the up position 99*u*, a signal "1" is applied to a differentiating circuit 100 so as to output a short pulse (for example having a width of 1 microsecond) synchronous with the building up of the input signal from the differentiating circuit 100 and this pulse is applied to the set input S of the flip-flop circuit 98. Consequently, this flip-flop circuit is set to change the up/down control signal U/D to "1" whereby the initial motion direction is set to the up mode. Where it is desired to set the initial motion direction to the up mode, the switch 97 is transferred to a down position 99D. Then, a signal "0" representing this position 99D is produced by the switch 99 so that the output of the inverter 101 changes to "1" which is applied to the diferentiating circuit 102 to produce a single differentiated pulse. The flip-flop circuit 98 is reset by the differentiated pulse and the up/down control signal U/D becomes "0" indicating the down count mode.

After being set to the set state or the reset state by the differentiated pulse from the differentiating circuit 100, the state of the T type flip-flop circuit 98 reverses each time a signal "1" is applied to the T input of the delay flip-flop circuit 97. As a consequence, when the counter melody note is generated N times, the mode is switched from the up mode to the down mode or vice versa.

FIG. 8 shows an improvement of the embodiment shown in FIG. 3. The counter melody note selection circuit shown in FIG. 8 is improved in the following points over that shown in FIG. 3.

(1) In the embodiment shown in FIG. 3, the counter melody note changes when the lower keyboard depressed state (accompaniment chord) changes. With this feature, however, where the same chord is continued, the melody note does not change at all, thus resulting in a monotone. For this reason, the counter melody note is varied not only when the lower keyboard depressed key states (accompaniment chord) changes but also when a new key of the upper keyboard is depressed or at the time of generating a predetermined rhythm pulse (beat pulse or a measure pulse).

(2) It is posible to set to any desired value the upper limit key code MAX and the lower limit key code MIN that set the tone range of the counter melody note. However, the following condition should be followed by considering music theory instead of setting to any desired value. According to the music theory, it is determined that at the termination, 1st degree note is produced after a 7th degree note or a 3rd degree note is produced following a 4th degree note. Accordingly, it is necessary to have a counter melody progression in order not to preclude such termination states. If the upper limit note is set to the 7th degree note at the time of up motion, it is necessary to switch to the down mode after the 7th degree note (upper limit note) has been produced as the counter melody note, so that it becomes impossible to produce a higher 1st degree note (above 7th) as the counter melody note. On the other hand, if the lower limit note is set to a 4th degree note at the time of the down motion, since the mode is changed to the up mode, once the 4th degree note (lower limit note) has been produced as a counter melody note it is impossible to produce a 3rd degree note as the counter melody note. For this reason, it should not select a 7th degree note as the upper limit key code MAX and to select a 4th degree note as the lower limit key code MIN.

Where a tonality designator is provided for desiganting a performance tonality it is possible to automatically avoid the 7th degree note and the 4th degree note described above. More particularly, since the tonality designator can judge the performance tonality now being designated, it is possible to automatically know the note names corresponding to the 7th degree note and the 4th degree note of that performance tonality. Accordingly, when the upper limit note (MAX) set by the upper limit note setter has the same note as that of the 7th degree note, or when the lower limit note (MIN) set by the lower limit note setter has the same note as that of the 4th degree note, the selected (or set) upper limit key code MAX or the lower limit key code MIN are not used as they are, but instead they are automatically converted into other notes. For example, the upper limit note selected as the 7th degree note may be changed to a 1st degree note, one semitone above, or the lower limit note selected as the 4th degree note may be changed to a 3rd degree note, one semitone below.

(3) There may arise a chance of frequent change of the counter melody note as result of adoption of the improvement (1). For the reason, the counter melody note previously generated is also added to the object to be searched, so as to enable to continuously select the same counter melody note. Then even when the counter melody search is frequently started it becomes possible to continuously select the same note as the counter melody note with the result that the person who hears the music feels that the counter melody note is not varying. Thus, it is possible to prevent frequent change of the counter melody note.

In the example shown in FIG. 3, concurrently with the generation of the search start signal SSTRT, since the search counter 30 is up (or down) counted by one count the counter melody note previously produced is not included in the object to be searched. To realize improvement (3) even when a search start signal SSTRT is generated the counter 30 is not immediately rendered operative but will be rendered operative a certain time later. With this measure, the up scanning (toward high tone side) or down scanning (toward low tone side) of the key code effected by the search counter 30 is started a little time later so that the key code before scanning, that is the previous note is also included to the object to be searched.

As above described, continuous selection of the same counter melody note is made possible, an excess amount of the same counter melody note will be continuously produced in a monotonous music. For this reason, where the same counter melody note continues a predetermined number, the circuit is constructed such that the aforementioned time delay is eliminated so as to select a note different from the previous note as the counter melody note.

(4) In the example shown in FIG. 3, the initial counter melody note is determined by the note name (note code NC (L)) of the lower most one of the chord constituting notes and the initial octave code CO*. However, as the flow of the entire counter melody changes depending upon which note is made to be the first counter melody note it is desirable to set the initial melody note to any note. Consequently, according to improvement (4), the initial counter melody note can be set to any note.

(5) Furthermore, as the flow of the entire counter melody is changed depending upon the direction of the initial counter melody progression (up or down) it is possible to set also the initial motion direction.

(6) Where the tonality designator is provided, as it is possible to identify the performance tonality, the following processing is executed depending upon the performance tonality designated by the tonality designator. More particularly, where a leading note (7th degree note) of the chord and a leading note of the counter melody note are produced in an overlapped relation, this condition is not desirable for a music. Consequently, the note name of the leading note (7th degree note) is discriminated in accordance with the performance tonality so as to inhibit a note having the same note name as that of the leading note from being selected as the counter melody note.

In FIG. 8 the circuits designated by the reference charactors as in FIG. 3, that is LK key-on signal gate circuit 24, LK depressed key note code memory device 26, counter melody key code latch circuit 27, search counter 30, comparator 31, counter melody key-on signal forming flip-flop circuite 32, OR gate circuits 33, 49, 69, 75 and 82, building up differentiating circuit 43, counter operation control flip-flop circuit 45, shift register 77, NOR gate circuit 78, AND gate circuit 81 and delay flip-flop gate circuit 83 have the same construction and function as those designated by the same reference charactors in FIG. 3. A gate circuit 25A whose enabling input EN is supplied with the lower keyboard key-on signal LKKON outputted from the AND gate circuit 44 of the lower keyboard key-on signal gate circuit 24 selects only a note code NC regading the lower keyboard depressed key among the key codes KC supplied from the tone production assignment circuit 12 (FIG. 1). The note code NC of the lower keyboard depressed key selected by this gate circuit 25A is stored in the lower keyboard depressed key note code memory device 26. As shown in detail in FIG. 3, this memory device 26 is constituted by a gate circuit 70 and a shift register 71, and receives the lower keyboard depressed key note code given from the gate circuit 25A when a lower keyboard key code load signal LKLD is given by a counter melody note change control circuit 2A.

To realize the improvement (1), an upper keyboard (UK) new key-on detection circuit 22B and a rhythm pulse detector 2C are provided to cooperate with the counter melody note change control circuit 22A. Like circuit 22 shown in FIG. 3, the counter melody note change control circuit 22A detects variation in the lower keyboard depressed key state according to the lower keyboard ky-on signal LKKON, and based on this detection, a key-on reset signal KORST, a search start signal SSTRT, and a lower keyboard key code load signal LKLD are produced. The UK new key-on detector 22B detects a new key depression in the upper keyboard in accordance with a key-on signal KON given from the tone production assignment circuit 12 on the time division basis. The rhythm pulse detector 22C detects the building up of a predetermined rhythm pulse RP (for example, a measure pulse corresponding to the start of a measure, or a beat pulse corresponding to a beat) given from the rhythm pulse generator 18 (FIG. 1). In response to the upper keyboard new key-on detection and or the rhythm pattern detection effected by the circuits 22B and or 22C, the counter melody note change control circuit 22A produces a key-on reset signal KORST, a search start signal SSTRT and a lower keyboard key code load signal LKLD.

Figure 9:
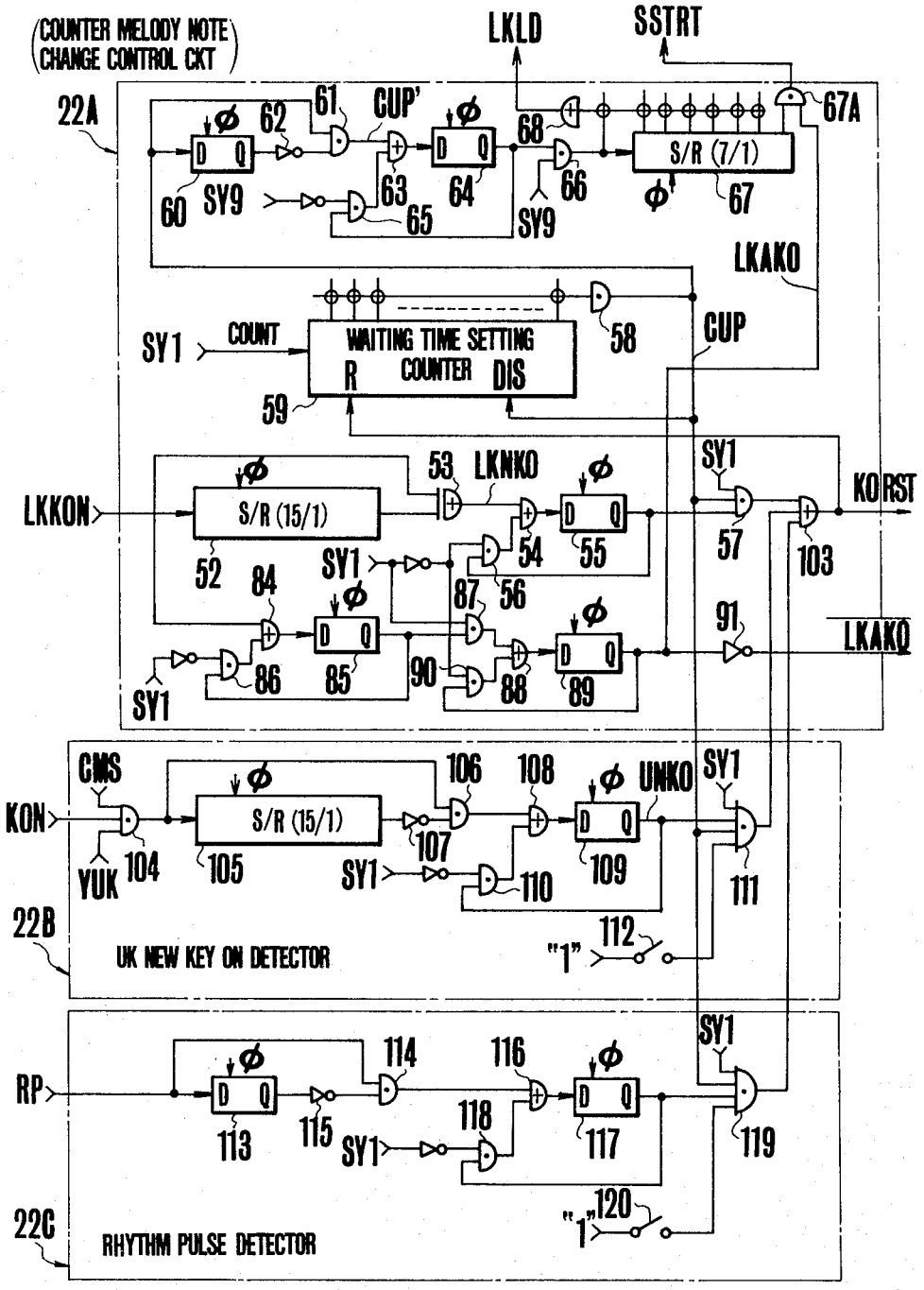
FIG. 9 is a block diagram showing the detail of the counter melody note change control circuit, the upper keyboard new key-on detection circuit and the rhythm pulse detector shown in FIG. 1.

The detail of the circuits 22A, 22B and 22C is shown in FIG. 9, in which a counter melody note change control circuit 22A has substantially the same construction as the counter melody note change control circuit 22 shown in FIG. 3 so that the same reference characters 52 through 91 are assigned to the circuit elements having the same function. Although in FIG. 3, the output of the AND gate circuit 57 is used as a key-on reset signal KORST as it is, in the case shown in FIG. 9, the output of the AND gate circuit 57 is outputted through an OR gate circuit 103 as a key-on reset signal KORST. For this reason, in FIG. 9, the waiting time setting counter 59 is reset by the output KORST of the OR gate circuit 103.

In the UK new key-on detection circuit 22B, the key-on signal KON given from the tone production assignment circuit 12 (FIG. 1) on the time division basis according to the time divisioned channel timing as shown in FIG. 4*a*, is inputted to one input of AND gate circuit 104, with the other input supplied with an upper keyboard channel timing signal YUK and a counter melody selection signal CMS. The upper keyboard channel timing signal YUK becomes "1" at the upper keyboard channel timings 2 through 8 (see FIG. 4*a*). Consequently, a key-on signal KON of a key (upper keyboard deprssed key) assigned to an upper keyboard channel would be selected at the time of performing a counter melody (when CMS is "1"). The upper keyboard key-on signal outputted from the AND gate circuit 104 is applied to a 15-stage/1-bit shift register 105 and to one input of an AND gate circuit 106. Since the same and the next channel timing "1". The output UNKO of the delay flip-flop circuit 109 is applied to one input of AND gate circuit 111, the other input thereof being supplied with a signal SY1 corresponding to the channel timing 1, a count completion signal supplied from AND gate circuit 58 and the output of an upper keyboard change-on-switch 112 which is provided for selecting that whether the counter melody note is to be changed in response to a new key depression on the upper keyboard or not. As the switch 112 is closed the AND gate circuit 111 is enabled to produce an output "1" corresponding to the channel timing 1 (SY1 is "1") when the upper keyboard new key-on signal UNKO is "1". The count completion signal CUP is "0" during the waiting time provided by counter 59, and this signal CUP is inputted to one input of AND gate circuit 111 for disabling the same. The output of the AND gate circuit 111 is applied to OR gate circuit 103.

In the rhythm pulse detector 22C shown in FIG. 9, a rhythm pulse RP is applied to delay flip-flop circuit and to one input of an AND gate circuit 114, the other input thereof being applied with a signal formed by inverting the output of a delay flip-flop circuit 113 with an inverter 115. As a consequence, the AND gate circuit 114 is enabled for a short interval of 1 microsecond in which the rhythm pulse RP changes to "1". The output "1" of the AND gate circuit 114 is applied to a delay flip-flop circuit 117 via an OR gate circuit 116 and held in the delay flip-flop circuit via one input of an AND channel timing is repeated at every 15 microseconds, when the upper keyboard key-on signal delayed 15 microseconds by the shift register 105 is produced from the 15th stage, a new key-on signal of the same channel would be produced from the AND gate circuit 104. An old (one cycle before) key-on signal outputted from the 15th stage of the shift register 105 is inverted by inverter 107 and then applied to one input of AND gate circuit 106. Accordingly, with reference to the same channel timing, only when the key-on signal in the previous cycle is "0" (output of inverter 107 is "1") and when the new key-on signal is "1" (output of AND gate circuit 104 is "1") the AND gate circuit 106 is enabled. In other words, where a newly depressed key of the upper keyboard is assigned to any one of the upper keyboard channels, the output of AND gate circuit 106 becomes "1" only once corresponding to the channel timing of that channel.

The output "1" of the AND gate circuit 106 is stored in the delay flip-flop circuit 109 via OR gate circuit 108 and self-held through one input of AND gate circuit 110, the other input thereof being supplied with a signal formed by inverting the timing signal SY1 so that the self-holding action would be released at the channel timing 1 (SY1 is "1") of the next cycle. Consequently, the output (upper keyboard new key-on signal) of the delay flip-flop circuit 109 becomes "1" during an interval between an instant 1 microsecond later than the time at which the output of AND gate circuit 106 becomes "1" gate circuit 118 with its other input supplied with a signal formed by inverting the timing signal SY1. Consequently, the output of the delay flip-flop circuit 117 becomes "1" during several microseconds between the time at which the rhythm pulse RP has changed to "1" and the channel timing 1.

The output of the delay flip-flop circuit 117 is applied to one input of an AND gate circuit 119 and the other input thereof is supplied with a timing signal SY1 corresponding to the channel timing 1, a count completion signal CUP and the output of the rhythm-pulse-on switch 120. The rhythm pulse-on-switch 120 is provided for the purpose of selecting whether the counter melody note is to be changed or not corresponding to the generation of a rhythm pulse (at each beat or measure).

As the switch 120 is closed, the AND gate circuit 119 is enabled for selectively outputting the output "1" (rhythm pulse detection signal) of the delay flip-flop circuit 117 at the time of generating a signal SY1 (channel timing 1). In the same manner as above described, the count completion signal CUP is applied for the purpose of enabling the AND gate circuit during the waiting time. The output of the AND gate circuit 119 is applied to OR gate circuit.

The outputs "1" of the AND gate circuits 57, 111 and 119 are outputted via OR gate circuit 103 as a key-on reset signal KORST, by which the waiting time setting counter 59 is reset to start counting of the waiting time. Also in the same manner as above described, after completing the waiting time, the OR gate circuit 68 produces a lower keyboard key code load signal LKLD, while a search start signal SSTRT is outputted from the shift register 67. Thus, a key-on signal KORST, a load signal LKLD and a search start signal SSTRT are produced in response to a variation in the lower keyboard depressed key state (output of AND gate circuit 57 is "1"), to a newly depressed key of the upper keyboard (output of AND gate circuit 111 is "1") when the switch 112 is closed, and also to a predetermined rhythm timing (output of AND gate circuit 119 is "1") when switch 120 is closed. Based on these signals KORST, LKLD and SSTRT, the counter melody note is changed.

In the example shown in FIG. 8, the lower keyboard (accompaniment keyboard) is used for setting the upper and lower limit key codes MAX and MIN and for designating the performance tonality where improvement I is adopted, and for setting an initial counter melody note. To this end, key codes KC for respective channels supplied from the tone production assignment circuit 12 (FIG. 1) on the time division basis, and a key-on signal KON are inputted to the counter melody note search section 28A, the max/min data setter 122, and the tonality setter 123.

In the counter melody note search section 28A, the key codes KC of respective channels are applied to the preset data input of the search counter 30, while the key-on signal KON is applied to one input of an AND gate circuit 124. The other input of this AND gate circuit is supplied with the output of an initial value preset switch 125, and a lower keyboard channel timing signal YLK (see FIG. 4a), and the output of the AND gate circuit 124 is supplied to the preset control input PS of the search counter 30. As a result, when the initial value preset switch 125 is closed, and when the key-on signal KON of the lower keyboard (YLK is "1") is given, the output of the AND gate circuit 124 becomes "1" and the search counter 30 assumes the preset mode. Before starting a counter melody performance (i.e., before closing the counter melody selection switch CM-SW), a key of the lower keyboard corresponding to a desired initial counter melody note is depressed, while at the same time, the initial value presetting switch 152 is closed. A key corresponding to this initial counter melody note is assigned to a suitable lower keyboard channel by means of the tone production assignment circuit 12 (FIG. 1) and a key code of the depressed key (initial counter melody note) is outputted from the tone production assignment circuit 12 corresponding to the channel timing. Upon closure of the preset switch 125, the mode of the search counter 30 is changed to the preset mode, so that the key code KC of the initial counter melody note given from the tone production assignment circuit 12 would be preset in the search counter 30.

Figure 10:
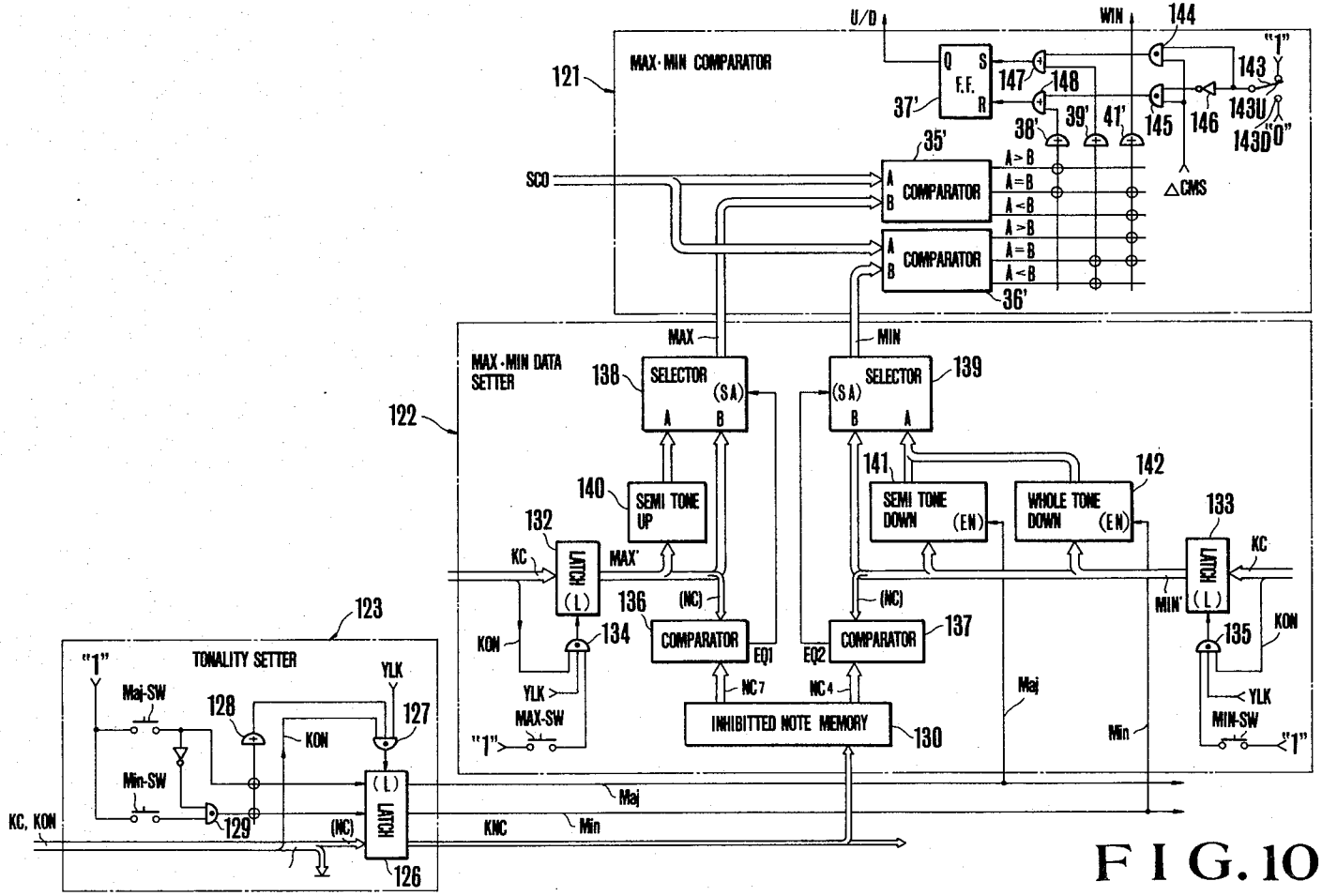
FIG. 10 is a block diagram showing the detail of the maximum/minimum comparator, maximum/minimum data setter and the tonality setter shown in FIG. 8.

The detail of the max/min comparator 121, max/min data setter 122 and tonality setter 123 is shown in FIG. 10. In the tonality setter 123 shown in FIG. 10, the note code portion NC of the key code KC given from the tone production assignment circuit 12 (FIG. 1) is received by the latch circuit 126, while a key-on signal KON is applied to one input of an AND gate circuit 127. The other input thereof is supplied with a lower keyboard channel timing signal YLK and the output of an OR gate circuit 128. A major selection switch Maj-SW and a minor selection switch Min-SW are provided for selecting the length of the tonality. The output of the major selection switch Maj-SW is applied to an OR gate circuit 128, while the output of the minor selection switch Min-SW is applied to an OR gate circuit 128 via one input of an AND gate circuit. The other input thereof is connected to receive a signal formed by inverting the output of the major selection switch Maj-SW so that when both switches Maj-SW and Min-SW are operated simultaneously, a priority is given to the major selection switch Maj-SW and the output of the minor selection switch Min-SW via AND gate circuit 129 are applied to a latch circuit 126.

To designate a tonality, a key of the lower keyboard corresponding to the major note of a desired tonality is depressed, while depending upon the length of the desired tonality, either one of the switches Maj-SW and Min-Sw is operated. Then the output "1" of the OR gate circuit 128 is applied to the AND gate circuit 127 which when supplied with a key-on signal KON from the lower keyboard (when YLK is "1") supplies a signal "1" to the load control input L of the latch circuit 126. Consequently the note code (NC) of the lower keyboard depressed key representing the major note of the tonality and a singnal (outputs of switches Maj-SW and Min-SW) representing the length of the tonality are latched by the latch circuit 126. The major note code KNC and a major tonality signal Maj or a minor tonlaity signal Min are applied to an inhibition note memory device in the max /min data setter 122 and to the leading note memory device 131 (FIG. 8).

In the max/min data setter 123 the key code KC supplied from the tone production assignment circuit 12 (FIG. 1) is applied to a latch circuit 132 for storing the upper limit key code and a latch circuit 133 for storing the lower limit key code, while the key-on signal KON is supplied to respective one inputs of AND gate circuits 134 and 135. The other input of the AND gate circuit 134 is supplied with the output of an upper limit key code setting switch MAX-SW and a lower keyboard channel timing signal YLK, and the output of the AND gate circuit 134 is applied to the load control input L of the latch circuit 132. The other input of the AND gate circuit 135 is supplied with the output of the lower limit key code setting switch MIN-SW and the lower keyboard channel timing signal YLK, and the output of this AND gate circuit is applied to the load control input L of the latch circuit 133.

To set the upper limit key code MAX, a key of the lower keyboard corresponding to a desired upper limit note is depressed, and at the same time, the upper limit key code setting switch MAX-SW is closed. The output "1" of this switch enables the AND gate circuit 134 which applies a load instruction "1" to the latch circuit 132 when a key-on signal KON is produced from the tone production assignment circuit 12 (FIG. 1) together with the key code KC of the depressed key of the lower keyboard, thus latching the key code KC of the lower keyboard depressed key (a desired upper limit note) with the latch circuit 132. To set the lower key code M, a key of the lower keyboard corresponding to a desired lower limit note is depressed, while at the same time, the lower limit key code setting switch MIN-SW is closed. The output "1" of this switch enables the AND gate circuit 135 so that its output becomes "1" when the key code KC of the desired lower limit note of the depressed key of the lower keyboard is applied together with the key-on signal KON from the tone production assignment circuit 12, thus causing the latch circuit 133 to latch the key code KC of the desired lower limit note.

As above described, a desired upper limit key code MAX' and a lower limit key code MIN' latched by latch circuits 132 and 133 respectively. The key codes MAX' and MIN' latched by latch circuits 132 and 133 are not outputted from the setter 122 as they are, but as has been described with reference to improvement 2, they are controlled to inhibit selection of a 7th degree note as the upper limit key code and a 4th degree note as the lower limit key code MIN. To this end, the setter 122 is provided with an inhibition note memory device 130, comparators 136 and 137, selectors 138 and 139, a semitone up circuit 140, a semitone down circuit 141, and a full note down circuit 142.

The inhibition note memory device 130 prestores the note code NC7 of the 7th degree note and the note code NC4 corresponding to respective tonalities so as to read out the note code NC7 representing the note name of the 7th degree note of the present performance tonality and the note code NC4 representing the note name of the 4th degree note in accordance with the major note note code KNC and the tonality signal Maj or Min given from the tonality setter 123. The comparator 136 is supplied with the note code portion NC of the upper limit key code MAX' latched by the latch circuit 132 (set by the performer), and the note code NC7 of the 7th degree note read out of the memory device 130, and when these two inputs coincide with each other, the comparator 136 produces an output EQ1 of "1". The comparator 137 is supplied with the note code portion NC of the lower limit key code MIN' latched by the latch circuit 133 (set by the performer) and the note code NC of the 4th degree note read out from the memory device 130 and when these two inputs coincide with each other the comparator 137 produces a coincidence signal EQ2 of "1".

The coincidence signal EQ1 produced by the comparator 136 is applied to the A input selection control input SA of a selector 138. When the coincidence signal EQ1 is "0", that is when the upper limit key code latched in the latch circuit 132 does not correspond to the 7th degree note, the selector 138 selects the upper limit key code MAX' (as it is) applied to the B input of the selector 138 from the latch circuit 132 so as to output the upper limit key code MAX' as a normal upper limit key code MAX. On the other hand, where the coincidence signal EQ1 is "1", in other words when the upper limit key code MAX' set by the performer is a 7th degree note, the selector would not select the key code MAX' but select and output a key code applied to the A input from the semitone up ciruit 140 as the normal upper limit key code MAX. The semitone up circuit 140 adds 1 or 2 to the key code MAX' supplied from the latch circuit 132 so as to produce the key code as a key code a semitone above. As shown in Table I, "0", "4", "8" and "12", of the decimal representation are not used for the note codes NC, where the note names of the key code MAX' is D#, F#, A or C, 2 is added to the key code MAX' to form a key code one semitone above, whereas when the note name of the key code MAX' is other than those mentioned above, 1 is added to the key code MAX' to form a key code one semitone above. Consequently, where the performer selects the 7th degree note as the upper note, it is automatically changed to a note (1st degree note) one semitone above to produce an upper limit key code MAX.

The coincidence output EQ2 of the comparator 137 is applied to the A input selection control input SA of a selector 139, which when the coincidence output EQ2 is "0", that is when the lower limit key code MIN' latched in the latch circuit 133 is not the 4th degree note, selects the key code MIN' (as it is) supplied to its B input so as to output the key code MIN' as a normal lower limit key code MIN. On the other hand, when the coincidence signal EQ2 is "1", that is when the key code MIN' set by the performer is the 4th degree note, the key code MIN' is not selected but a key code supplied to the A input from the semitone down circuit 141 or whole tone down circuit 142 is selected and outputted as a normal lower limit key code MIN. To the enabling input EN of the semitone down circuit 141 is applied a major tonality signal Maj so that when the performance tonality is the major tonality (Maj is "1") the semitone down circuit 141 is caused to operate. To the enabling input EN of the whole tone down circuit 142 is applied a minor tonality signal Min so that the circuit 142 is rendered operative at the time of the minor tonality (Min is "1").

The semitone down circuit 141 subtracts 1 or 2 from the key code MIN' inputted from the latch circuit 133 for producing a key code one semitone below the key code MIN'. In order to avoid that the note code assumes values "0", "4", "8", and "12" not corresponding to the note name, where the note name of the key code MIN' is E, G, A# and C#, 2 is subtracted from the key code MIN' to form a key code one semitone below, whereas when the note name of the key code MIN' is of the other note name, 1 is subtracted from the key code MIN' to form a key code one semitone below. In the case of the major tonality, since the interval between 4th and 3rd degree notes is a semitone, the semitone down circuit 141 is used. Consequently, where the performer selects the 4th degree note as the lower limit note for the major tonality, a key code which has been changed to a note (3rd degree note) one semitone below by the semitone down circuit 141 would be outputted as the lower limit key code MIN.

The whole tone down circuit 142 subtracts 2 or 3 from a key code MIN' supplied from the latch circuit 133 for producing a key code a whole tone below the key code MIN'. In the case of the minor tonality, since the interval between the 4th degree note and the 3rd degree note is a whole tone, this whole tone down circuit is utilized for converting the key code MIN' of the 4th degree note to a 3rd degree note. In the same manner as above described, to avoid values "0", "4", "8" and "12" of not used note codes, where the note name of the key code MIN' is C#, D, E, F, G, G#, A# or B, 3 is subtracted from the key code MIN' to form a key code MIN' a whole tone below, whereas in the case of other note names, 2 is subtracted from the key code MIN' to form a key code a whole tone below. Thus, where the performer selects the 4th degree note as the lower limit note for the minor tonality, a key code which has been changed to a note (3rd degree note) a whole tone below by the whole tone down circuit 142 would be outputted as the lower limit key code MIN.

The upper limit key code MAX outputted from the selector 138 is applied to the B input of a comparator 35' for comparing the upper limits, while the lower limit key code MIN outputted from the selector 139 is applied to the B input of a comparator 36' for comparing the lower limit. The output SCO of the search counter 30 (FIG. 8) is applied to the A inputs of the comparators 35' and 36'. OR gate circuits 38', 39' and 41' supplied with the outputs (A>B, A=B, A<B) of respective comparators 35' and 36' have the same construction and function as comparators 35 and 36 and OR gate circuits 38, 39 and 41. Also an up/down control flip-flop circuit 37′ has the same function as the flip-flop circuit 37 shown in FIG. 3. Thus, as the operation of the max/min comparator 121 can be readily understood from that of the max/min comparison control circuit 29A, it will not be described in detail. The circuit 121 is different from the circuit 29A shown in FIG. 3 in that there is provided an initial motion direction setting switch 143 for adopting the improvement 5.

Where the initial motion direction is set to the up mode, switch 143 is thrown to a position 143*u* for applying a signal "1" to one input of an AND gate circuit 144. The output "1" of the switch 143 is inverted by an inverter 146 for applying a signal "0" to one input of AND gate circuit 145. To the other inputs of the AND gate circuits 144 and 145 is applied a counter melody start pulse ΔCMS. Consequently at the time of starting the counter melody the output of the AND gate circuit 144 is caused to temporarily become "1" by the timing action of pulse ΔCMS and this output "1" is applied to the set input S of the flip-flop circuit 37′ via OR gate circuit 147, thus setting the flip-flop circuit 37′. Accordingly the up/down control signal U/D supplied to the research counter 30 (FIG. 8) from the flip-flop circuit 37′ becomes "1", thereby setting the initial motion direction to the up mode.

Where the initial motion direction is to be set to the down mode, switch 143 is thrown to a position 143D for applying to one input of the AND gate circuit 144 an output "0" of the switch 143 and a signal "1" to one input of the AND gate circuit 145. When a counter melody start pulse ΔCMS is generated, a signal "1" is applied to the reset terminal K of flip-flop gate circuit 37′ from the AND gate circuit 145 via OR gate circuit 148 so as to reset the flip-flop circuit 37′. As a consequence, the up/down control signal supplied to the search counter 30 (FIG. 8) from the flip-flop circuit 37′ becomes "0", thus setting the initial motion mode to the down mode.

In the same manner as above described with reference to FIG. 3, during the up mode, when the count SCO of the search counter 30 becomes equal to the upper limit key code MAX, the output A=B of the comparator 35′ becomes "1" which resets the flip-flop circuit 37′ via OR gate circuits 38′ and 148 to change the mode to the down mode. During the down mode, when the content SCO of the search counter becomes equal to the lower limit key code MIN, the output A=B of comparator 36′ becomes "1" which sets the flip-flop circuit 37′ via OR gate circuits 39′ and 147 thus changing the mode to the up mode. With the search counter 30 shown in FIG. 8, as it is possible to initially set any vaue there is a probability that a key code on the outside of the range between the upper limit key code MAX and the lower limit key code MIN might be initially set. In such a case, the output A>B of the comparator 35′ or the output A<B of the comparator 36′ becomes "1" which immediately resets or sets the flip-flop circuit 37′ via OR gate circuits 38′ and 148 or OR gate circuits 39′ and 147 thus correcting the key code to be in the range between the upper limit key code MAX and the lower limit key code MIN. To the OR gate circuit 41′ are applied the output A=B and A<B of the comparator 35′, and the outputs A=B and A>B of the comparator 36′, and the output WIN of the OR gate circuit 41′ is applied to one input of the AND gate circuit 149 shown in FIG. 8.

The output WIN of the OR gate circuit 41′ is normally "1".

The counter melody note search section 28A shown in FIG. 8 is different from the counter melody note search section 28 shown in FIG. 3 lies in the improvement (4) regarding the initial value presetting and the improvement (4). A search start signal SSTRT outputted from the shift register 67 (FIG. 9) of the counter melody note change control circuit 22A is applied to a delay-flip circuit 150 in the counter melody note search circuit 28A and to the B input of a selector 151. The output of the delay flip-flop circuit 150 is applied to the A input of the selector 151. The delay flip-flop circuit 150 is provided for adopting improvement (3), in other words for delaying the count start of the search counter 30 for adding the counter melody note previously generated (or selected) counter melody note to the object to be searched.

Figure 11:
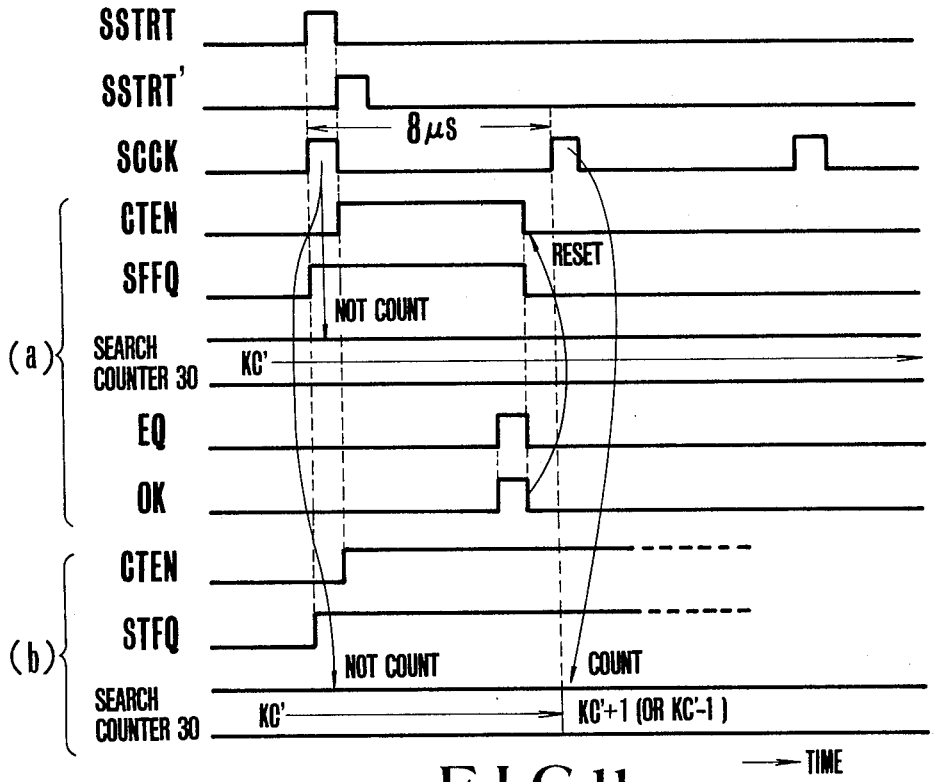
FIG. 11 is a timing chart showing one example of the operation of the counter melody note search circuit shown FIG. 8.

To the control input of the selector 151 is applied the output of AND gate circuit 152 and a signal formed by inverting the output with an inverter 153. Normally, the output of the AND gate circuit 152 is "0" and the selector 151 assumes an A input selection state according to the output "1" of the inverter 153. Consequently, a search start signal SSTRT′ normally delayed by 1 microsecond in the delay flip-flop circuit 150 is selected and outputted by selector 151 and then given to the reset input S of the flip-flop circuit 45 adapted to control the operation of the counter. The counter enabling signal (CTEN produced by the flip-flop circuit 45) is applied to the enabling input EN of the search counter 30 and to one input of an OR gate circuit 154 is supplied with a search start signal SSTRT and its output is applied to one input of the AND gate circuit 149 as a search state memory signal SFFQ.

Where the selector 151 is in the A input selection state, as shown in FIG. 11, even when the search start signal SSTRT is generated, the count enabling signal CTEN would not immediately change to "1" but changes to "1" when the output signal SSTRT′ of the delay flip-flop circuit 150 becomes 1 one microsecond later. Consequently with the search start signal SSTRT the OR gate circuit 75 produces a count clock pulse SCCK which is applied to the search counter 30. However, as it is not enabled to count (CTEN is "0"), the first pulse SCCK concurrently generated with the search start signal SSTRT would not be counted by the counter 30. As a consequence, the count of the search counter 30 is held at a value KC′ representing the previously produced (selected) counter melody note for an interval of 8 microseconds between generation of the search start signal SSTRT and the generation of the next count clock pulse SCCK (see search counter 30 shown in FIG. 11). On the other hand, the search state memory signal SFFQ applied to one input of an AND gate circuit 149 from an OR gate circuit 154 becomes "1" concurrently with the generation of the search start signal SSTRT and thereafter will be still maintained at "1" corresponding to the counter enabling signal CTEN so that the AND gate circuit 149 is enabled at the same time when the search start signal SSTRT is generated. Signal WIN (output of the OR gate circuit 41′ shown in FIG. 10) and the output of inverter 155 which are applied to the other inputs of AND gate circuit 149 are normally 1. To the remaining input of the AND gate circuit 149 is applied, through AND gate circuit 81 and OR gate circuit 156, the coincidence signal EQ outputted from the comparator 31.

Where a note code NC having the same note name as a previous counter melody note is stored in the lower keyboard depressed key note code memory device 26, as shown in FIG. 11*a*, the comparator 31 produces a coincidence signal at any time in an interval of 8 microseconds following the generation of a search start signal SSTRT and the AND gate circuit 149 produces a search completion signal OK corresponding thereto. Based on this search completion signal, a key code KC' having the same value as the previous note is latched by the latch circuit 27. The flip-flop circuit 45 is reset by the output "1" of a delay flip-flop circuit 83 which is obtained by delaying one microsecond the search completion signal OK, thus changing the counter enabling signal CTEN to "0". Consequently, search counter 30 is made inoperative before it is counted up (or down) by the second count clock pulse SCCK. In this manner, the search is completed without changing the count KC' of the search counter 30 and a key code KC' same as the previous one is latched by the latch circuit 27 as a counter molody key code CMKC. In the example shown in FIG. 8, the output of the latch circuit 27 which is delayed 1 one microsecond with the delay flip-flop circuit 157 is supplied to the counter melody note musical tone signal forming circuit 21 (FIG. 1) as the counter melody key code CMKC.

Where the lower keyboard depressed key code memory device 26 does not store a note code NC having the same note as the previous counter melody note, as shown in FIG. 11*b*, the comparator 31 does not produce a coincidence signal EQ in an interval of 8 microseconds following the generation of the search start signal SSTRT. As a consequence when the second count clock pulse SCCK is generated, the counter enabling signal CTEN is still maintained at "1" so that the search counter 30 is counted up one (or down) and its count is changed to [KC'+1] (or [KC'−1]).

Delay flip-flop circuits 157, comparator 158, and AND gate circuits 159 and 160 are provided for the purpose of comparing whether previously selected counter melody key code MKS coincides or not with the newly selected counter melody key code. The comparator 158 is supplied with the output of the search counter 30 and the outputs (CMKC) of the delay flip-flop circuits 157, and when both inputs coincide with each other, a coincidence signal EQ3 becomes "1" which is supplied to one input of an AND gate circuit 159. A signal formed by inverting the coincidence signal EQ3 with an inverter 161 is applied to one input of an AND gate circuit 160. The other inputs of the AND gate circuits 159 and 160 are supplied with a search completion signal OK outputted from AND gate circuit 149. When the search completion signal OK is "1", the value of the output of the search counter 30 comprises a newly selectd counter melody key code and the content of the latch circuit 27 is substituted by the newly selected key code based on the signal OK. At this time, however, the delay flip-flop circuits 157 produces the output of the latch circuit 1 microsecond before, that is the previously selected counter melody key code. Consequently the output EQ3 of the comparator at the time of generating the search completion signal OK represents the result of comparison of the previous and new counter melody key codes.

Like the case shown in FIG. 11*a*, where the same counter melody key code as the previous code is selected, the coincidence output EQ3 of the comparator 158 is "1" when the search completion signal OK is generated so that the output of the AND gate circuit 159 becomes "1" and the output of the AND gate circuit 160 becomes "0". The output "1" of the AND gate circuit 159 is applied to the count input T of the counter 162 to count up by one the count of the counter 165.

Where the newly selected counter melody key code (output of the search counter 30) is different from the previous counter melody key code, the coincidence output EQ3 of the comparator 158 is "0" when the search completion signal OK is generated. The output of the AND gate circuit 159 is "0" and the output of the AND gate circuit 160 is "1" which is applied to the reset input R of the counter 162 for resetting the same. A suitable combination of the outputs of the counter 162 is applied to the AND gate circuit 152 such that the counter 162 is provided for the purpose of counting the number of times of continuously selecting the counter melody key code. When the count of the counter 162 reaches a predetermined number of continuously selecting the same note, the AND gate circuit 152 is enabled. Usually, since the AND gate circuit 152 is not enabled the output thereof is "0" and the selector 151 selects and outputs a search start signal SSTRT' one microsecond delayed by the delay flip-flop circuit 150. Thus, as has been described with reference to FIG. 11, the previous search counter key code is also added to the object to be searched so that the same counter melody key code might be continuously selected.

Figure 12:
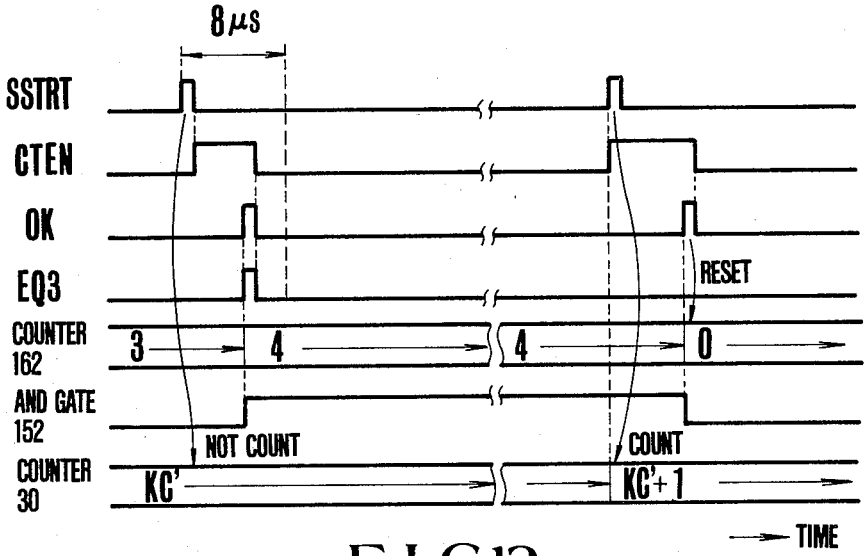
FIG. 12 is a timing chart showing one example of the circuit shown in FIG. 8 where the same counter melody note continues a predetermined number of times.

When the same counter melody key code is continuously selected and when the count of the counter reaches a predetermined value (for example 4), AND gate circuit 152 is enabled to produce an output "1", FIG. 12 shows one example of signals SSTRT, CTE, OK EQ3, content of the counter 162 and the content of the search counter 30 when the output of the AND gate circuit 152 becomes "1". When the output of the AND gate circuit 152 becomes "1" the selector 151 selects the B input. Consequently, when a search start signal SSTRT is generated next time, it is selected by selector 151 via its B input so that the flip-flop circuit 45 is immediately reset. Thus, when a first count clock pulse SCCK is given to the search counter 30 concurrently with the generation of the search start signal SSTRT, the counter enabling signal CTEN produced by the flip-flop circuit CTEN also changes to "1" and the count of the search counter 30 is counted up (or down) by one at once. This eliminates previously selected counter melody key code from the object to be searched so as to select a key code of a note higher (or lower) than the previous note as a new counter melody key code. When a search completion signal OK adapted to latch this new counter melody key code in the latch circuit 27 is produced by AND gate circuit 149, the coincidence signal EQ3 outputted by the comparator 158 is always "0" and the counter 162 is reset by the output "1" of an AND gate circuit 160. As a consequence the output of AND gate circuit 15 returns to "0" and the selector 151 returns to an A input selection state. Consequently, at the next search, the newly selected counter melody key code is also added to the object to be searched.

The leading note memory device 131 and the comparator 163 shown in FIG. 8 are provided for the purpose of realizing the improvement (6). In the leading note memory device 131 is prestored a note code NC7, representing the note name of a leading note (seven degree note) of each tonality, and the note code NC7 of a leading note of a designated performance tonality in accordance with a major note note code KNC given by the tonality setter 123 and a tonality signal Maj or Min.

The comparator 163 is inputted with a note code portion NC7 read out from the memory device 131 and the note code portion NC of the output of the search counter 30, and when these two inputs coincides with each other, a coincidence signal EQ4 becomes "1". This coincidence signal EQ4 is inverted by an inverter 155 and then applied to one input of the AND gate circuit 149. Consequently, where a key code outputted from the search counter 30 is a key code, the output of the inverter 155 becomes "0" whereby the AND gate circuit 149 is disenabled with the result that even when a coincidence signal EQ is generated from the comparator 31 corresponding to the count of the search counter 30, no search completion signal OK would note be produced.

Since the circuit shown in FIG. 8 is constructed such that any key code may be presetable in the search counter as an initial counter melody key code there may be a case in which a note code same as the note code portion NC of the preset key code is not stored in the lower keyboard depressed key note code memory device 26. In this case, since the comparator 31 does not produce a coincidence signal corresponding to the preset key code (note code), there is a disadvantage that the initial key code once preset will not be latched by the latch circuit 27. For this reason, a mimic coincidence signal is applied to the AND gate circuit 149 from a AND gate circuit 164 via an OR gate circuit. A counter melody start signal ΔCMS is applied to the set input S of a flip-flop circuit 165 so as to set the same at the time of starting the counter melody. The set output Q of "1" of the flip-flop circuit 165 is applied to the AND gate circuit 164 so as to enable the same at the time of starting the counter melody. When a first search start signal SSTRT ius produced for starting an initial counter melody note, the output of the AND gate circuit 164 inputted with this search start signal becomes "1" which is applied to one input of the AND gate circuit 149 via OR gate circuit 156. Furthermore as the signal SSTRT is applied to the input of AND gate circuit 149 as a signal SFFQ via OR gate circuit 154, it produces a search completion signal OK corresponding to the first search start signal SSTRT. In response to the search completion signal OK the initial key code which has been preset in the search counter 30 is latched by the latch circuit 27. A note (even if it is not contained in the accompaniment chord) is always produced corresponding to the initial key code preset as the initial counter melody note. The output "1" of the AND gate circuit 164 is delayed one microsecond in a delay flip-flop circuit 166 and then applied to the reset input R of the flip-flop circuit 165. Thus, when a mimic search completion signal OK is once produced, the flip-flop circuit 165 is reset at once, and thereafter the AND gate circuit 164 is disabled.

Although in the examles shown in FIGS. 8 and 10, designation of the counter melody note, designation of the tonality, and settings of the upper limit key code MAX and lower limit key code MIN are effected by a key depression of the lower keyboard, it should be understood that the invention is not limited to this specific construction and that a group of switches may be provided which are exclusively used for setting purpose so as to set a desired key code and so forth by manupulating these switches. Where a tonality setting means such as a tonality setter 123 is provided, the setting of the initial counter melody note, upper limit key code MAX, and the lower limit key code MIN may be made with a degree designation switch, not shown. More particularly, when a tonality is designated by the tonality designator, a note name corresponding to a designated degree is automatically known, so that it is possible to designate a desired initial note, upper limit note or lower limit note with a degree designation switch. In this case, however, as it is impossible to designate an octave, the octave tone range is fixed to a predetermined range or it is necessary to provide a specific octave designator. Although not shown in the drawing, the following improvements can also be added.

(7) This improvement is used for applying an end feeling for the counter melody progression. Thus where the accompaniment chord progresses form a chord of V7 (dominant 7th) to a chord of I (tonic), and where a counter melody note produced corresponding to the chord of V7 is a 4th degree note, a 3rd degree note is produced as a counter melody note corresponding to the chord of I, whereas. When the counter melody note generated corresponding to a chord of V7 is a 7th degree note, 1st degree note is produced as a counter melody note corresponding to a chord of I. Such melody progression satisfics theory of end thus giving an end feeling. This can be accomplished by the following processing.

More particularly, a chord detector is provided to detect a chord from the key depression state of the lower keyboard and depending upon the detected chord name and the tonality name designated by the tonality designator, the type (chord of V7 or I) of the chord. Where a chord of V7 is detected, the degree of the counter melody note (4th degree or 7th degree) is detected in accordance with the note name of the counter melody note and the tonality name which are now being produced. When the detected note is a 4th or 7th degree note, it is stored in a suitable memory device. Then the performed chord is detected and when the detected chord is instead of a counter melody key code searched by a search section 28A, the key code of a 3rd degree note or 1st degree note determined by the end theory is latched in the latch circuit 27. In other words, where the fact that a 4th degree note was produced as a preceding note, the key code of a 3rd degree note is latched by the latch circuit 27 as a counter melody key code CMKC. Where the fact that a 7th degree note was produced as a previous note, the key code of an 1st degree note is latched by the latch circuit 27. The note name (note code) of the 3rd or 1st degree note can readily be determined from the note name designated by the tonality designator. As has been defined in the introduction description of this specification, the term "end" used herein does mean an absolute end by also means an intermediate end.

(8) When a counter melody note becomes parallel with an ordinary melody note (upper keyboard depressed key tone) or a bass note (perfect 8th or a perfect 5th interval), the chord feeling is weakened so that a counter melody note is selected to avoid paralleling. This can be realized by the following processing.

Thus, the output of the search counter 30 is compared with all key code assigned to the upper keyboard channels and with key codes assigned to the pedal keyboard channels, so that when the output of the counter 30 is an interval of 3rd or perfect 5th, the AND gate circuit 149 (FIG. 8) provided for forming a search completion signal OK is disabled. This enables to block with the AND gate circuit 149 a coincidence signal EQ even though it is generated from the compartor 31 corresponding to the output of the search counter 30, with the result that any counter melody key code that may become parallel with an upper keyboard note or a pedal keyboard note (bass note) would not be latched by the latch circuit 27. In FIG. 8, the improvements (1) through (6) were incorporated into the circuit shown in FIG. 3, but it is possible to incorporate improvements (1) through (6) as well as (7) and (8) to the circuit shown in FIG. 7 and it is believed that modified circuit can be readily formed from the description regarding FIG. 8.

Figure 13:
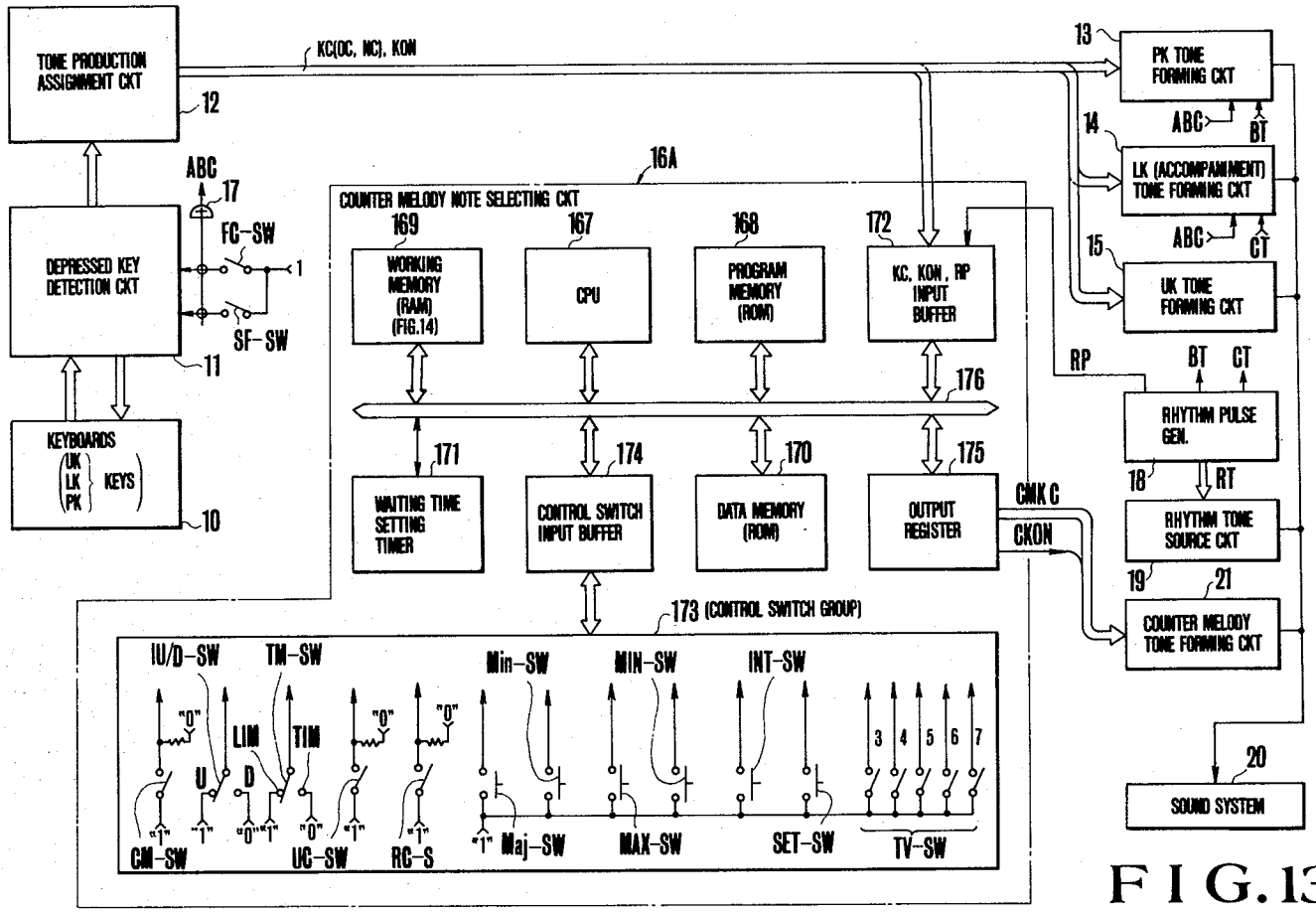
FIG. 13 is a block diagram showing another embodiment of this invention in which the counter melody note selection circuit is constituted by a microcomputer.

FIG. 13 shows an embodiment wherein the counter melody note selector 16A is constituted by a microcomputer and keyboards 10, depressed key detector 11, tone production assignment circuit 12, musical tone signal forming circuits 13, 14 and 15 for respective keyboards, rhythm pulse generator 18, rhythm tone source circut 19, sound system 20 and counter melody musical tone signal forming circuit 21 are identical to those shown in FIG. 1.

The counter melody note selector 16A constituted by a microcomputer comprises a central processing unit (CPU) 167, a working memory circuit 169 made up of a program memory device 168, a random access memory device (RAM), a data memory device comprising a read only memory device (ROM), a timer 171 for setting a waiting time, a buffer circuit 172 applied with a key code KC, a key-on signal KON and a rhythm pulse RP, a control switch input putter circuit 174 and an output register 175 for outputting a counter melody key code CMKC, a counter melody key-on signal CKON, and data are exchanged between respective circuit elements via a bus line 176. The counter melody note selector 16A has the same function as that of the counter melody note selector 16 shown in FIGS. 3 and 7 and the same as that of the counter melody note selector 16 shown in FIG. 8 which is incorporated with the improvements (1) through 8 described above.

Among a group of control switches 173, a counter melody selection switch CM-SW is closed at the time of starting a counter melody performance. An initial up/-down motion selection switch I U/D-SW is provided to select either one of the up or down as the initiation motion direction. A turn mode selection switch TM-SW selects switching from up to down or vice versa according to the upper and lower limit values as the max/min comparsion control circuit 29A shown in FIG. 3 (this is termed a upper/lower limit mode LIM) or according to the number of times of generating the counter melody note as the up/down motion number control circuit 29B shown in FIG. 7 (this is termed a time mode TIM). The upper keyboard change-on switch UC/SW selects whether a counter melody note is to be changed or not in response to a new key depression of the upper keyboard. The rhythm pulse-on switch SW selects whether the counter melody tone is to be changed or not in response to a predetermined rhythm pulse (measure pulse or beat pulse).

The major selection switch Maj-SW is closed when the tonality of a music to be performed is a major tonality, while the minor selection switch is closed at the time of a minor tonality. As has been described with reference to the tonality setter 123 shown in FIG. 10, concurrently with the depression of a key of the lower keyboard corresponding to the root note of a desired tonality, either one of the switches Maj-SW and Min-SW is closed to designate the tonality. The upper limit key code setting switch MAX-SW and the lower limit key code setting switch MIN-SW and closed when setting upper limit key code MAX and the lower limit key code MIN respectively, and as has been described with reference to the max/min data setter 122 shown in FIG. 10, concurrently with the depression of a key of the lower keyboard corresponding to a desired upper or lower limit note the switch MAX-SW or MIN-SW is closed to set the desired upper limit key code MAX or lower limit key code MIN. The initial value presetting switch INT-SW is used to set an initial counter melody note, and like the switch 125 shown in FIG. 8, concurrently with the depression of a key of the lower keyboard corresponding to a desired initial counter melody note the switch INT-SW is closed to set the desired initial counter melody note.

The number-of-times set switch SET-SW and the number-of-times selection switch group TV-SW are used to set the number of times of generations (or selections) of the counter melody note at the time of up or down motion in the number-of-times mode TIM. The number-of-times selection switch group TV-SW comprises a plurality of switches corresponding various number of times (for example 3,4,5,6 and 7). One of the switch groups TV-S corresponding to a desired number of times is closed and the number-of-times set switch SET-SW is closed to set a desired number of times.

Figure 14:
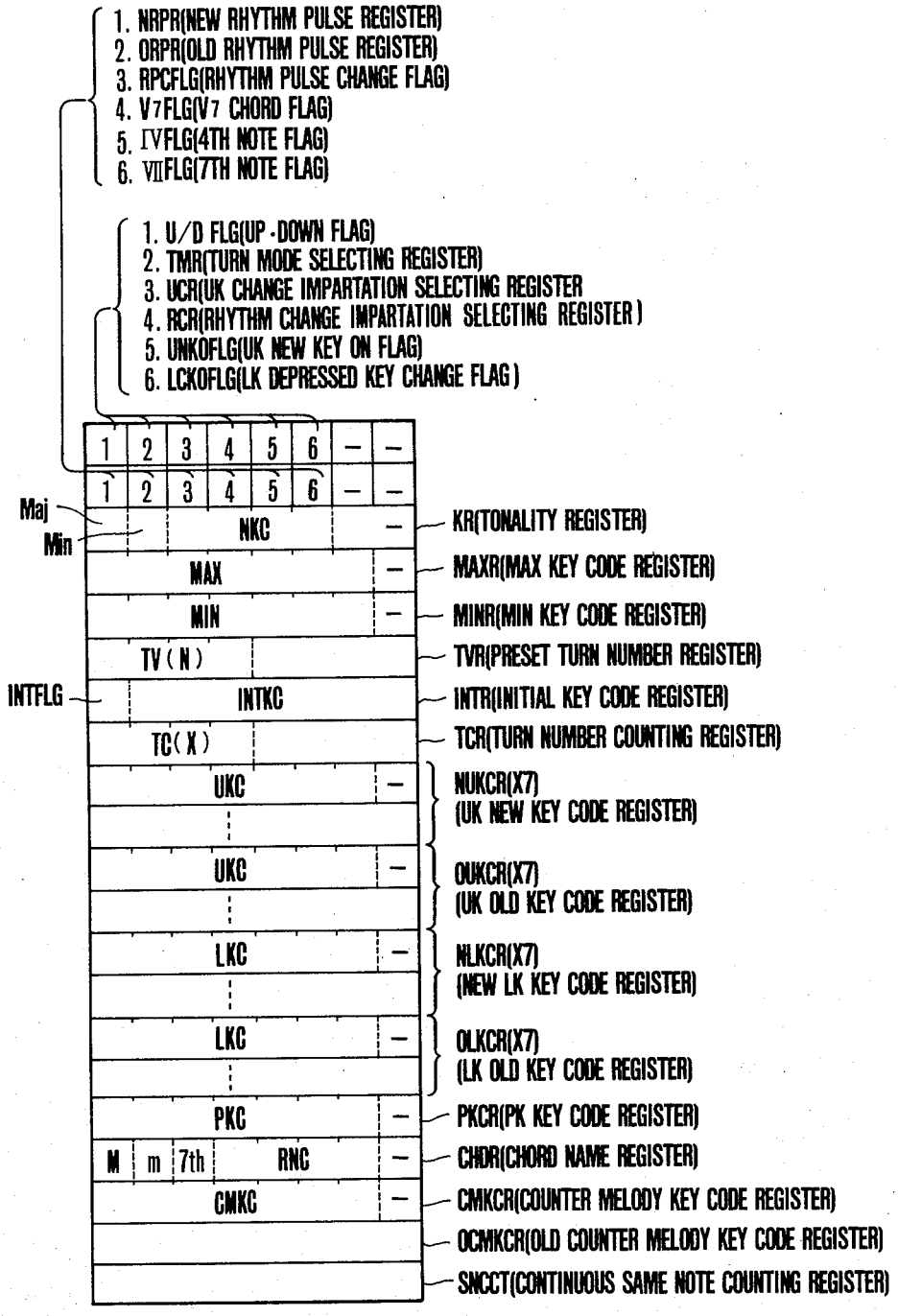
FIG. 14 shows registers contained in the working memory device shown in FIG. 13.

A working memory device 169 functions as a register for temporarily storing the data produced in the preceding step and one example of a register contained in the working memory device 169 is shown in FIG. 14. An up/down flag U/D FLG is provided to store the search direction (up or down) of the counter melody note. When signal is "1" it shows the up mode, while when "0" the down mode. A turn mode selection register TMR is used to store the output of the turn mode selection switch TM-SW (FIG. 13) and functions to store a signal "1" in the max/min mode LIM, but "0" in the number-of-times mode TIM. A upper keyboard change-on selection switch UC is used to store the output of the upper keyboard change-on switch UC-SW (FIG. 13). Where the counter melody note is changed in response to a new key depression of the upper keyboard, signal "1" is stored but "0" is stored in the other cases. A rhythm pulse-on selection register RCR is used to store the output of the rhythm pulse-on switch RC-SW (FIG. 13). Where a counter melody note is to be changed in response to the generation of a rythm pulse RP, signal "1" is stored but "0" is stored in other cases. The upper keyboard new key-on flag UNKOFLG is set to "1" when a new key is depressed on the upper keyboard. A lower keyboard depressed key change flag LCKOFLG is set to "1" when a new key of the lower keyboard is newly depressed or released.

A new rhythm pulse register NRPR is provided for storing the state ("1" or "0") of a present rhythm pulse RP, while an old rhythm pulse register ORPR stores the state of a previous rhythm pulse RP. A rhythm pulse change flag RPCFLG is set to "1" when the content of the register ORPR is "0" and that of the register NRPR is "1" that is when the rhythm pulse RP builds up. A V7 chord flag V7FLG is provided to be set to "1" when a V7 chord (dominant 7th chord) is performed as the accompaniment chord. A 4th degree note flag IVFLG is set to "1" when a 4th degree note is selected as the counter melody note. A 7th degree note is selected as the counter melody note.

A tonality register KR stores the root note note code KNC of a designated tonality, and a major tonality signal Maj and a minor tonality signal Min which shows the major/minor discrimination. An upper limit key code register MAXR stores the upper key code MAX which was set while a lower limit key code register MINR stores the lower key code MIN set. A number-of-times registrer TVR stores a data TV(N) representing the number of times selected and set by the number-of-times selection switch group TV-SW (FIG. 13). An initial key code register INTR stores the key code INTKC of the initial counter melody note. An initial flag INTFLG is set to "1" when the initial key code INTKC is stored in the initial key code register INTR. A number-of-times counter register TCR is provided to count and store the number of generations of the counter melody notes TC(x) at the present time in the up or down motion.

A new upper keyboard key code registor NUKCR is provided to store key codes of the upper keyboard depressed keys respectively assigned to 7 upper keyboard channels, and constituted by 7 registers corresponding to respective upper keyboard channels. An old upper keyboard key code register ONKCK is used to store an old upper keyboard key code UKC which has been stored in the register NUKCR, and constituted by 7 registers corresponding to respective upper keyboard channels. A new lower keyboard key code register NLKCR is used to store key codes LKC of the lower keyboard depressed keys assigned to 7 lower keyboard channels and constituted by 7 registers corresponding to respective lower keyboard channels. An old keyboard key code register OLKCR is provided to store an old lower keyboard key code LKC which has been stored in the register NLR and constitued by 7 registers. A pedal keyboad key code register PKCR is used to store key codes of the pedal keyboard depressed keys (bass note) assigned to the pedal keyboard channels. A chord name register CHDR is used to store a root note note code RNC representing the root note name of an accompaniment chord, a signals M (major), m (minor), 7th (seventh) which represent the chord type. A counter melody key code register CMKCR is provided to temporality store a counter melody key code CMKC searched, and then transfer to the output register 175 (FIG. 15) the key code CMKC temporarily stored therein. The working memory device 169 further comprises an old counter melody key code register OCMCR and a same note continuation counter register SNCCT which will be described later.

Figure 15:
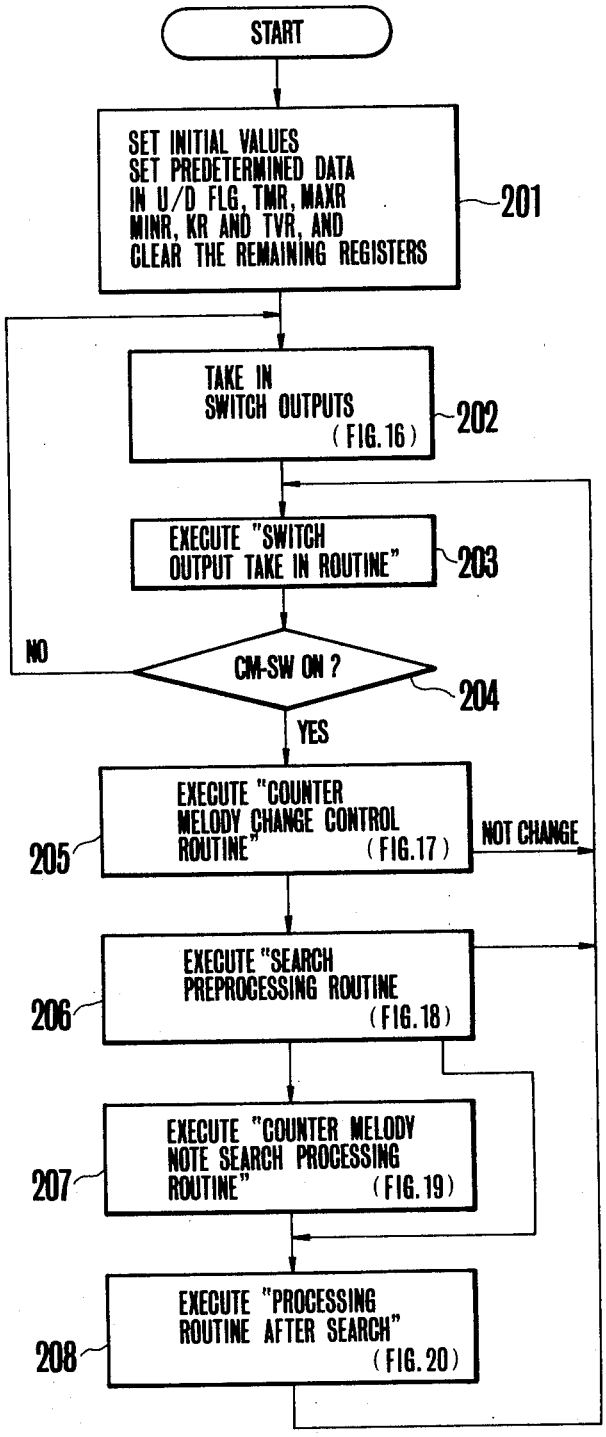
FIG. 15 is a flow chart showing one example of the outline of a program executed by the counter melody note selection circuit shown in FIG. 13.

FIG. 15 is a flow chart showing one example of a program executed by the counter melody note selection circuit 16A. At step 201 following the start, various registers (FIG. 14) in the working memory device 169 (FIG. 13) are set to their initial states. More particularly, the up/down flag U/D FLG is set to "1", "1" is stored in the turn mode selection register TMR, a predetermined key code is set in the upper limit key code register MAX, a predetermined key code is also set in the lower limit key code register MINR, data (Maj is "1", Min is "0" and KNC is "1111") representing the C major tonality is set in the tonality register KR, and a value 5 ("0101") is set in the set number-of-times register TVR. Registers in the working memory device other than the registers referred to above are cleared to "0". The data to be set in the registers MAXR, MINR, KR and TVR are read out from the data memory device 170 (FIG. 13) and supplied to the working memory device 169. The reason for initially setting predetermined data in these registers MAXR, MINR, KR and TVR is to make possible to advance the processing based on these initially set data even when the performer does not set data in these registers later.

Figure 16:
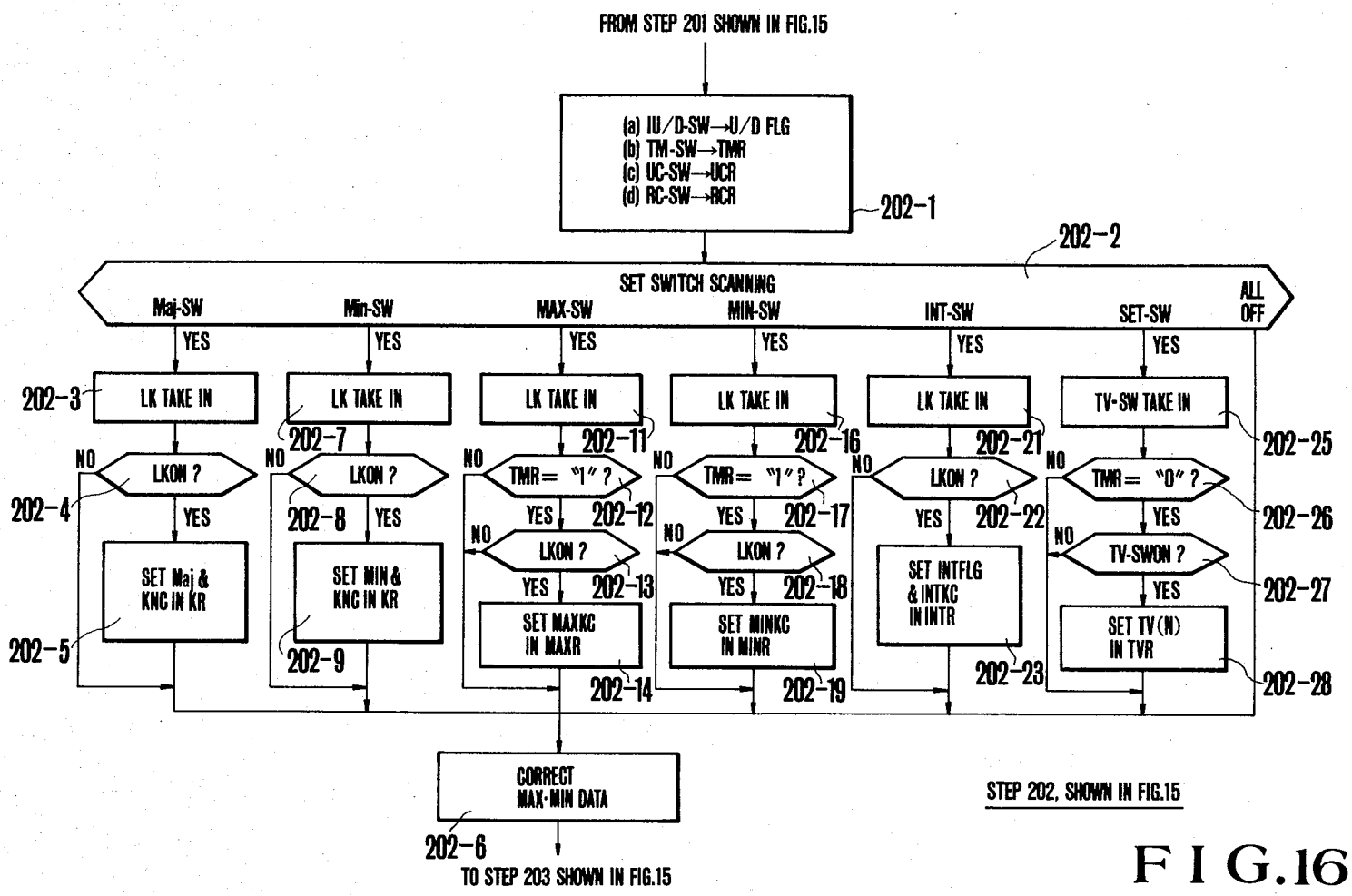
FIG. 16 is a flow chart showing one example of the detail of the switch output take in routine shown in FIG. 15.

At the next step 202 a "switch output take in" routine is executed. Thus the outputs of the control switch group 173 as taken into the working memory device 169 via the control switch input buffer circuit 174, the detail thereof being shown in FIG. 16. At step 202-1 shown in FIG. 16, the outputs of the selection switches IU/D-SW, TM-SW, UC-SW, RC-SW of the control switch group 173 (FIG. 13) are taken into the registers (FIG. 14) in the working memory device 169. More particularly, (a) in the processing of "IU/D-SW-U/D FLG", the output of the initial up/down motion selection switch IU/D-SW is taken into the up/down flag U/D FLG. Where the switch IU/D-SW is set to the up (U) mode, the flag U/D FLG is set to "1" whereas when set to the down (D) mode the flag U/D FLG is set to "0". (b) In the processing of "TM-SWΔTMR", the output of the turn mode selection switch TM-SW is taken into the turn mode selection register TMR. Where the switch TM-S is set to the max/min mode LIM, "1" is set in the register TMR, whereas when set to the number-of-times mode TIM "0" is set in the register TMR. (c). In the processing of "UC-SW→UCR", the output of the upper keyboard change-on switch UC-SW is set in the upper keyboard change-on selection register UCR. When the switch UC-SW is closed, this means that a change performance that change, the counter melody note in response to a new key depression of the upper keyboard has been selected, whereas a open state of the switch UC-SW means that the signal set in the register UCR is "0" that is the change performance is not selected. (d). In the processing of "RC-SW→RCR", the output of the rythm pulse-on switch RC-SW is set in the rhythm pulse-on selection register RCR. When the switch RC-SW is closed, (change performance which changes the counter melody note at the time of generating a rhythm pulse is selected), "1" is stored in the register RCR.

At the next step 202-2 "set switch scanning", switches Maj-SW, Min-SW, MAX-SW, MIN-SW, INT-SW and SET-SW (FIG. 13) which were closed when desired data are set as the upper key code MAX, etc are scanned to detect whether these switches are closed or not. When the major selection switch Maj-SW is closed, the program is advanced to a routine "Maj-SW is YES". At step 203 of this routine the key code KC of the lower keyboard depressed key (that is the key code assigned to a lower keyboard channel in which the key-on signal KON is 7") is set in the input buffer circuit 172 (FIG. 13). At the next step 202-4 of "LKON?" a judgement is made as to whether any key of the lower keyboard is depressed or not, that is whether any key code KC of the lower keyboard depressed key was set in the buffer circuit 172 or not. When the result of judgement is YES, the program is advanced to step 202-5 where "1" is set in the tonality register KR (FIG. 14) in the working memory device 69 as a major tonality signal Maj, and further the note code portion of the lower keyboard depressed key code set at step 202-3 is set in the tonality register KR as the major note code KNC. When the result of judgement at step 202-4 is NO, at step 202-6 max/min data is corrected without performing step 202-5.

Where the minor selection switch Min-SW is closed "Min-SW YES" routine is executed. In this routine, at steps 202-7 and 202-8 the same procedure as in steps 202-3 and 202-4 are executed and when the result of judgement made at step 202-8 is YES, at step 202-9, "1" representing the minor tonality signal MIN and the note code of the depressed lower keyboard depressed key represented by a major note note code KNC are set in the tonality register KR.

Where the upper key code setting switch MAX-SW is depressed a "MAX-SW YES" routine is executed. The processing executed at step 202-11 of this routine is identical to that of step 202-3, while at step 202-12, a judgement is made whether "1" is stored in the turn mode selection register TMR (that is max/min mode) or not (number-of-times mode). When the result of judgement is YES, at step 202-14, the key code of the lower keyboard key code KC which has been set in the upper limit key code register MAXR( FIG. 4) in the preceding step 202-11 is set in the tonality register KR as the upper limit key code MAX and the program is advanced to step 202-6. When the result of judgement of step 202-12 is NO, it means the number-of-times mode, so that even when the switch MAX-SW is closed, no signal is set in the upper key code register MAXR and the step is directly jumped to step 202-6.

Where the lower limit key code set switch MIN-SW is closed, "MIN-SW YES" routine is executed. The processings at steps 202-16, 202-17 and 202-18 are identical to those executed at steps 202-11, 202-12 and 202-13. When the result of judgement at step 202-18 is YES, at step 202-19 the key code of the lower keyboard depressed key is set in the lower limit key code register MINR as a lower limit key code MIN. Then, the step is advanced to step 202-6.

Where the initial value preset switch INT-SW is closed, after executing the steps 202-21 and 202-22 identical to steps 202-11 and 202-18, at step 202-23 the intial flag INTFLG is set in the initial key code register INTR and the key code KC of the lower keyboard depressed key is set as the key code INTKC of the initial counter melody note. Then the step is advanced to step 202-6.

When the number-of-times switch SET-SW is closed, at step 202-25 the outputs of the number-of-times selection group TV-SW (FIG. 13) are applied to the input buffer circuit 174. At the next step 202-26, a judgement is made whether the turn mode selction register TMR is storing "0" or not. When "0" is stored (YES) it means that the number-of-times mode TIM has been selected. At the next step 202-27, a judgement is made whether ther is a switch closed by the output signals outputted by the switch group TV-SW and applied to the input buffer circuit 174 or not. where ther is a closed switch, at step 202-28 data TV(N) corresponding to that switch is set in the set number-of-times register TVR. Thereafter, the step is advanced to step 202-6.

When the processing executed at step 202-2 detects that switches Maj-SW, Min-SW, MAX-SW, MIN-SW, INT-SW and SET-SW are all open, the step is jumped to step 202-6 where,when a 7th degree note is set as the upper limit key code MAX and a 4th degree note is set as the lower limit key code MIN, the 7th degree note is changed to an 1st degree note and the 4th degree note is changed to a 3rd degree note. More particularly, tonality data KNC, Maj and Min are read out from the tonality register KR and based upon the note code NC7 of the 7th degree note and the note code NC4 of the 4th degree note of the tonality represented by these data are read out from the data memory device 170. The note code NC7 of the 7th degree note is compared with the note code portion NC of the upper key code portion NC of the upper key code MAX stored in the register MAXR and when a coincidence is obtained, 1 or 2 is added to its upper limit key code to correct it into the key code of the 1st degree note, thus changing the content of the register MAXR to the corrected key code. Further, the note code NC4 of the 4th degree note is compared with the lower limit key code MIN of the register MINR and when they coincide with each other, 1 or 2 (in the case of the major tonality) or 2 or 8 (in the case of the minor tonality) is subtracted from the lower limit key code MIN to correct or change the key code to the key code of the 3rd degree note thus changing the content of the register MIN to the corrected key code. Where the note is not the 7th or 4th degree note, the content of the register MAXR or MINR would not be changed.

When the processing at step 202-6 is completed, the program is advanced to step 203 shown in FIG. 15 where the output of the counter melody selection switch CM-SW is applied to the control switch input buffer circuit 174 (FIG. 13). At the next step 204, a judgement is made as to whether the output of the switch CM-SW which has been applied to the input buffer circuit 174 is "1" (closed) or not. Where the switch CM-SW is not yet closed the result of judgement is NO so that the program is returned to step 202 where the "switch output take in routine" is executed again. Before closing switch CM-SW, the processing of step 202 is repeated many times to set all data (MAX, etc.) to be set.

When the counter melody selection switch CM-SW is closed the result of judgement executed at step 204 is YES, thus advancing to step 205 of "counter melody change control routine" in which substantially the same processing as the functions of circuits 22A, 22B and 22C shown in FIG. 9 are executed. The detail of this routine is shown in FIG. 17.

Figure 17:
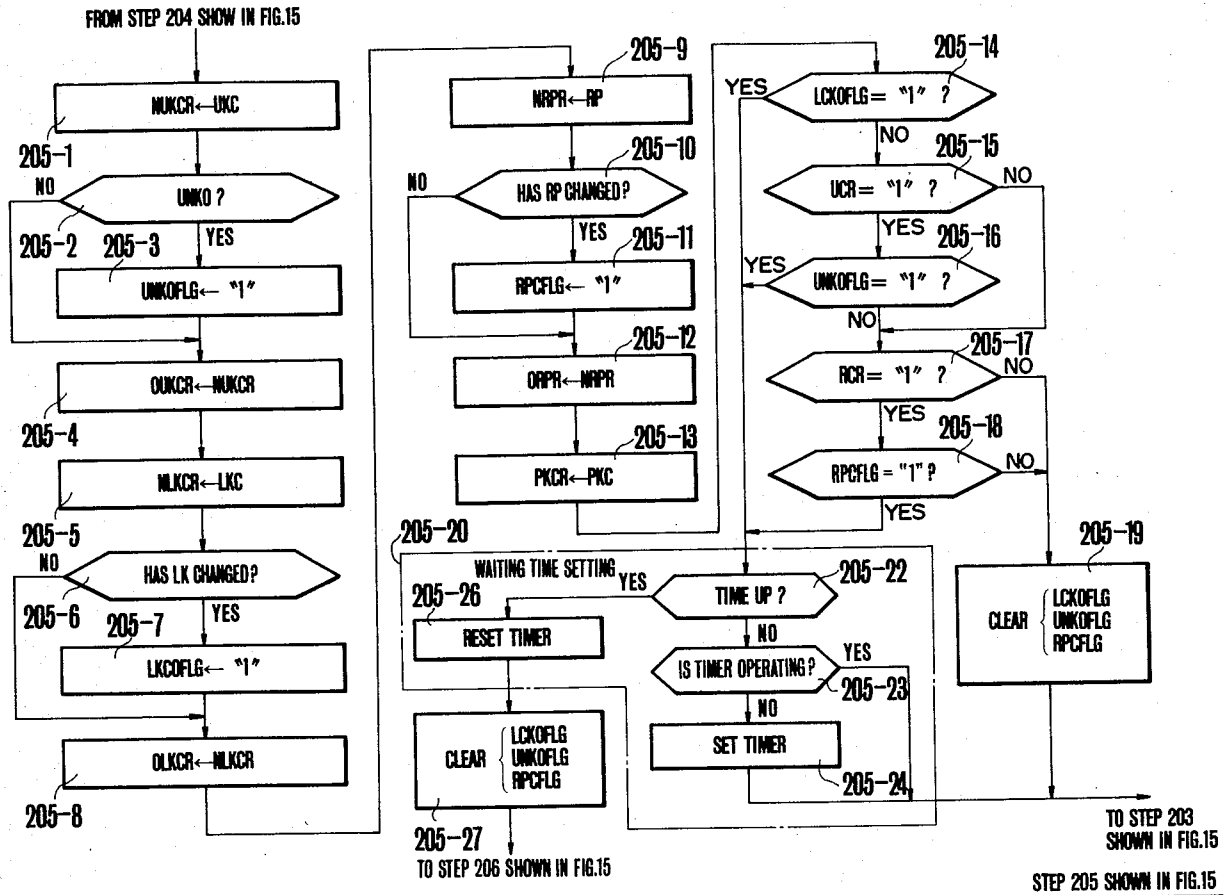
FIG. 17 is a flow chart showing the detail of the counter melody change control routine shown in FIG. 15.

At step 205-1 shown in FIG. 17, the key codes UKC (upper keyboard depressed key codes) of the depressed keys (KON are "1") assigned to 7 upper keyboard channels among the key codes KC outputted from the tone generation assignment circuit 12 (FIG. 13) are all applied to the input buffer circuit 172 and the upper keyboard depressed key codes UKC for the 7 channels are set in the new upper keyboard key code register NUKCR. Of course, all "0" are set in the register NUKCR corresponding to the upper keyboard channels not assigned with the depressed key key codes.

At the next step 205-2, the content of the register NUK which was set with new data UKC as above described is compared with the content of the old upper keyboard key code register OUKCB. The old upper keyboard key code register is storing the content of the register NUKCR immediately before setting the new data by the processing executed by step 205. Where the result of comparison shows that the register NUKCR is storing a new key code UKC not found in the register OUKCR (YES), it means that a new key was depressed on the upper keyboard and the step is advanced to step 205-3 to set to upper keyboard key-on flag UNKOFLG to "1". When the result of comparison is NO, the flag UNKOFLG is not set and maintained at "0" state.

At the next step 205-4, all data (key codes of 7 channels) stored in the new upper keyboard key code register NUKCR are stored in the old keyboard key code register OUKCR.

At step 205-5, among the key codes KC produced by the tone generation assignment circuit 12 (FIG. 13), depressed key (KON is "1") codes LKC assignes to lower keyboard channels are applied to the input buffer circuit 172 and the received lower keyboard depressed key key codes LKC of 7 channels are set in the new lower keyboard key code register NLKCK.

At step 205-6, the content of the new lower keyboard key code register NLKCR is compared with the content of the old lower keyboard key code register OLKCR and a judgement is made whether the both contents are different or not. When they are different (YES), it means that the state of the lower keyboard depressed key has changed (new key is depressed or released) and the step is advanced to step 205-7 where the lower keyboard depressed key change flag LCKOFLG is set to "1". When the result is NO, the state of the flag LCKOFLG is maintained at "0".

At step 205-8, all data (key codes of 7 channels) stored in the new lower keyboard key code register NLKCH are stored in the old lower keyboard key code register OLKCR.

At the next step 205-9, the signal state of a rhythm pulse generator 18 (FIG. 13) corresponding to the generation of a measure or beat is applied to the input buffer circuit 172 and the signal state ("1" when the pulse is generated but "0" when the pulse is not generated) of the applied rhythm pulse RP is stored in the new rhythm pulse register NRPR.

At step 205-10, the content ("1" or "0") of the new rhythm pattern pulse register NRPR is compared with the content ("1" or "0") of the old rhythm pulse register ORPR to judge whether NRRR is "1" and ORPR is "0" or whether the rhythm pulse has built up or not. When the result of judgement is YES, at step 205-11, "1" is set in the rhythm pulse change flag KPCFLG (RPCFLG 1), whereas when the result is NO, the state of the flag RPCFLG is still maintained at "0".

At the next step 205-12, the content of the new thythm pulse register NRPR is stored in the old rhythm pattern register ORPR.

At the next step 205-13, among the key codes KC outputted from the tone generation assignment circuit 12 (FIG. 13), the key codes PKC of the depressed keys (KONs are "1") assigned to the pedal keyboard channels are applied to the input buffer circuit 172 and then stored in the pedal keyboard key code register PKCR in the working memory device 169.

At the next step 205-14, a judgement is made as to whether the lower keyboard depressed key change flag LCKOFLG was set to "1" or not. When the result of judgement is YES, the step is immediately advanced to step 205-20 where a waiting time is set, whereas when the result is NO, the step is advanced to step 205-15 where a judgement is made as to whether "1" is set in the upper keyboard change-on selection register UCR or not. When the result is YES (the counter melody note is changed in response to an upper keyboard new key-on code) the step is advanced to step 205-16, whereas when the result is NO, the step is jumped to step 205-17. Since in the case of NO, it is not necessary to confirm the state of the upper keyboard new key-on flag UNKOFLG.

At step 205-16 a judgement is made as to whether the upper keyboard new key on flag UNKOFL has been set to "1" or not. When the result is YES, the step is advanced to step 205-20, whereas when the result is NO, the step is advanced to step 205-17 where a judgement is made as to whether "1" has been set in the rhythm pulse-on selection register RCR. When the result is YES the counter melody note is changed in response to a rhythm pulse and the step is advanced to step 205-18 where a judgement is made as to whether "1" was set in the rhythm pulse change flag RPCFLG or not. When the result or judgement is YES the program is advanced to the step 205-20 where the waiting time is set.

Where the result of judgement executed at step 205-17 or 205-18 is NO, at step 205-19 respective flags LCKOFLG, UNKOFLG and RPCFLG are once cleared (at through they are "0" at this time) and the step is returned to the step 203 shown in FIG. 15.

At step 205-22, a judgement is made as to whether the waiting time is over or not. When the result is NO, at step 205-23 a judgement is made whether the timer 171 (FIG. 13) is operating (counting the waiting time) or not. When the result is NO, at step 205-24, the timer 171 is started. Thereafter, the step is returned to step 203 shown in FIG. 15 and after executing steps 203 and 204, the step 205 ("counter melody change control routine", FIG. 17) is executed again. When the timer is set, since all flags LCKOFLG, UNKOFLG and RPCFLG are always set to "1", the step is returned the to step 205-20 of the routine for setting the waiting time.

At step 202-22, a time-up is judged and when the result is NO, the step is transferred to step 202-23. When the timer is operating (YES) the program is returned to step 203 without executing the step 202-24.

When a predetermined waiting time (for example 15 microseconds) elapses after setting the timer 171, the result of judgement at step 205-22 becomes YES, and at step 205-26 the timer is reset. Thereafter, at step 205-27, flags LCKOFLG, UNKOFLG and RPFLG are cleared to complete the counter melody change control routine, thereby transferring to a search preprocessing routine executed at step 206, the detail of this routine being shown in FIG. 18.

Figure 18:
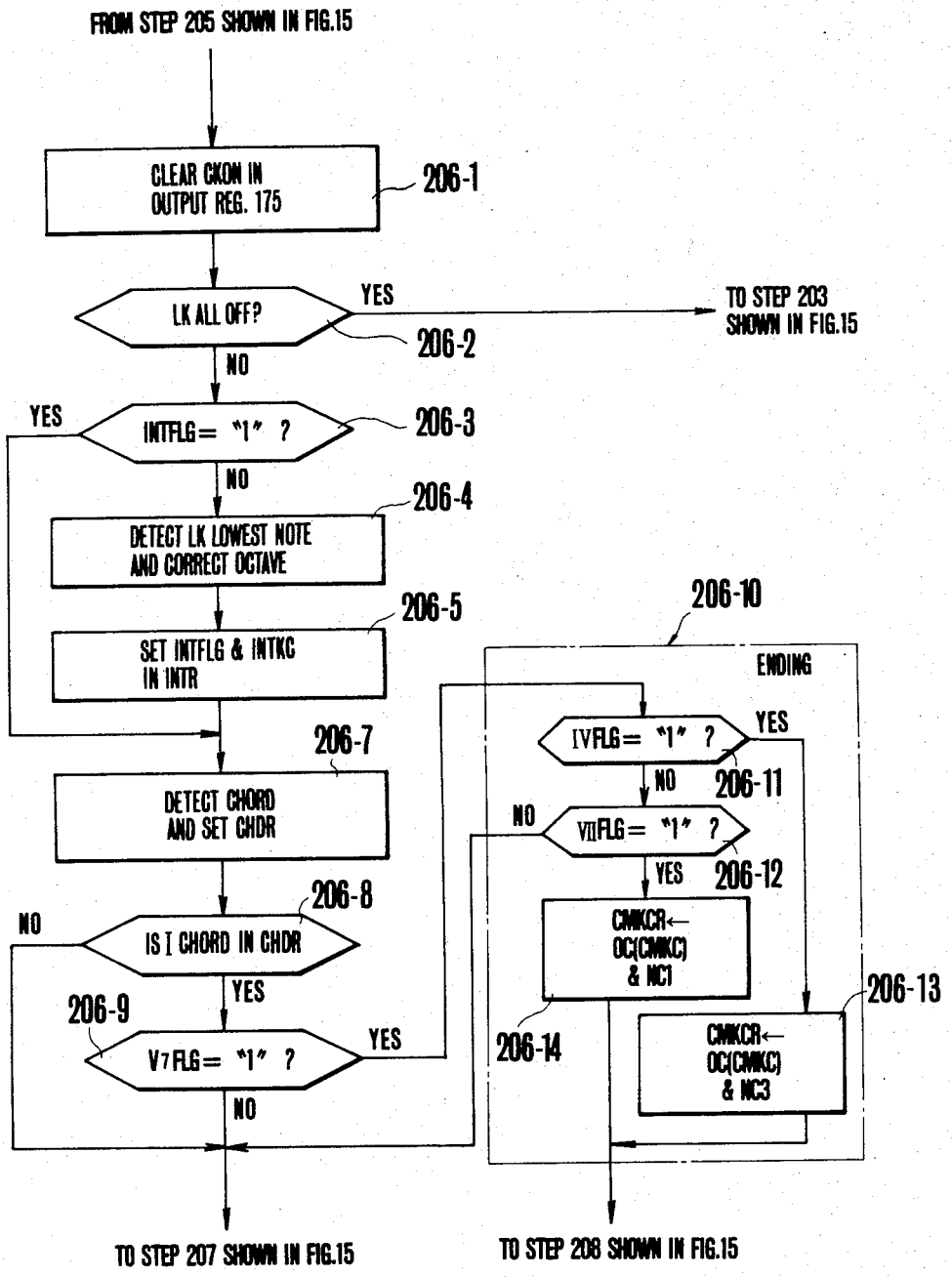
FIG. 18 is a flow chart showing the detail of the search preprocessing routine shown in FIG. 15.

In FIG. 18, at step 206-1 the counter melody key-on signal CKON stored in the output register 175 (FIG. 13) is cleared. At the next step 206-2, all contents (of 7 channels) of the old lower keyboard key code register OLKCR are checked so as to judge whether all keys of the lower keyboard have been released (all off-YES) or not. Where all keys of the lower keyboard have been released there is no note (accompaniment chord) to be searched so that the program is returned to step 203 shown in FIG. 15. Thus, the search of the counter melody note is not made. When a key is being depressed on the lower keyboard the result of judgement executed at step 206-2 is NO, and at the net step 206-3 a judgement is made as to whether "1" was set in the initial flag INTFLG in the initial key code register INTR or not. When the result is YES, it means that any initial key code INTKC that designates the initial counter melody note has been set, and the step is jumped to step 206-7 where a chord is detected and CHDR is set. Where the result is NO, it means that a desired initial key code INTKC was not set, and at step 206-4 a lower keyboard lowest note is detected and the octave is corrected.

At this step 206-4, the key code of the lowest note of the lower keyboard depressed keys is detected from the content of the old lower keyboard key code register OLKCR and the octave code of the lowest key code is suitably corrected such that it will be included in the range between the upper limit key code MAX and the lower limit key code MIN respectively stored in registers MAXR and MINR.

At the next step 206-5, "1" is set in the initial flag INTFLG of the initial key code register INTR and the lower most note key code whose octave code has been corrected is set in the initial key code register INTR as an initial key code INTKC. In this manner, where the performer does not set the initial key code INTKC, the lower most note of the firstly depressed lower keyboard key (accompaniment note) is automtically made to the initial counter melody key code INTKC.

At the next step 206-7, a chord is detected by a combination of a plurality of lower keyboard depressed key key codes stored in the old lower keyboard key code register OLKCR and a note code RNC representing the root note of the detected chord and the data M, m and 7th representing the types (major, minor and seventh) of the chord are set in the chord name register CHDR. The chord is detected by rearranging the note code portions of the lower keyboard depressed key key codes stored in the register OLKCR in the order of degrees in accordance with the tonality data stored in the tonality register KR, comparing this combination of degrees with the combination of degrees of the chords read out from the data memory device 170 (FIG. 13) and then determining the chord name when both combinations coincide with each other.

At the next step 206-8, a judgement is made whether a chord (i.e. the present accompaniment chord) represented by the data stored in the chord name register CHDR is a chord of I (tonic chord) or not. This can be judged by comparing the data RNC, M, m and 7th stored in the chord name register with the data KNc, Maj, and Min stored in the tonality register KR and then comparing the result of comparison with the data of the chord of reference I read out from the data memory device 170 (FIG. 13). The judgement executed at step 206-8 is made for providing the end feeling of the improvement (7).

When the result of judgement at step 206-8 is NO, the program is jumped to step 207 shown in FIG. 15 to complete the search preprocessing routine and then commences "a counter melody note search processing routine" (FIG. 15).

When the result of the judgement executed at step 206-8 is YES, a judgement is made whether the V7 chord flag V7FLG was set (that is whether the previous accompaniment chord was a dominant 7th chord) for the purpose of judging whether an end processing is to be made or not.

When the result of step 206-9 is YES, an end processing is executed at step 206-10, whereas when the result is NO (at this time the chord is the I chord but in the previous time it was not the 7th chord, at step 207 shown in FIG. 7 a counter melody note search processing routine is started. The end processing step 206-10 will be described later. Now the counter melody note search processing routine will be described.

Figure 19:
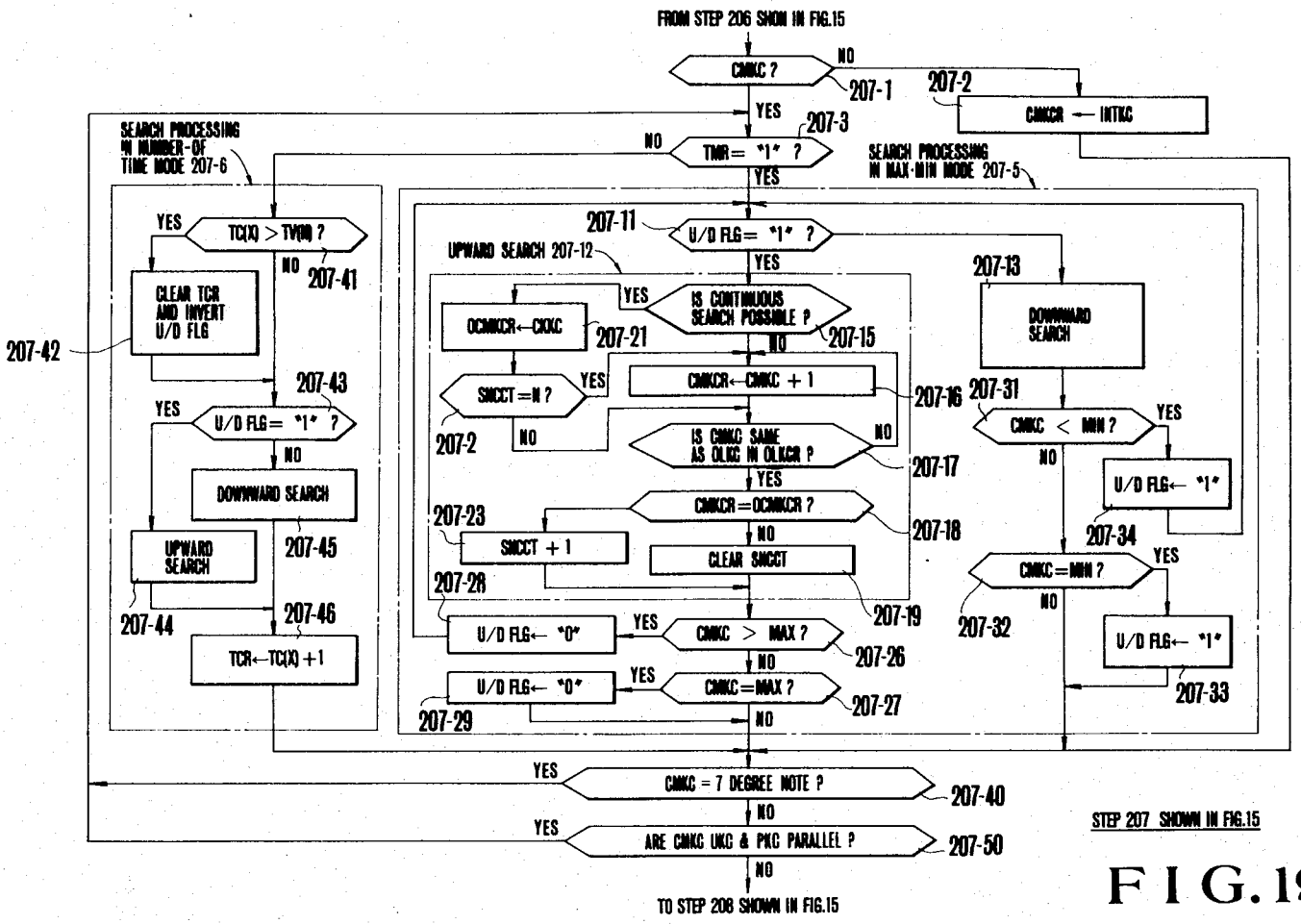
FIG. 19 is a flow chart showing the detail of the counter melody note search processing routine shown in FIG. 15.

The counter melody note search processing routine is executed for providing a function similar to that of the counter melody note search section 28 or 28A (FIGS. 3 and 8), and the detail of this routine is shown in FIG. 19.

At step 207-1 shown in FIG. 19, a judgement is made as to whether any counter melody key code CMKC is being stored in the counter melody key code register CMKCR or not. At the initial state, the content of the register CMKCR is cleared to "0" by the initial setting and there is no key code CMKC set therein (NO). After the first counter melody note has been outputted, the register CMCR is always inputted with any key code CMKC (YES). In the case of NO after setting the initial counter melody key code CMKC, the step jumps to step 207-40 for judging whether the key code CMKC is a 7th degree note or not without searching a counter melody note. At step 207-2, the initial key code INTKC stored in the initial key code register INTR is set in the counter melody key code register CMKCR as a counter melody key code CMKC.

When the result of judgement at step 207-1 is YES, a counter melody note is searched. More particularly, at first, at step 207-3, a judgement is made as to whether "1" is stored in the turn mode selection register TMR (up/down mode) or not (number-of-times mode). When the result is YES, at step 207-5, a search is made in the max/min mode, whereas in the case of NO, at step 207-6 a search is made in the number-of-times mode.

At the step 207-5, a judgement is made at step 207-11 as to whether the up/down flag U/D FL is "1" or not and when the result is YES, at step 207-12 upward search is made, whereas when the result is NO, at step 207-13 a downward search is made.

In the upward search executed at step 207-12, a judgement is made at step 207-15 as to whether a continuous search is possible or not. This judgement is made to determine whether the improvement (3) is to be adopted or not and the result is YES where there is a fear that the counter melody note may change frequently so as to enable to continuously select the same counter melody note. Otherwise the result is NO. To execute the step 207-15, a special selection switch, not shown, is provided and YES and NO may be judged depending upon ON and OFF of this switch, or YES and NO may be determined depening upon whether "1" is set in the upper keyboard change-on selection register UCR or the rhythm pulse-on selection register RCR (there is a fear of frequent change).

When the result of judgement of step 207-15 is NO, at step 207-16, "1" is added to the key code CMKC stored in the counter melody key code register CMKCR so as to restore a key code incremented by "1" (CMKC+1) in the register CMKCR. Consequently, the value of the key code CMKC stored in the register CMK is incremented by one.

At the next step 207-17, all key codes OLKC stored in the old lower keyboard key code register OLKCR (that is the key codes of the chord constituting notes) are compared with the key codes CMKC stored in the register CMKCR to judge whether there is a key code of the same note (the same note code) or not. Where there is no key code (chord constituting note) of the same note name as the key code CMKC (NO) the program is returned to step 207-16 to further increment by one the content (CMKC) of the register CMKCR. The counting up "1" of the key code CMKC is repeated until the code becomes the same note name (the same note code) as the key code (chord constituting note) stored in the register OLKCR. When the key code CMKC becomes to have the same note name (the same note code) as that of either one of the key code stored in the register OLKCR, the result of judgement executed at step 207-17 becomes YES. As this time the register CMKCR is storing a searched counter melody key code CMKC (a key code representing a counter melody note now to be produced).

At step 207-18, a judgement is made whether a counter melody key code presently searched and stored in the register CMKCR coincides with a key code representing a counter melody note previously produced and stored in the register OCMKCR. When a routine of NO is executed the same counter melody note does not continue so that the result of this judgement is always NO, in which case at step 207-19, the same note continuation counter register SNCCT is cleared, thus completing the upward search executed at step 207-12.

When the result of judgement executed at step 207-15 is YES, the step 207-16 for counting up one the key code CMKC is not executed firstly, but the priority is given to step 207-17. More particularly, at step 207-21, the key code CMKC stored in the counter melody key code register CMKCR is also stored in the old counter melody key code register OCMKC. At step 207-22, a judgement is made as to whether the content of the same note continuation counter register SNCCT has reached a predetermined number (for example 4) of the same note continuation. When the result of judgement is NO, it means that the same note of the previous counter melody note can be also selected at this time so that the processing at step 207-17 is given a priority. At this time, however the content of the register CMKCR is not yet counted up one, the key code CMKC stored therein shows the counter melody note previously produced. Consequently, when the result of judgement is YES, it means that the same note as before is also selected at this time. On the other hand when the result is YES, at step 207-16 the content of the register CMKCR is counted up one.

Where the result of judgement of step 207-17 becomes YES before executing step 207-16, the previous counter melody key code stored in the old counter melody key code register OCMKCR is the same as the counter melody key code CMKC presently selected and stored in the register CMKCR with the result that the result of judgement executed at step 207-18 becomes YES. In this case the content of the same note continuation counter register SNCCT is counted up one at step 207-27, thus completing the upward search executed at step 207-12.

As above described the number of times of continuing the same counter melody key code is counted by the counter register SNCT. When a counter melody key code different from the previous key code is searched before reaching a predetermined number of continuations N, at step 207-19, the counter register SNCCT is cleared. When the content of the register SNCT reaches the predetermined number before clearing the result of processing executed at 207-22 (in which a judgement is made as to whether the content of the register SNCCT is equal to N or not) becomes YES in the upward search at the next time. Then at step 207-16, a priority is given to the one count up processing of the register CMKCR, thus selecting a counter melody key code CMKC different from that of the previous note.

At step 207-27 following the upward search step 207-12, a counter melody key code CMKC to be presently produced and stored in the register CMKCR is compared with the upper limit key code MAX stored in the register MAXR to judge whether the code CMKC is larger than MAX or not. If the result is NO, at step 207-27, a judgement is made whether key code CMKC is equal to key code MAX or not. Where the counter melody key code CMKC does not reach the upper limit key code MAX, this state is also NO. Then at step 207-5, a search is made in the max/min mode, and the step is advanced to step 207-40 where a judgement is made as to whether the key code CMKC is equal to 7th degree.

When the counter melody key code CMKC coincides with the upper limit key code MAX. (the result of judgement as to whether CMKC is equal to MAX or not is YES), at step 207-29, the up/down flag U/D FLG is reset to "0" thus completing search in the max/-min mode.

Where the counter melody key code CMKC is greater than the upper limit key code MAX (the result of comparison CMKC MAX is YES), the step is transferred to step 207-28 where the up/down flag U/D FLG is reset to "0" and then program is returned to the first step 207-11 of search processing 207-5. When the result of judgement executed at the step 207-11 is NO, at step 207-13 a downward search is made. Where key code CMKC is greater than the key code MAX, it means that the note in on the outside of the counter melody note range (outside of MAX and MIN) the code is not converted into a note as it is, but instead, at step 207-13 the downward search is made to correct the counter melody key code CMKC to a value less than that of key code MAX.

The downward search step 207-13 is different from the upward search step 207-12 only in that the content of the counter melody key code register CMKCR is sequentially counted down and other processings are quite the same as those of the upward search step 207-12. More particularly, when the processing "CMKCR→CMKC+1" at step 207-16 of the upward 15 search step 207-12 is replaced by the procesing "CMKCR→CMKC−1" the downward search step 207-13 can be obtained.

At the step 207-31 to be executed later than the downward search step 207-13, the counter melody key code CMKC now to be produced and searched by the downward search executed at step 207-13 (stored in the register CMKCR) is compared with the lower limit key code stored in the register MINR so as to judge whether key code CMKC is smaller than the key code MIN or not. When the result is NO, at step 207-32 whether these codes coincide with each other or not is judged. When this result is also NO it means that the counter melody key code CMKC does not reach the lower limit key code MIN so that after completing step 207-5 for searching max/min mode, the program is advanced to step 207-40 where a judgement is made as to whether the counter melody key code CMKC is equal to a 7th degree note or not. When the result of judgement as to whether the key code CMKC is equal to MIN or not executed at step 207-32 is YES, at step 207-33 the up/down flag U/D FLG is set to "1", thus completing the search executed at step 207-5 by switching the mode to up mode.

When the result of judgement "CMKC<MIN?" executed at step 207-31 is YES, since the key code CMKC in the register CMKC is smaller than the lower limit key code MIN, at step 207-34 the up/down flag U/D FLG is set to "1" to switch the mode to the up mode and then the program is returned to the first judging step 207-11 of the search step 207-5. When the result of judgement executed at step 207-11 is YES a upward search is made at step 207-12, thereby correcting the counter melody key code to obtain a value larger than the key code MIN.

Where the search in the max/min mode is executed at step 207-5, the search in the number of time mode would not be executed at step 207-6. Conversely, when the result of judgement executed at step 207-3 is NO, at step 207-6 a search is made in the number of time mode, but the search in the max/min mode is not executed at step 207-5.

At step 207-4 of the step 207-6, a judgement is made as to whether the number of times TC (x) of generating the counter melody notes stored in the number-of-times counter register TCR is greater than the set number of times TV(N) set in the set number-of-times register TVR or not. When the result of this judgement is YES, it means that the counter melody note was generated a predetermined number of times during upward or downward motion. Then at step 207-42, the counter register TCR is cleared to change TC (x) to "0" and to invert the state of the up/down flag U/D FLG (from "1" to "0" or vice versa). Thus the motion is changed from upward to down ward or vice versa. Then at step 207-43 a judgement is made as to whether the state of the up/down flag U/D FLG is "1" or not. The result NO of the step 207-41 means that the motion is still rising or lowering so that the step is advanced to the step 207-43 without executing step 407-42 described above.

When the result of judgement executed at step 207-43 is YES, the upward search is made at step 207-44 in the same manner as the step 207-5 described above, whereas when the result is NO a downward search is made at step 207-45. The upward search and the downward search executed at steps 207-44 and 207-45 of step 207-6 are identical to those executed at steps 207-12 and 207-13 of step 207-5.

At step 207-46 the content TC (x) of the number-of-times counter register TCR is counted up or incremented by 1 and thereafter the step is advanced to step 207-40.

At step 207-40 a judgement is made as to whether the counter melody key code CMKC to be presently produced and stored in register CMK is equal to the 7th degree note leading note or not, this processing items relating to improvement (6). More particularly, based on the tonality data KNC, Maj and Min stored in the tonality register KR, a note code NC7 representing the note name of the 7th degree note at the tonality shown by the tonality data KNC, Maj and Min is read out from the data memory device 170 (FIG. 13) and a judgement is made as to whether the note code NC7 of the 7th degree note coincides with the note code portion NC of the counter melody key code CMKC or not. In the case of the 7th degree note, the program is returned to the step 207-3 "TMR="1"?" to execute again the search step 207-5 or 207-6 for changing the counter melody key code to the key code of a note other than the 7th degree note.

At step 207-50, a judgement is made as to whether the intevals of the counter key melody stored in the register CMKCR and the upper keyboard depressed key key code UKC stored in the old upper keyboard key code register OUKCR or the pedal keyboard depressed key key code PKC stored in the pedal keyboard key code register PKCR are parallel (perfect 8th or perfect 5th) or not. Where the intervals are parallel (YES) the program is returned to step 207-3 described above to execute again search step 207-5 or 207-6 so as to change the counter melody key code CMKC to a value not forming parallel intervals. Where the intervals are not parallel (NO), the counter melody note search processing routine 207 is completed and the program is advanced to the processing routine after search 208.

Figure 20:
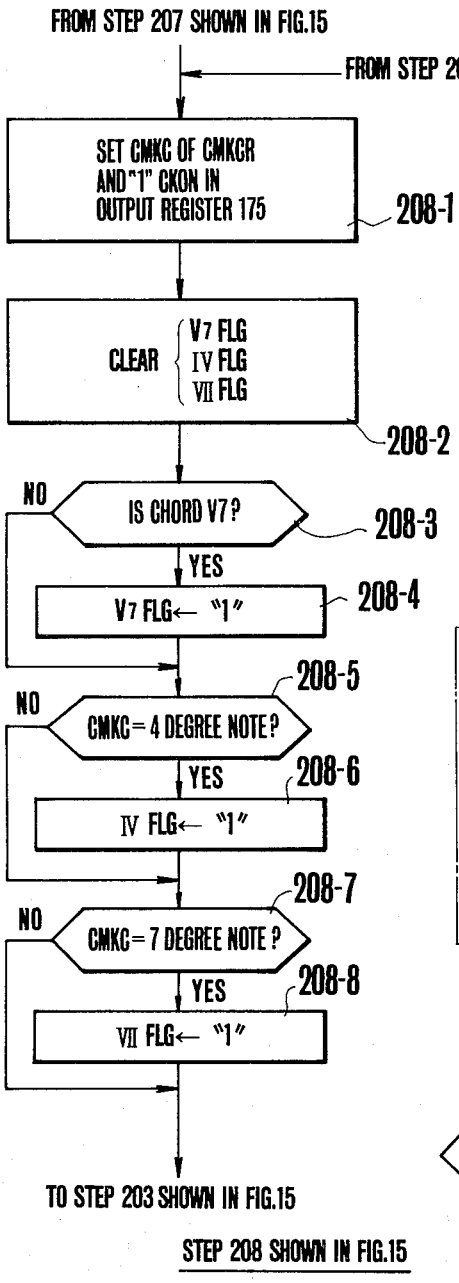
FIG. 20 is a flow chart showing the detail of the after-search-processing routine shown in FIG. 15.

The detail of this routine is shown in FIG. 20. In this routine, at first, at step 208-1 a counter melody key code CMKC stored in the register CMKCR is set in the output register 175 (FIG. 13), while the counter melody key-on signal CKON is set to "1" whereby a musical tone signal of a new counter melody note is produced by the counter melody musical tone signal forming circuit 21 (FIG. 13) based on the key code CMKC and the key-on signal CKON newly stored in the output register 175.

Then, at step 208-2, the V7 chord flag V7FLG, the 4th degree note flag IVFLG and the 7th degree note flag VIIFLG are cleared and at the next step 208-3 a judgement is made as to whether the chord (that is the present accompaniment chord) is the chord of V7 (dominant 7th chord) or not. Such judgement can be made by comparing the chord name data RNC, M, m and 7th with the tonality data KNC, Maj and Min which are stored in the tonality register KR and then comparing the result of this comparison with the data of the reference chord V7 read out from the data memory device 170 (FIG. 13). The judgement executed at step 208-3 is made for adopting improvement (7), and when the result of this judgement is YES, at step 208-4 the V7 chord flag V7FLG is set to "1".

At the next step 208-5, a judgement is made as to whether the counter melody key code CMKC stored in the register CMKCR and now produced as a musical tone is a 4th degree note or not. Like the processing executed at step 207-40 shown in FIG. 19, based on the tonality data KNC, Maj and Min stored in the tonality register KR, a note code NC4 representing the note name of the 4th degree note of the tonality now being designated is read out from the data memory device 170 (FIG. 13), and a judgement is made as to whether this read out note code NC4 coincides with the note code portion NC of the counter melody key code CMKC or not. When the result of judgement is YES, at step 208-6 the 4th degree note flag IVFLG is set to "1".

At the next step, the counter melody key code CMKC now being produced as a musical tone and stored in the register CMKCR is a 7th degree note or not in the same manner as above described. When the result of judgement is YES, at step 208-8, the 7th degree note flag VIIFLG is set to "1".

By the processings described above, a preliminary condition of the end theory holds, that is the fact that a counter melody note of 4th or 7th degree has been produced corresponding to the V7 chord (dominant 7th chord). Only when this preliminary condition is satisfied, the flag V7FLG is st to "1" and the flag IVFLG or VIIFLG is also set to "1".

Figure 21:
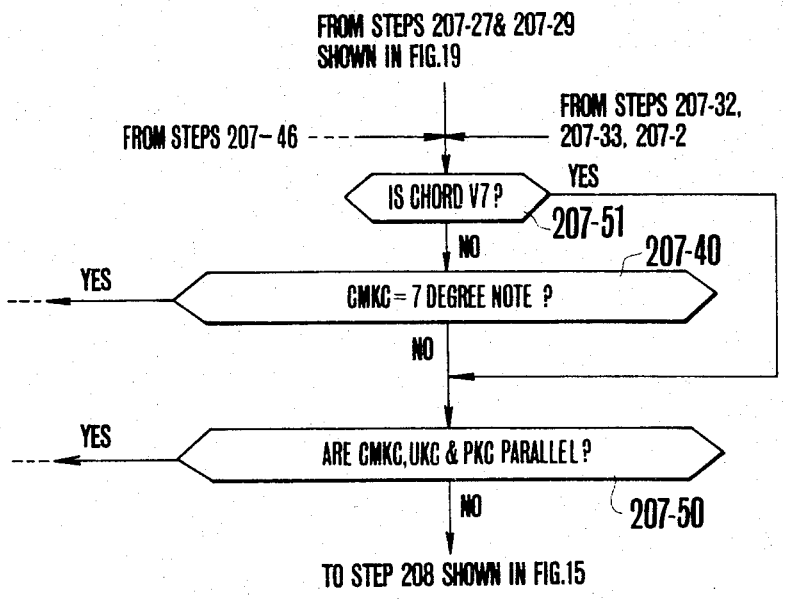

In this embodiment, only when the result of judgement executed at step 207-50 is NO, the program is advanced to the next step and this processing inhibits the leading note (7th degree note) [improvement (6)]. Consequently, under a normal condition, the result of judgement executed at step 208-8 would not become YES. However, when a priority is given to the inhibition processing [improvement (7)] instead of the leading note inhibition processing [improvement (6)] the step 207-40 shown in FIG. 19 is eliminated, or as shown in FIG. 21, step 207-51 (same as step 208-3 shown in FIG. 20) is inserted before the step-40 shown in FIG. 19, and when the result of judgement regarding V7 chord is YES, that is when the accompaniment chord is the V7 chord, the step is jumped to step 207-50 thus invalidating step 207-40. Only when the result of judgement executed at step 207-51 is 150, or where the accompaniment chord is a chord other than the V7 chord, at step 207-40 a judgement is made as to whether the key code CMKC is a 7th degree note or not. Then the step 208-7 shown in FIG. 20 becomes efficient.

When the processing routine after search is completed the program is returned to step 203 shown in FIG. 15 for executing again succeeding steps.

When the counter melody note is not changed, that is where the depressed key state of the lower keyboard does not change, no new key is depressed on the upper keyboard, and no new rhythm pattern is generated, all of the lower keyboard depressed key state change flag LCKOFLG, the upper keyboard new key-on flag UNKOFLG and the rhythm pulse change flag RPCFLG are not set to "1" (they are held in cleared state in the previous counter melody change control routine (FIG. 17)) so that in the counter melody change control routine 205 after sequentially executing steps 205-14, 205-16 and 205-18 (see FIG. 17) the program is returned to step 203. Consequently, when the counter melody note is not changed the step 205 of countermelody change control routine including step 203 and 204 is repeated.

Where the counter melody note is to be changed, in the counter melody change control routine, the program is not advanced to step 203 but advanced to step 206 via step 205-20 (FIG. 17) thus executing the search preprocessing routine and the processing routine after search at steps 207 and 208 respectively.

Where the improvement (end theory) is incorporated, in the search preprocessing routine 206 the program is branched to end processing 179 (FIG. 18) and then advanced to the processing routine after search 208 (FIG. 20) by jumping over the counter melody not search processing routine 207 (FIG. 19).

When an accompaniment chord corresponding to the previous counter melody note is a V7 chord, the V7 chord flap V7FLG is set to "1" in the previous processing routine after search 208 (FIG. 20) so that the content of this flag V7FLG remains at "1". As a consequence where a chord progression (change from V7 chord to I chord) which is a condition of end appears, in the search preprocessing routine 206 (FIG. 18), the result of judgement executed at step 206-8 is YES (present chord is I chord) and the result of judgement executed at step 206-9 is also YES (preceeding chord is V7 chord) so that the program is advanced to the end processing step 206-10 instead of step 207 shown in FIG. 15.

Where the previous counter melody note produced corresponding to V7 chord is a 4th degree note, in the previous processing routine after search (FIG. 20), the 4th degree note flag IVFLG is set to "1" and the result of judgement as to whether IVFLG is "1" or not executed at step 206-11 of the end processing step 206-10 is YES. When the previous melody note produced corresponding to chord V7 is a 7th degree note the 7th degree note flag VIIFLG is se to "1" in the previous processing routine after search (FIG. 20) so that the result of judgement executed at step 206-12 of the end processing step 206-10 is YES (the result of judgement as to whether IVFLG is "1" or not is NO). Where the previous memory note generated corresponding to the V7 chord is not the 4th nor 7th degree note the results of steps 206-12 and 206-13 are both NO so that the program is returned to step 207 to start the counter melody note search processing routine (FIG. 19) and the end theory is not applied.

In the end processing step 206-10 when the result of judgement IVFLG="1"? executed at step 206-11 is YES, the step 206-13 is executed at which a note code NC3 representing a 3rd degree note of a tonality designated in accordance with the tonality data stored in the tonality register KR is read out from the data memory device 170 (FIG. 13), and this 3rd degree note code NC3 is combined with an octave code OC (OMKC) of the previous counter melody key code CMKCC in this case 4th degree note) stored in the counter melody key code register CMKCR to form a counter melody key code CMKC for the 3rd degree note and the combination is stored in the register CMKCK. Where the counter melody key code for the 3rd degree note thus formed is not in a predetermined note range (outside of the range between MAX and MIN), the value of the octave code OC (CMKC) is suitably corrected.

When the result of judgement at the whether VIIFLG is "1" or not executed at step 206-12 is YES, the step 206-14 is executed at which the note code NC1 representing 1st degree note of the designated note is combined with the previous counter melody key code CMKC (in this case 7th degree note) to form a counter melody key code CMKC for the 1st degree note, and the combination is stored in the counter melody key code register CMKCR. Also in the same manner as above described, the value of the octave code OC (CMKC) is suitably corrected to be in a predetermined note range.

After selecting the 3rd or 1st degree note in the counter melody key code register CMKCR at step 208 the processing routine after search (FIG. 20) is executed. Accordingly, the 3rd or 1st degree note is produced as a counter melody note thus giving an end feeling.

In the counter melody search routine executed at step 207 shown in FIG. 19, after the initial key code INTKC has been set in the register CMRCR at the step 207-2, the program is immediately advanced to step 207-40 where a judgement is made as to whether CMKC is a 7th degree note or not. Where result shows that the CMKC is not the 7th degree note or no parallel relation occurs, the initial key code INTKC set becomes the key code CMKC of an initial counter melody. Consequently, where a key code on the outside of the lower max/min key code MAX/MIN range is set as the initial key code INTKC, the initial counter melody note would be produced as a tone in a range outside of the set note range (MAX/MIN range).

Figure 22:
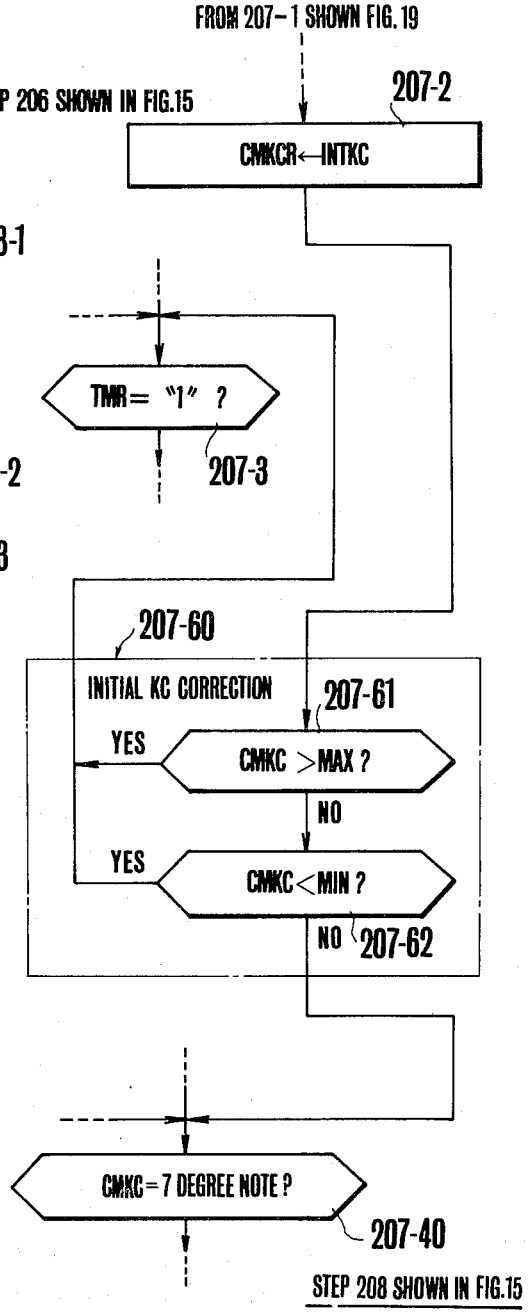
FIG. 21 and FIG. 22 are partial flow charts showing modifications of the routines shown in FIG. 19.

When the initial counter melody note is set in a set note range (MAX/MIN range) a step 207-60 "initial key code correction processing" as shown in FIG. 22 may be added to the next of step 207-2 shown in FIG. 22. In the initial key code correction processing (step 207-60), at step 207-6, a judgement is made as to whether the key code CMKC (that is the initial key code INTKC) stored in the register CMKCR is greater or not than the upper limit key code MAX stored in the upper limit key code register MAXR. At step 307-62 a judgement is made as to whether the key code CMKC (initial key code INTRC) is smaller than the lower limit key code MIN or not. When the results of steps 207-6 and 207-62 are both NO, it means that the key code CMKC (that is the initial key code INTKC) stored in the register CMKCR is in the range of MAX/MIN, and the program is advanced to step 207-40 where a judgement is made as to whether CMKC is 7th degree note or not (FIG. 19). When either one of the results is YES, it means that the key code CMKC that is the initial key code INTKC is in a range outside of the MAX/MIN range and the program is advanced to step 207-3 "TMR=1?" (FIG.

19) and at step 207-5 or 207-6 (FIG. 19), the search processing is executed. By executing the search processing step 207-5 or 207-6, the counter melody key code CMKC in the register CMKC is changed to a value in the MAX/MIN range.

Figure 23:
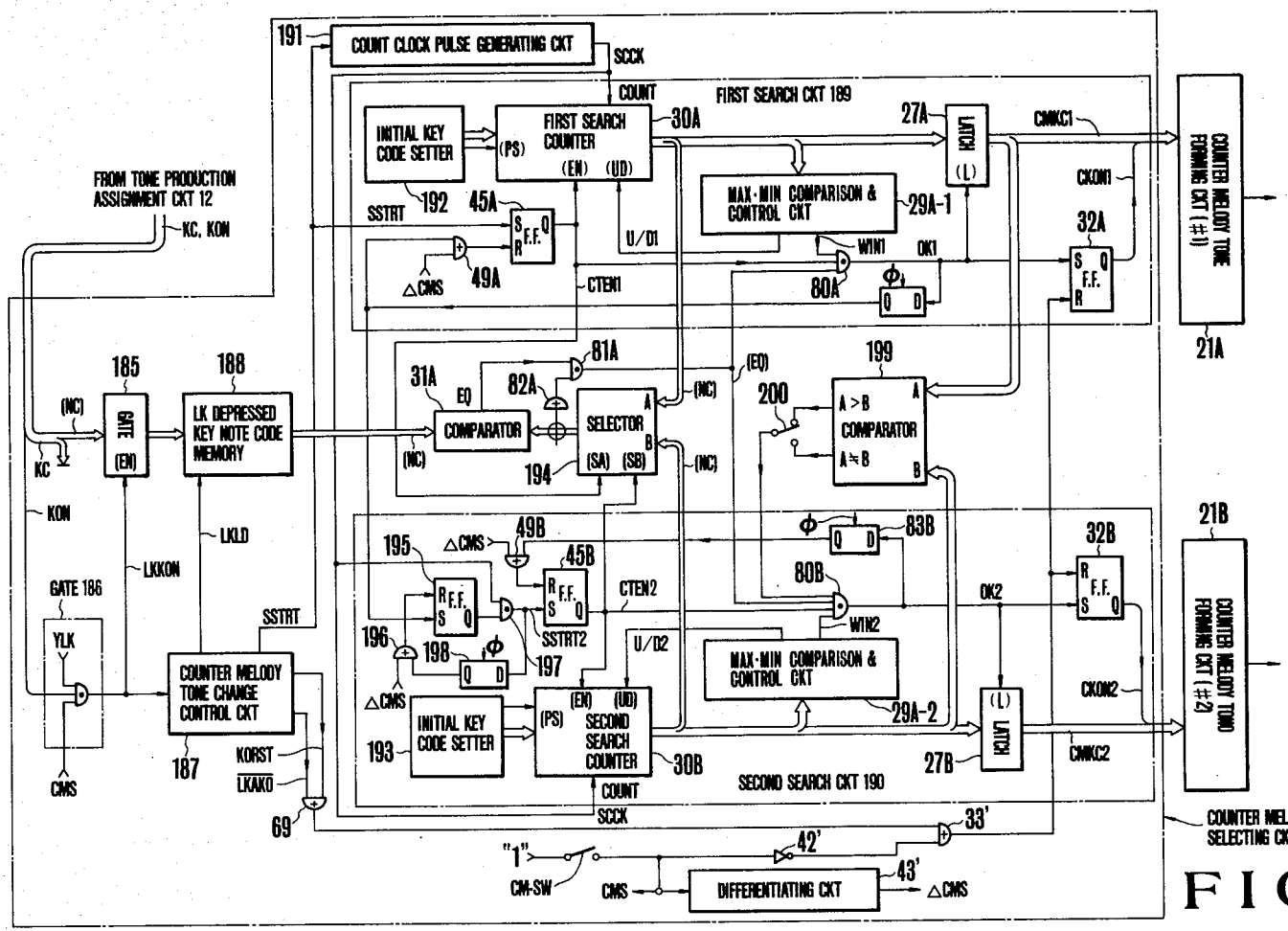
FIG. 23 is a block diagram showing still another embodiment of this invention which is constructed to simultaneously select and produce two counter melody notes.

FIG. 23 is a block diagram showing another embodiment of this invention which is constructed to simultaneously select and produce two counter melody notes. In FIG. 23 only a counter melody note selecting circuit 16B and a counter melody note signal forming circuits 21A and 21B are shown, it should be understood that other circuit elements of the electronic musical instrument (tone production assignment circuit 12 etc.) are identical to those shown in FIG. 1. The circuit shown in FIG. 1 is different from that shown in FIG. 1 in that the counter melody note musical tone signal forming circuits 21A and 21B are provided as two series so that it is possible to independently form two counter melody notes, and that the counter melody note selection circuit 16B can select two counter melody key codes CMKC1 and CMKC2 (and key-on signals CKON1 and CKON2). These two counter melody key codes CMKl and CMKC2 (and key-on signals CKON1 and CKON2) are separately supplied to the first and second counter melody musical tone signal forming circuits 21A and 21B to form counter melody notes corresponding to these key codes CMKC1 and CMKC2 by respective circuits 21A and 21B.

In the counter melody note selection circuit 16B, the note code portions NC of the key codes KC of respective channels supplied from the tone production assignment circuit 12, on the time division basic, are inputted to the lower keyboard depressed key note code gate circuit 185, thus inputting key-on signals of respective channels into the lower keyboard key-on signal gate circuit 186. The constructions and functions of the lower keyboard key-on signal gate circuit 186, the counter melody note change control circuit 187, and the lower keyboard depressed key note code memory device identical to those of the circuits 24, 22 and 26 of the same name shown in FIG. 3. Further, the construction and function of the lower keyboard depressed key note code gate circuit 185 are identical to those of the note code gate circuit 25A shown in FIG. 8. Also OR gate circuit 33' and 69', building up differentiation circuit 43' and inverter 42' constituting peripheral elements of the counter melody selection switch CM-SW are identical to the OR gate circuits 33 and 69, the building up differentiating circuit 43 and inverter 42 shown in FIG. 3.

Consequently, as the lower keyboard depressed key state varies, the counter melody note change control circuit 187 produce a key-on reset signal KORST which resets the first and second flip-flop circuits 32A, 32B utilized via OR gate circuits 69' and 33' thus forming the counter melody key-on signals. In accordance with the lower keyboard key code load signal LKLD, the note code of the lower keyboard depressed key (chord constituting note) is stored in the lower keyboard note code memory device 188, and thereafter a search start signal SSTRT is produced.

The counter melody note selection circuit 16B compries two series of the search circuits 189 and 190. Search counters 30A and 30B, counter melody key code latch circuits 27A and 28B, max/min comprison control circuits 29A-1 and 29A-2, AND gate circuits 80A and 80B, counter melody key-on signal forming flip-flop circuits 32A and 32B, delay flip-flop circuits 83A and 833, counter operation control flip-flop circuits 45A and 45B, and OR gate circuits 49A and 49B respectively contained in the search circuits 189 and 190 are identical to the circuit elements of the same name 30, 27, 29A, 80, 32, 83, 45 and 49 shown in FIG. 3.

The count clock pulse generator 191 is identical to circuit constituted by OR gate circuit 75, shift register 77 and NOR gate circuit 78 shown in FIG. 3 and repeatedly produces a count clock pulse SCCK at every 8 microseconds after generation of the search start signal SSTRT. The count clock pulse SCCK generated by the count clock pulse generator 191 are used in common in the first and second search circuits 189 and 190.

Only one comparator 51A is provided for comparing the lower keyboard depressed key note code NC outputted from the lower keyboard depressed key note code memory device 188, on the time division basis, with the count of the search counter, and this comparator 31A is commonly utilized by two search counters 30A and 30B on the time division basis.

Initial key-code setters 192 and 193 are provided for presetting the initial key code in the search counters 30A and 30B. The initial key code may be preset by any method as has already been described with reference to FIGS. 3 or 8.

The operation of the circuit shown in FIG. 23 will now be described with reference to the timing chart shown in FIG. 24.

The counter operation controlling flip-flop circuits 45A and 45B are reset by a counter melody start pulse CMS or search completion signals OK1 and OK2 applied through OR gate circuits 49A and 49B and delayed one microsecond. Consequently, before generation of the search start signal SSTRT, both flip-flop circuits 45A and 45B are reset state. Upon generation of the search start signal SSTRT, the first flip-flop circuit 45A supplied with this search start signal SSTRT at its set input S is firstly set. Accordingly, the first count enablng signal CTEN1 outputted from the flip-flop circuit 45A changes to "1" thus bringing the search counter 30A to the count enabling state. This first count enabling signal CTEN1 is also applied to the AND gate circuit 80A and to the A selection control input SA of the selector 194.

When signal "1" is applied to the A selection control input SA, the selector 194 selects the output (note code portion NC) of the first search counter 30A supplied to its A input, and applies the selected output to the comparator 30A. Thus at first the count (note code portion) of the first search counter 30A is compared by comparator 31A with the lower keyboard depressed key note code NC read out for the memory device 188. The output EQ of the comparator 31A is applied to AND gate circuits 80A and 80B via AND gate circuit 81A. When the first counter enabling signal CTEN1 is "1", the AND gate circuit 80A is enabled, but the AND gate circuit 30B of the second search circuit 190 is not enabled because CTEN2 is "0". AND gate circuit 81A and OR gate circuit 82A are provided to block a coincidence signal EQ corresponding to note codes of all "0" just like the AND gate circuit 81 and OR gate circuit 82 shown in FIG. 3.

The first search counter 30A counts the number of the count clock pulses SSCK until the comparator 31A generates a coincidence signal EQ for causing the AND gate circuit 80A to produce a search completion signal OK1. Upon generation of the search completion signal OK1, the count of the first search counter 30A is latched in the first counter melody key code latch circuit 27A, while the first counter melody key-on signal forming flip-flop circuit 32A is set. This search completion signal OK1 is delayed one microsecond by the delay flip-flop circuit 83A, and then applied to the flip-flop circuit 45A via OR gate circuit 49A and to the set inputs of the flip-flop circuit 195 in the second search circuit 190 whereby the flip-flop circuit 45A is reset and the first counter enabling signal CTEN1 changes to "0" thus stopping the counting operation of the first search counter 30A.

Figure 24:
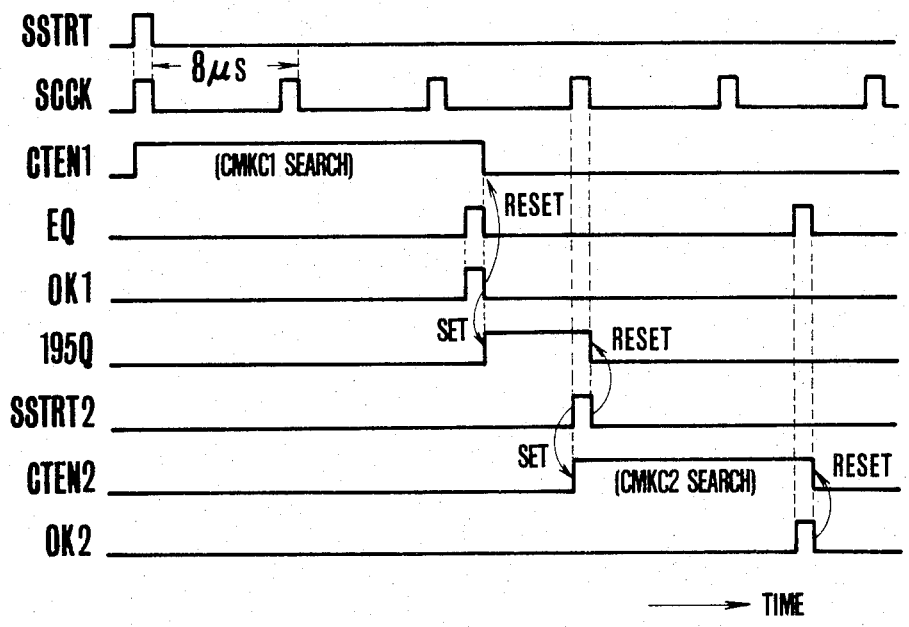
FIG. 24 is timing chart showing an example of the operation of the counter melody note search circuit shown in FIG. 23.

The flip-flop circuit 195 has already been reset by a signal from OR gate circuit 196 and its state changes to set state a search completion signal OK1 delayed one microsecond is applied to its set input whereby the output Q of the flip-flop circuit 195 changes to "1" (see 195Q shown in FIG. 24). This output "1" of the flip-flop circuit 195 is applied to one input of an AND gate circuit 197 with the other input supplied with the count clock pulse SCCK. Consequently, when the first count clock pulse SCCK is generate after the output Q of the flip-flop circuit 195 has changes to "1" the output of the AND gate circuit 197 becomes "1" which is applied to the set input S of the second counting operation control flip-flop circuit 45B to act as a second search start signal SSTRT2 (see STRT2 shown in FIG. 24). The output "1" is delayed one microsecond by the delay flip-flop circuit 189 and then applied to the reset input R of the flip-flop circuit 195 via OR gate circuit 196.

Thus, the second counting operation control flip-flop circuit 45B is set by the second search start signal SSTRT2 so that the second counter enabling signal CTEN2 outputted from this flip-flop circuit 45B changes to 19 (see CTEN2 shown in FIG. 24) and the flip-flop circuit 195 is reset (see 195Q shown in FIG. 24). The second counter enabling signal is applied to the enabling input EN of the second search counter 30B and to the B selection control input SB of the selector 194 as well as an AND gate circuit 80B.

When signal "1" is applied to the B selection control input SB1 the selector 194 selects the output (note code portion NC) of the second search counter 30B applied to its B input and applies the selected output to the comparator 30A. Since the second search start signal SSTRT 2 outputted from the AND gate circuit 197 is synchronous with the output timing of the count clock pulse SCCK, the second counter enabling signal CTEN2 also builds up on synchronism with the pulse SCCK so that the search counter 30B is counted up (or down) one by pulse SCCK at the same time when it is enabled to count. In the second search counter 30B, like the first search counter 30A, the number of the count clock pulses SSCK is counted until the AND gate circuit 80B produces a second search completion signal OK2 according to the coincidence signal EQ outputted from the comparator 31A. However, the condition of producing the search completion signal from the AND gate circuit 80B is not same as that of AND gate circuit 80A.

To the AND gate circuit 80B is applied the output of the comparator 199 via a selection switch 200. This is made for the purpose of searching with the second search circuit 190 a note different from that searched with the first search circuit 189. To the A input of the comparator 199 is applied the output of a latch circuit 27A of the first search circuit 189, that is a key code CMKC1 showing the first counter melody note now to be produced as a musical tone and has just bee searched, where as to the B input is applied the output of the second search counter 30B. The output A>B of the compartor 199 becomes "1" when the A input is larger than the B input and the output A≠B becomes "1" when A input and B input do not coincide with each other. Selection switch 200 is provided for providing a mode in which the first counter melody note (a note formed by circuit 21A according to key code CMKC1) is made to be higher than the second counter melody note (a note formed by circuit 21B according to key code CMKC2) or a mode in which the tone pitches of the first and second counter melody notes are made to be different irrespective of the fact that which one is higher. Where the former mode is selected, the switch 200 is thrown to the position shown for applying the output A>B of the comparator 199 to AND gate circuit 80B. Where the latter mode is selected the switch 200 is thrown to the opposite position for applying the output A≠B of the comparator 199 to the AND gate circuit 80B. Where the selection switch 200 is set to A>B as shown, the AND gate circuit 803 is enabled provided that the count of the second search counter 30B is smaller than the first counter melody key code CMKC1 latched in the latch circuit 27A. When the switch is set to A≠B, the AND gate circuit 80B is enabled provided that the count of the search counter 30B is not equal to the first counter melody key code CMKC1 latched in the latch circuit 27A. When the signal outputted from the selection switch 200 is "1", that is when aforementioned condition is satisfied, the comparator 31A produces a coincidence signal EQ and when the output of the AND gate circuit 81A become "1", the output of the AND gate circuit 80B becomes "1", thus producing the second completion signal OK.

Based on this signal OK, the count of the second search counter 30B is latched by a counter melody key code latch circuit 27B for setting the second counter melody key-on signal forming flip-flop circuit 32B (CKON2 becomes "1"). One microsecond later than the second search completion signal OK2, the output of the delay flip-flop circuit 83B becomes "1" which sresets the counting operation control flip-flop circuit 45B via OR gate circuit 49B, whereby the second counter enabling signal changes to "0" thus stopping the counting operation of the second search counter 30B.

As above described, by the operation of the first and second search circuits 189 and 190, two counter melody key codes CMKC1 and CMKC2 are searched and are respective latched by latch circuits 27A and 27B. Similar to the circuit 29A shown in FIG. 3 the max/min comparison control circuits 29A-1 and 29A-2 produces up/down control signals U/D1 and U/D2 which respectively control the count mode (up or down) of the first and second search counters 30A and 30B. Signals given WIN1 and WIN2 from max/min comparison control circuits 29A-1 and 29A-2 to AND gate circuits 80A and 80B are similar to signal WIN shown in FIG. 8 (FIG. 10). The tone colors of the counter melody tones formed by the first and second counter melody musical tone signal forming circuits 21A and 21B may the same or different.

Although in the foregoing embodiments, a key code was used as an information representing a depressed key note or a counter melody note, the invention is not limited to an electronic musical instrument utilizing a key code made up of a plurality of bits. Further, while in the search section of the foregoing embodiments, the counter melody note is searched (scanned) by combining search counters with a comparator, it is also possible to use other scanning circuits of different construction (for example, a shift register). When controlling the switching between up and down according to the number of times of generating the counter melody key note during or down operation, the number settings of the up and down may be made different.

As above described, according to this invention, where a counter melody note corresponding to an accompaniment chord is automatically performed, since the counter melody note is selected according to a predetermined progression mode each time the accompaniment chord is changed, a counter melody performance rich in variety can be realized. Especially, the counter melody performance has a unique melody development according to a predetermined progression pattern without relying upon only the accompaniment chord and specific counter melody effect different from the prior and counter melody performance. Furthermore, as the counter melody note is changed in response to a key depression of the melody performance keyboard (upper keyboard) or to the generation of rhythm pulse where the accompaniment chord does not vary appreciably there is no fear of imparting a feeling of prolonged counter melody performance. Since the selection of the counter melody note is controlled by considering such musical theory as the end theory it is possible to provide an automatic counter melody performance rich in variety.

What is claimed is:

1. An electrical musical instrument having automatic counter melody performance capability for forming in time a sequence of counter melody tones, comprising:

a keyboard including a plurality of keys;

a circuit for producing accompaniment designating signals that simultaneously designate a plurality of accompaniment notes established by the depression of at least one key;

a detection circuit for detecting a variation in the depressed key status of said keyboard between the presently depressed set of keys and the most recent previously depressed set of keys different from said presently depresset set, and for producing an output when such variation is detected;

pattern designating means for designating the tonal order relationship between successive counter melody tones in accordance with a preestablished pattern of such relationships;

a selection circuit, operative in response to an output of said detection circuit and cooperation with said pattern designating means, for selecting, for the second and each subsequent counter melody tone of said sequence, from among the accompaniment note designating signals established by the presently depressed set of keys, a signal corresponding to that note which has the tonal order relationship, with respect to the previous counter melody tone most recently formed by said instrument, that is designated by said pattern designating means, and a musical tone signal forming circuit for forming a counter melody musical tone in accordance with the note corresponding to the signal selected by said selection circuit, said formed musical tone being unchanged until the next variation in depressed key status is detected.

2. An electronic musical instrument according to claim 1 wherein said preestablished pattern includes portions in which the tone pitches of said musical tones to be formed are sequentially raised and other portions in which the tone pitches are sequentially lowered.

3. An electronic musical instrument according to claim 2 further comprising means for establishing said pattern by predetermining an upper limit note and a lower limit note of said musical tones to be formed and then sequentially combining a portion between said upper and lower limit notes in which the tone pitch is to by sequentially raised and another portion between said upper and lower limit notes in which the tone pitch is to be sequentially lowered.

4. In a musical performance comprising chords changing timewisely according to a progression, a method of selecting in time a sequence of notes to constitute a counter line melody in accordance with an established order of tonal relationships, comprising:

a first step of detecting the set of notes being concurrently played for each of the chords;

a second step of detecting that the set of notes detected for the chord presently being performed is changed from the set of notes detected for the chord next previously performed; and a third step of selecting as the counter line melody note, upon detection of said change, that note from among said new set of notes which has, in accordance with said established order, a predetermined tonal relationship with respect to the note which was next previously selected as the counter line melody note.

5. A method according to claim 4 wherein said third step is a step which selects a note which is not equal to but nearest to the note which was next previously selected.

6. In a musical performance comprising chords changing timewisely according to a progression, each of said chords being constituted by a set of notes, a method of selecting notes to constite a counter line melody comprising:

a first step of detecting the respective sets of notes being concurrently played for the respective ones of said chords;

a second step of detecting a change in the sets of notes from one set of notes into a new set of notes; and a third step of selecting a note, upon detection of said change, from among said new set of notes according to a predetermined musical rule which takes into account the note which was selected, preceding said change, from among said one set of notes, said third step occurring for the second and each subsequently selected counter melody note.

7. In an electronic musical instrument, a system for producing counter melody tones in accordance with a predetermined progression pattern in response to successively played accompaniment chords, comprising:

selecting means for selecting a single note from among the notes of each successively played accompaniment chord, the single note selected during the playing of one accompaniment chord having a tonal order relationship with respect to the note selected during playing of the next preceding accompaniment chord established by said predetermined progression pattern, for the second and each subsequently produced counter melody tone and means for producing musical tones corresponding to said selected notes with a uniform tone color different from the tone color with which said accompaniment chords are produced.

8. For use in an electronic musical instrument in which accompaniment tones are produced, a counter melody performance system for supplying in time a sequence of counter melody notes, comprising:

counter melody progression pattern designating means for establishing a predetermined order of tonal relationships in which counter melody notes are to be selected from among the produced accompaniment tones, and counter melody note selecting means, operative each time that the produced accompaniment tones are changed, for searching from among the new accompaniment tones for the note having, with respect to the next previously supplied counter melody note, the next tonal relationship in said order and for supplying that note as said counter melody note, said searching being done for the and each subsequent counter melody note of said sequence.

9. A counter melody performance system in accordance with claim 8 further comprising:

means for storing said supplied note and for using the stored supplied note to establish the start of search for the next operation of said selecting means.

10. A counter melody performance system according to claim 8 wherein notes in musical scale order are represented by correspondingly ordered binary codes and wherein said selecting means comprises:

a counter, the contents of said counter representing a note code, and search means, operative upon a change of said accompaniment tones, for rapidly progressively altering the contents of said counter in accordance with said predetermined order until the contents of said counter correspond to the note code of one of the new accompaniment tones, said counter then being stopped, the contents of said contents then establishing said supplied counter melody note, said contents being stored in said counter as the start of counting at the next change of accompaniment tones.

11. An electronic musical instrument comprising:

keyboard means including playing keys capable of being operated by a player of the instrument for designating respective notes;

note signal producing means coupled with said keyboard means for producing note designating signals that designate a plurality of notes corresponding to operated ones among said keys;

note change detection means connected to said note signal producing means for producing a detection output when detecting a change in said note designating signals;

selection means, connected to said note signal producing means and said note change detection means, for selecting a signal from among said note designating signals after said change upon receipt of said detection output according to a predetermined rule, said rule being that the selected signal is a signal of a note determined to be of a first priority from among said plurality of notes according to a predetermined priority order if a selection is of a timewisely first occurrence in a musical performance and further that the selected signal is of a note determined from among said plurality of notes according to a predetermined priority order with respect to the preceding note selected by said selection means if a selection is each of other occurrences than the timewisely first one, said selection menas including means for detecting said preceding selected note and means for outputting a signal of the note being now selected as a selection output; and musical tone signal forming means connected to said note signal producing means and said selection means for forming musical tone signals corresponding to said note designating signals in a first fashion and a musical tone signal corresponding to said selection output in a second fashion different from said first fashion.

12. An electronic musical instrument according to claim 11 which further comprises another selection circuit, which in response to an output of said first mentioned selection circuit, selects another signal corresponding to another one of said designated notes according to a condition related to the last preveiously selected note, whereby said first and second musical tone signal forming circuit forms musical signals based upon outputs of said first mentioned selection circuit and said another selection circuit.

13. An electronic musical instrument according to claim 12 wherein said first mentioned selection circuit comprises a first search circuit, which when a change in said chord is detected, starts a scanning toward a high tone side or a low tone side and stops the scanning when a note of the same note name as a chord constituting tone is detected during said scanning, for selecting said note as a first selected note, and wherein said another selection circuit comprises a second search circuit, which starts scanning towards the high tone side or low tone side after stopping the scanning of said first search circuit, the scanning of said second search circuit being stopped when a note of the same note name as said chord constituting tone and different from said first selected note is detected during the scanning by said second search circuit, this producing said different note as a second selected note.

14. An electronic musical instrument according to claim 11 wherein said selection means includes a memory means for storing the selected signal which was selected before said change and selects a signal from among the note designating signals after said change based on the stored signal.

15. An electronic musical instrument according to claim 11, wherein said plurality of designated notes constitute a chord.

16. An electronic musical instrument according to claim 15 which further comprises a circuit for designating a tonality of a music to be performed, chord detection means for detecting a chord name designated by said keyboard, an end preliminary condition judging circuit for judging whether a preliminary condition that satisfies a condition of terminating said music has been satisfied or not according to said designated tonality, said detected chord name and a note selected by said selection circuit means, and an end circuit for substituting a predetermined end note for the note selected by said selection circuit when it is judged that said end preliminary condition has been satisfied and then when a change of the depressed key state has been detected, and wherein an output of said end circuit is applied to said musical tone signal forming circuit.

17. An electronic musical instrument according to claim 16 wherein said end preliminary condition judging circuit operates to judge whether a 4th degree note or a 7th degree note of a performance tonality has been selected together with a dominant chord as a selected note, and said substituting circuit operates, when a tonic triad chord is detected as an end chord, to substitute a 3rd degree note as the end note in place of a previously selected 4th degree note, and operates to substitute a 1st degree note as the end note in place of a previously selected 7th degree note.

18. An electronic musical instrument according to claim 11 which further comprises second keyboard means including second playing keys to be operated by the instrument player, and second note change detection means coupled with said second keyboard means and to said selection means for producing a second detection output when detecting a change in operation of said second keys, said second detection output being supplied to said selection means so that selection should take place also upon receipt of this second detection output.

19. An electronic musical instrument according to claim 11 wherein said note signal producing means includes a first memory means for storing the note designating signals produced after said change and wherein said selection means includes a second memory means for storing the selected signal which was selected preceding said change, said selection means selecting from among the note designating signals stored in said first mnemory means a signal which is nearest in terms of note to the selected signal stored in said second memory means.

20. An electronic musical instrument according to claim 11 wherein said selection means selects from among the note designating signals after said change a signal of a note which is not equal to but nearest to the note designated by the selected signal preceding said change.

21. An electronic musical instrument according to claim 20 wherein said selection means selects from among the note designating signals after said change a signal which is nearest in terms of note to the stored signal in said memory means.

22. An electronic musical instrument according to claim 20 which further comprises up/down control means for selectively designating either one at a time of an up mode and a down mode and being connected to said selection means, and wherein said selection means selects from among the note designating signals after said change a signal of a note which is higher than and nearest to the note designated by the selected signal preceding said change while the up mode is designated by said up/down control means but a signal of a note which is lower than and nearest to the note designated by the selected signal preceding said change while the down mode is designated by said up/down control means.

23. An electronic musical instrument according to claim 22 wherein said selection circuit comprises an up/down control circuit for producing an up/down control signal which designates up or down of said note, a note search circuit, which when a change in said chord is detected, starts a scanning toward a high tone side or a low tone side according to a designation of said up/down control signal and stops the scanning when a note of the same note name as a chord constituting tone is detected during said scanning thus selecting said note, and a circuit for setting an initial note, said note search circuit starting said scanning from said initial note and then restarting said scanning from a position at which said scanning has been stopped thus sequentially shifting said note from said initial note towards a high tone side or a low tone side.

24. An electronic musical instrument according to claim 22 which further comprises;

a note limit setting means for setting an upper limit note and a lower limit note; and range keeping means connected to said note limit setting means, to said selection means and to said up/down control means for keeping the note of the selected signal within a range between said upper limit note and said lower limit note by controlling the selective designation of said up and down modes.

25. An electronic musical instrument according to claim 24 wherein said selection circuit comprises an up/down control circuit which generates an up/down control signal that designates up or down of the tone pitch, and a scanning circuit which starts a scanning according to a designation of said up/down control signal and stops the scanning when a note of the same note name as one of said designated notes is detected during scanning for selecting said note as a selected note, and a circuit for repeating start and stop of said scanning each time a variation in said depressed key state is detected thereby gradually shifting said selected note toward high or low note side.

26. An electronic musical instrument according to claim 25 further comprising a selected-note search circuit which starts again a search from a position including a previously selected note when a selected note change control signal is generated, and a same note continuation control circuit which counts the number of times of continuously selecting the same note as a selected note, said control circuit controlling when the counted number reaches a predetermined value such that the search is started again from a position not containing the previously selected note.

27. An electronic musical instrument according to claim 25 wherein said up/down control circuit comprises a circuit for setting a predetermined upper limit tone and a predetermined lower limit tone, a comparator for comparing said scanned note with said upper limit note and said lower limit note, and a transfer switch responsive to a result of comparison made by said comparator for transferring said up/down control signal thus controlling a note range in which up and down of said note is repeated.

28. An electronic musical instrument according to claim 25 wherein said up/down control circuit comprises a counter which counts the number of notes selected by said selection circuit, and a transfer switch which transfers said up/down control signal between up and down modes each time a count of said counter reaches a predetermined value, thus alternately repeating up and down modes each time a predetermined number of notes are produced.

29. An electronic musical instrument according to claim 28 wherein said transfer switch comprises circuit for selecting and setting said predetermined number so as to control the number of tones produced during up and down modes.

30. An electronic musical instrument according to claim 25 wherein said up/down control circuit comprises a circuit for setting a direction of progression at an initial state of said up/down control signal, and a circuit for alternately changing the state of said up/-down control signal between up and down modes thus repeatedly rise and lower the tone pitch of said note.

31. An electronic musical instrument according to claim 25 wherein said selection circuit comprises an up/down counter which in response to said up/down control signal counts the number of key codes according to a tone pitch order of a musical tone when the variation in said depressed key state is detected, and a comparator for comparing a note code representing said designated note names with a content of said counter for stopping counting operation thereof when said note code coincides with said count thus outputting a count at which said counting operation stops as a key code representing said note.

32. An electronic musical instrument according to claim 25 wherein said up/down control circuit comprises circuit for switching said up/down control signal to a down mode when a note scanned by said scanning circuit reaches a predetermined upper limit note, whereas switching said up/down control signal to an up mode when said note reaches a predetermined lower limit note.

33. An electronic musical instrument according to claim 25 which further comprises a tonality designation circuit which designates a tonality of a music to be performed, and correcting circuit for correcting said upper and lower limit notes according to the designated tonality.

34. An electronic musical instrument according to claim 33 wherein said correcting circuit comprises a first circuit for correcting said upper limit note to a note of an octave higher than that set by said setting means when said upper limit note is a 7th degree note of the designated tonality, and a second circuit for correcting said lower limit note to a note of an octave lower than that set by said setting means when said lower limit note is a 4th degree note of said designated tonality.

* * * * *